US005507379A

United States Patent [19]

Mazur et al.

[11] Patent Number: 5,507,379

[45] Date of Patent: Apr. 16, 1996

[54] COIN HANDLING SYSTEM WITH COIN SENSOR DISCRIMINATOR

[75] Inventors: Richard A. Mazur, Naperville; Gary Watts, Buffalo Grove; Donald E. Raterman, Deerfield; Robert J. Crawford, Palatine, all of Ill.

[73] Assignee: Cummins-Allison Corp., Mt. Prospect, Ill.

[21] Appl. No.: 149,660

[22] Filed: Nov. 9, 1993

Related U.S. Application Data

[63] Continuation-in-part of Ser. No. 115,319, Sep. 1, 1993, Pat. No. 5,429,550, which is a continuation-in-part of Ser. No. 951,731, Sep. 25, 1992, Pat. No. 5,299,977, which is a continuation-in-part of Ser. No. 904,161, Aug. 21, 1992, Pat. No. 5,277,651, which is a continuation of Ser. No. 524,134, May 14, 1990, Pat. No. 5,141,443.

[51] Int. Cl.[6] ..... G07D 3/14

[52] U.S. Cl. ..... 194/318; 453/10

[58] Field of Search ..... 194/317, 318; 453/6, 10

[56] References Cited

U.S. PATENT DOCUMENTS

| | | | |
|---|---|---|---|
| 3,559,789 | 2/1971 | Hastie et al. . | |
| 3,672,481 | 6/1972 | Hastie et al. . | |
| 3,788,440 | 1/1974 | Propice et al. | 194/318 |
| 3,795,252 | 9/1974 | Black . | |
| 3,910,394 | 10/1975 | Fujita . | |
| 3,921,003 | 11/1975 | Greene . | |
| 3,978,962 | 9/1976 | Gregory, Jr. . | |
| 3,980,168 | 9/1976 | Knight et al. . | |
| 4,111,216 | 9/1978 | Brisebarre . | |
| 4,172,462 | 10/1979 | Uchida et al. | 133/3 A |
| 4,234,072 | 11/1980 | Prumm . | |
| 4,254,857 | 3/1981 | Levasseur et al. . | |
| 4,326,621 | 4/1982 | Davies . | |
| 4,353,452 | 10/1982 | Shah et al. . | |
| 4,407,312 | 10/1983 | Davila et al. | 453/32 |
| 4,462,513 | 7/1984 | Dean et al. . | |
| 4,474,281 | 10/1984 | Roberts et al. . | |
| 4,483,431 | 11/1984 | Pratt . | |
| 4,538,719 | 9/1985 | Gray et al. . | |
| 4,564,036 | 1/1986 | Ristvedt | 453/10 |
| 4,579,217 | 4/1986 | Rawicz-Szcerbo | 194/317 |
| 4,620,559 | 11/1986 | Childers et al. | 133/3 A |
| 4,667,093 | 5/1987 | MacDonald | 250/223 |
| 4,681,128 | 7/1987 | Ristvedt et al. | 453/6 |
| 4,681,204 | 7/1987 | Zimmermann | 194/317 |
| 4,696,385 | 9/1987 | Davies | 194/319 |
| 4,715,223 | 12/1987 | Kaiser et al. | 73/163 |
| 4,731,043 | 3/1988 | Ristvedt et al. | 453/6 |
| 4,753,624 | 6/1988 | Adams et al. | 453/10 |
| 4,850,469 | 7/1989 | Hayashi et al. | 194/318 |
| 4,863,414 | 9/1989 | Ristvedt et al. | 453/6 |
| 4,864,320 | 9/1989 | Munson et al. | 343/833 |
| 4,881,918 | 11/1989 | Goh et al. | 453/4 |
| 4,963,118 | 10/1990 | Gunn et al. | 455/3 |
| 4,966,570 | 10/1990 | Ristvedt et al. | 453/10 |
| 4,971,187 | 11/1990 | Furuya et al. | 194/318 |
| 4,995,497 | 2/1991 | Kai et al. | 194/318 |
| 5,002,174 | 3/1991 | Yoshihara | 194/317 |
| 5,011,455 | 4/1991 | Rasmussen | 453/10 |

(List continued on next page.)

FOREIGN PATENT DOCUMENTS

| | | | |
|---|---|---|---|
| 3808159 | 9/1989 | Germany . | |
| 2117953 | 10/1983 | United Kingdom | 453/6 |

*Primary Examiner*—F. J. Bartuska
*Attorney, Agent, or Firm*—Arnold, White & Durkee

[57] ABSTRACT

A coin sorter for sorting mixed coins by denomination includes a rotatable disc, a drive motor for rotating the disc, and a stationary sorting head having a lower surface generally parallel to the upper surface of the rotatable disc and spaced slightly therefrom. The lower surface of the sorting head forms a plurality of exit channels for guiding coins of different denominations to different discharge stations around the periphery of the disc. A plurality of coin sensor/discriminators are mounted in the stationary sorting head over the rotatable disc for discriminating between valid and invalid coins guided by said stationary sorting head. At least one coin sensor/discriminator is mounted in each of the plurality of exit channels.

37 Claims, 45 Drawing Sheets

U.S. PATENT DOCUMENTS

| | | | |
|---|---|---|---|
| 5,021,026 | 6/1991 | Goi | 453/40 |
| 5,033,602 | 7/1991 | Saarinen et al. | 194/334 |
| 5,067,604 | 11/1991 | Metcalf | 194/203 |
| 5,090,576 | 2/1992 | Menten | 209/587 |
| 5,141,443 | 8/1992 | Rasmussen et al. | 453/10 |
| 5,195,626 | 3/1993 | Le Hong et al. | 194/317 |
| 5,213,190 | 5/1993 | Furneaux et al. | 194/317 |
| 5,230,653 | 7/1993 | Shinozaki et al. | 453/4 |

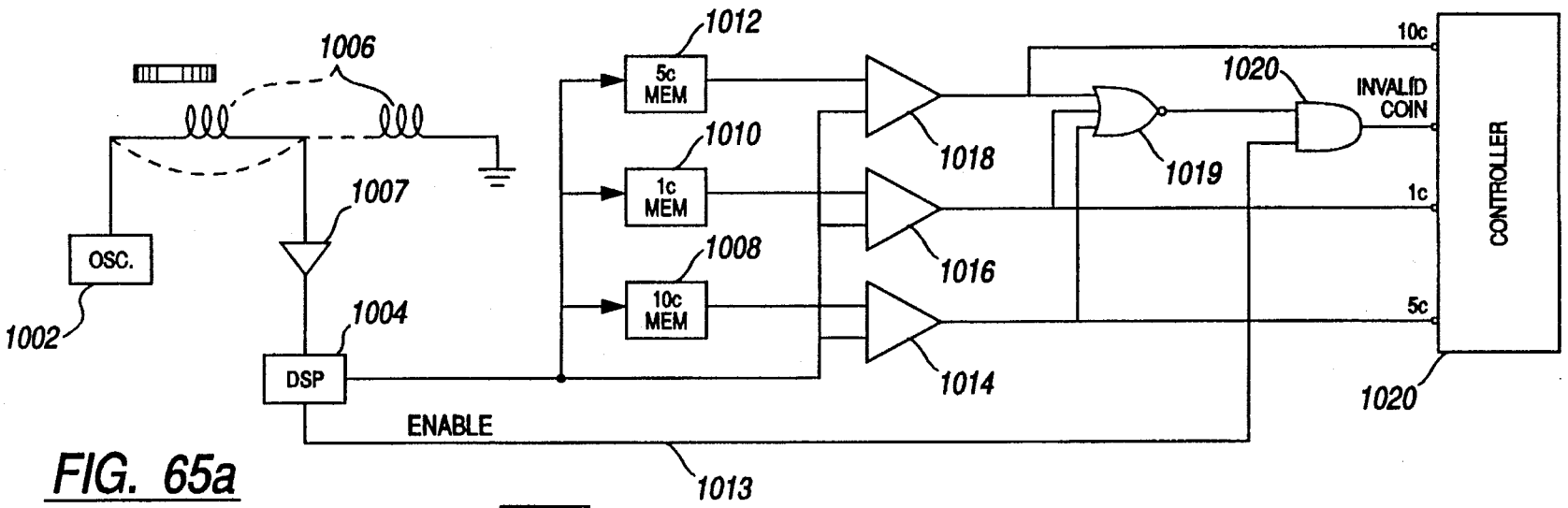
FIG. 65a
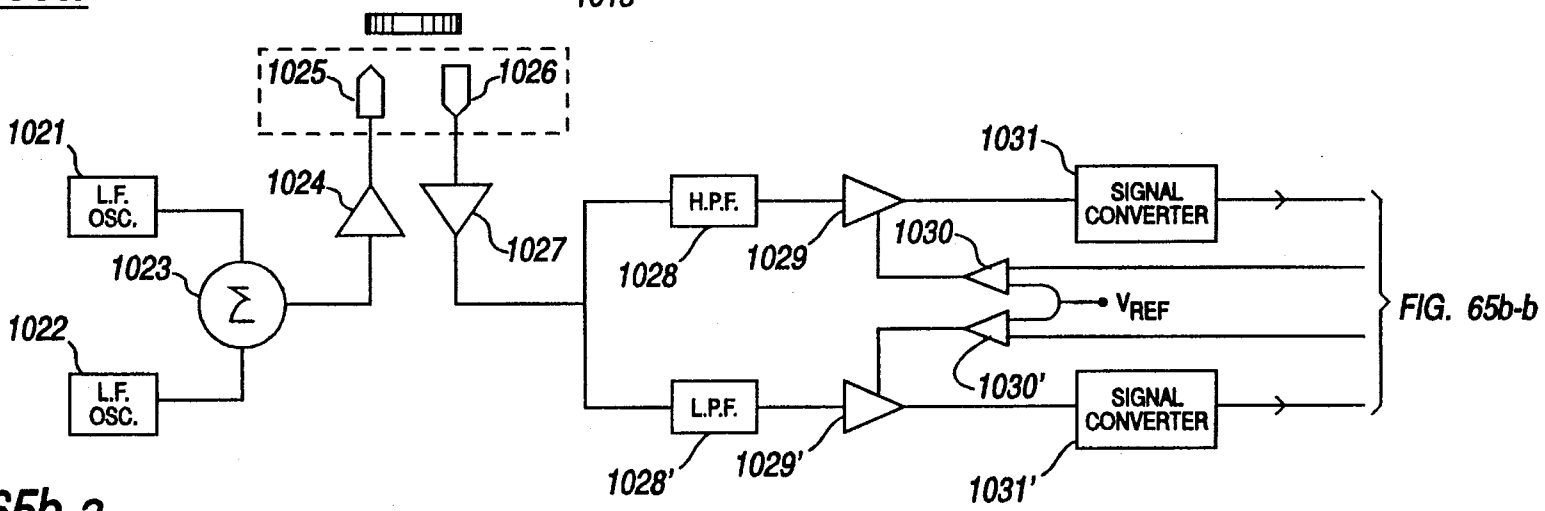
FIG. 65b-a

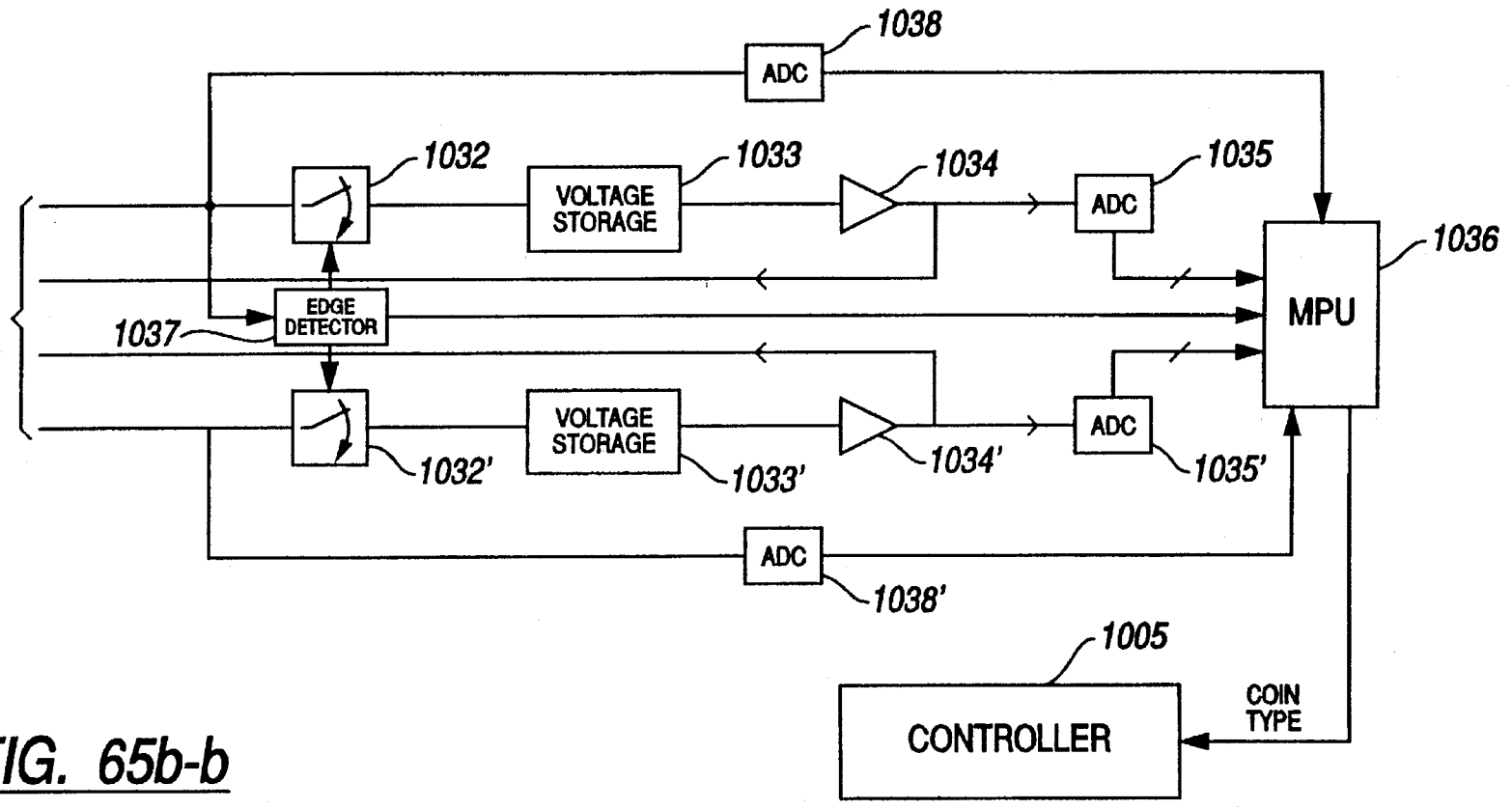
FIG. 65b-b

COIN HANDLING SYSTEM WITH COIN SENSOR DISCRIMINATOR

CROSS-REFERENCE TO RELATED APPLICATIONS

This application is a continuation-in-part of U.S. patent application Ser. No. 08/115,319, filed Sep. 1, 1993, now U.S. Pat. No. 5,429,550 and entitled "Coin Handling System With Controlled Coin Discharge", which is in turn a continuation-in-part of U.S. patent application Ser. No. 07/951,731, filed Sep. 25, 1992, now U.S. Pat. No. 5,299,977 and entitled "Coin Handling System," which is in turn a continuation-in-part of U.S. patent application Ser. No. 07/904,161 filed Aug. 21, 1992, now U.S. Pat. No. 5,277,651 and entitled "Coin with Automatic Bag-Switching or Stopping," which in turn is a continuation of U.S. patent application Ser. No. 07/524,134 filed May 14, 1990 (now issued as U.S. Pat. No. 5,141,443), and entitled "Coin Sorter With Automatic Bag-Switching Or Stopping."

FIELD OF THE INVENTION

The present invention relates generally to coin handling systems and, more particularly, to coin handling systems of the type which use a resilient disc rotating beneath a stationary coin-manipulating head.

SUMMARY OF THE INVENTION

An object of the present invention is to provide a coin sorter having a coin sensor/discriminator for discriminating between valid coins and invalid coins (e.g., foreign and counterfeit coins).

In accordance with the foregoing object, the present invention provides a coin sorter, comprising a rotatable disc; a drive motor for rotating the disc; a stationary sorting head having a lower surface generally parallel to the upper surface of the rotatable disc and spaced slightly therefrom, the lower surface of the sorting head forming a plurality of exit channels for guiding coins of different denominations to different discharge stations around the periphery of the disc; and a coin sensor/discriminator mounted in the stationary sorting head over the rotatable disc for discriminating between valid and invalid coins moving on the rotatable disc.

The above summary of the present invention is not intended to represent each embodiment, or every aspect, of the present invention. This is the purpose of the detailed description which follows.

BRIEF DESCRIPTION OF THE DRAWINGS

Other objects and advantages of the invention will become apparent upon reading the following detailed description and upon reference to the drawings in which:

FIGS. 65*a*, 65*b-a* and 65*b-b*are block diagrams of alternative coin sensor/discriminator circuit arrangements, according to the present invention, for discriminating valid coins from invalid coins;

Figure 1:
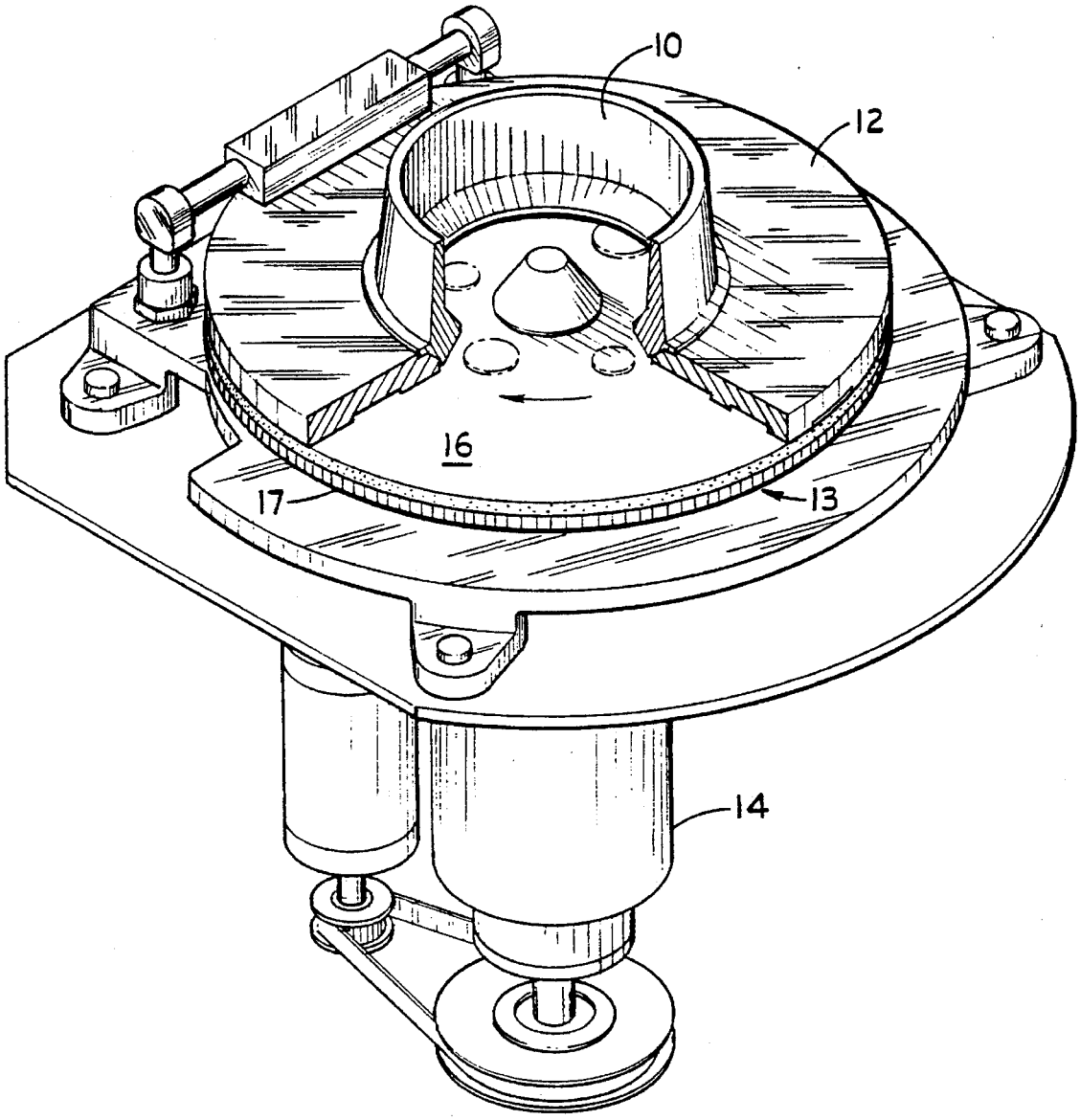
FIG. 1 is perspective view of a coin counting and sorting system embodying the present invention, with portions thereof broken away to show the internal structure.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF THE PREFERRED EMBODIMENTS

Turning now to the drawings and referring first to FIG. 1, a hopper 10 receives coins of mixed denominations and feeds them through central openings in an annular sorting head or guide plate 12. As the coins pass through these openings, they are deposited on the top surface of a rotatable disc 13. This disc 13 is mounted for rotation on a stub shaft (not shown) and driven by an electric motor 14. The disc 13 comprises a resilient pad 16, preferably made of a resilient rubber or polymeric material, bonded to the top surface of a solid metal disc 17.

As the disc 13 is rotated, the coins deposited on the top surface thereof tend to slide outwardly over the surface of the pad due to centrifugal force. As the coins move outwardly, those coins which are lying flat on the pad enter the gap between the pad surface and the guide plate 12 because the underside of the inner periphery of this plate is spaced above the pad 16 by a distance which is about the same as the thickness of the thickest coin.

Figure 2:
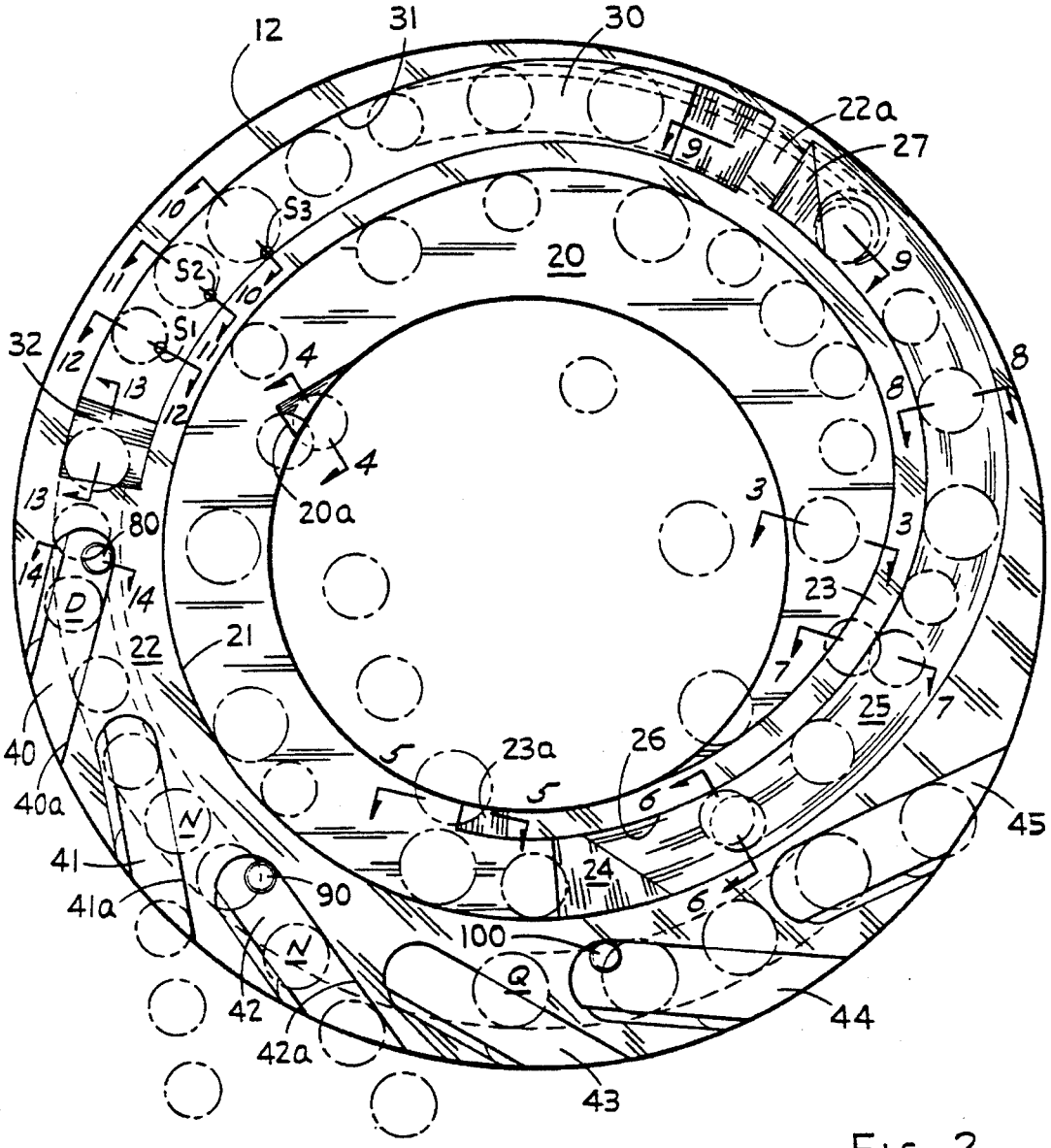
FIG. 2 is an enlarged bottom plan view of the sorting head or guide plate in the system of FIG. 1.
Figure 3:
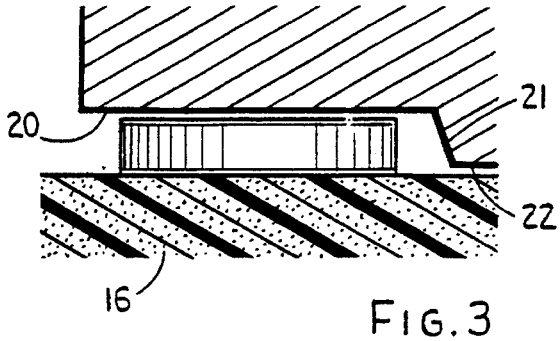
FIG. 3 is an enlarged section taken generally along line 3—3 in FIG. 2.
Figure 4:
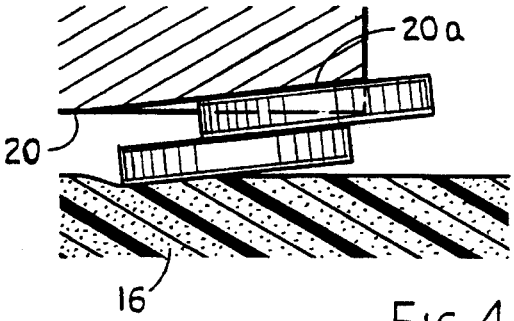
FIG. 4 is an enlarged section taken generally along line 4—4 in FIG. 2.

As can be seen most clearly in FIG. 2, the outwardly moving coins initially enter an annular recess 20 formed in the underside of the guide plate 12 and extending around a major portion of the inner periphery of the annular guide plate. The outer wall 21 of the recess 20 extends downwardly to the lowermost surface 22 of the guide plate (see FIG. 3), which is spaced from the top surface of the pad 16 by a distance which is slightly less, e.g., 0.010 inch, than the thickness of the thinnest coins. Consequently, the initial radial movement of the coins is terminated when they engage the wall 21 of the recess 20, though the coins continue to move circumferentially along the wall 21 by the rotational movement of the pad 16. Overlapping coins which only partially enter the recess 20 are stripped apart by a notch 20*a* formed in the top surface of the recess 20 along its inner edge (see FIG. 4).

Figure 5:
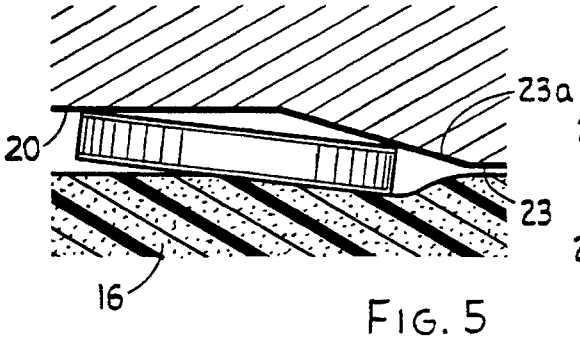
FIG. 5 is an enlarged section taken generally along line 5—5 in FIG. 2.

The only portion of the central opening of the guide plate 12 which does not open directly into the recess 20 is that sector of the periphery which is occupied by a land 23 whose lower surface is at the same elevation as the lowermost surface 22 of the guide plate. The upstream end of the land 23 forms a ramp 23*a* (FIG. 5), which prevents certain coins stacked on top of each other from reaching the ramp 24. When two or more coins are stacked on top of each other, they may be pressed into the resilient pad 16 even within the deep peripheral recess 20. Consequently, stacked coins can be located at different radial positions within the channel 20 as they approach the land 23. When such a pair of stacked coins has only partially entered the recess 20, they engage the ramp 23*a* on the leading edge of the land 23. The ramp 23*a* presses the stacked coins downwardly into the resilient pad 16, which retards the lower coin while the upper coin continues to be advanced. Thus, the stacked coins are stripped apart so that they can be recycled and once again enter the recess 20, this time in a single layer.

When a stacked pair of coins has moved out into the recess 20 before reaching the land 23, the, stacked coins engage the inner spiral wall 26. The vertical dimension of the wall 26 is slightly less than the thickness of the thinnest coin, so the lower coin in a stacked pair passes beneath the wall and is recycled while the upper coin in the stacked pair is cammed outwardly along the wall 26 (see FIGS. 6 and 7). Thus, the two coins are stripped apart with the upper coin moving along the guide wall 26, while the lower coin is recycled.

As coins within the recess 20 approach the land 23, those coins move outwardly around the land 23 and engage a ramp 24 leading into a recess 25 which is an outward extension of the inner peripheral recess 20. The recess 25 is preferably just slightly wider than the diameter of the coin denomination having the greatest diameter. The top surface of the major portion of the recess 25 is spaced away from the top of the pad 16 by a distance that is less than the thickness of the thinnest coin so that the coins are gripped between the guide plate 12 and the resilient pad 16 as they are rotated through the recess 25. Thus, coins which move into the recess 25 are all rotated into engagement with the outwardly spiralling inner wall 26, and then continue to move outwardly through the recess 25 with the inner edges of all the coins riding along the spiral wall 26.

Figure 6:
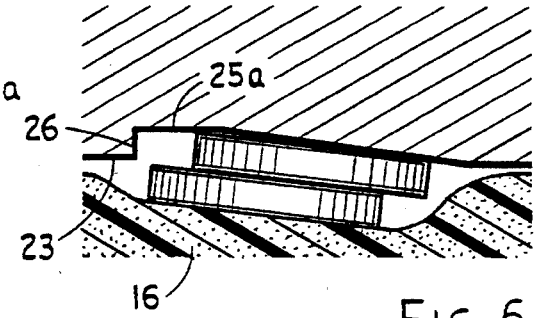
FIG. 6 is an enlarged section taken generally along line 6—6 in FIG. 2.
Figure 7:
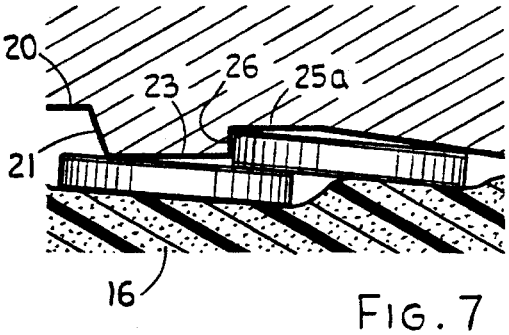
FIG. 7 is an enlarged section taken generally along line 7—7 in FIG. 2.
Figure 8:
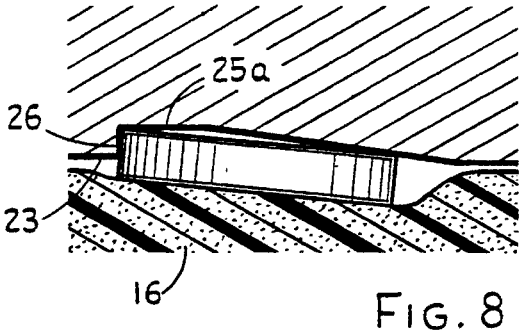
FIG. 8 is an enlarged section taken generally along line 8—8 in FIG. 2.

As can be seen in FIGS. 6–8, a narrow band 25*a* of the top surface of the recess 25 adjacent its inner wall 26 is spaced away from the pad 16 by approximately the thickness of the thinnest coin. This ensures that coins of all denominations (but only the upper coin in a stacked or shingled pair) are securely engaged by the wall 26 as it spirals outwardly. The rest of the top surface of the recess 25 tapers downwardly from the band 25*a* to the outer edge of the recess 25. This taper causes the coins to be tilted slightly as they move through the recess 25, as can be seen in FIGS. 6–8, thereby further ensuring continuous engagement of the coins with the outwardly spiraling wall 26.

The primary purpose of the outward spiral formed by the wall 26 is to space apart the coins so that during normal steady-state operation of the sorter, successive coins will not be touching each other. As will be discussed below, this spacing of the coins contributes to a high degree of reliability in the counting of the coins.

Figure 9:
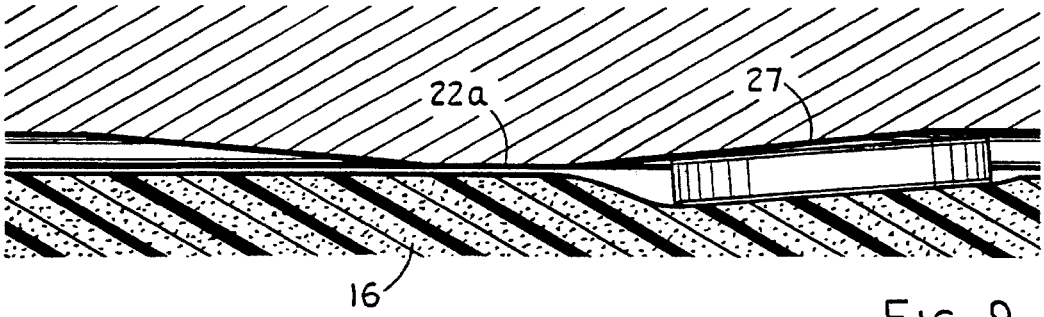
FIG. 9 is an enlarged section taken generally along line 9—9 in FIG. 2.
Figure 10:
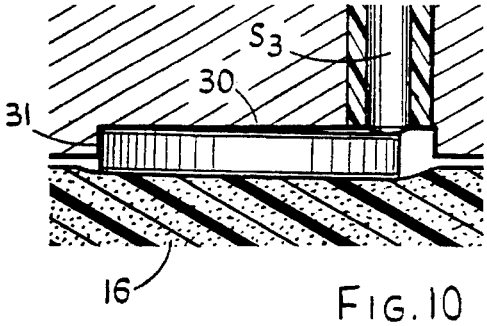
FIG. 10 is an enlarged section taken generally along line 10—10 in FIG. 2.
Figure 11:
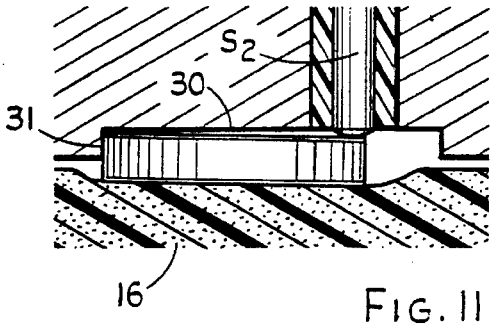
FIG. 11 is an enlarged section taken generally along line 11—11 in FIG. 2.
Figure 12:
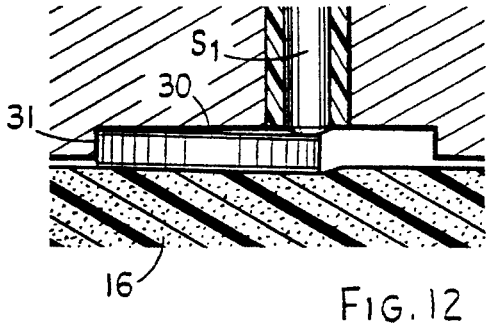
FIG. 12 is an enlarged section taken generally along line 12—12 in FIG. 2.

Rotation of the pad 16 continues to move the coins along the wall 26 until those coins engage a ramp 27 sloping downwardly from the recess 25 to a region 22*a* of the lowermost surface 22 of the guide plate 12 (see FIG. 9). Because the surface 22 is located even closer to the pad 16 than the recess, the effect of the ramp 27 is to further depress the coins into the resilient pad 16 as the coins are advanced along the ramp by the rotating disc. This causes the coins to be even more firmly gripped between the guide plate surface region 22*a* and the resilient pad 16, thereby securely holding the coins in a fixed radial position as they continue to be rotated along the underside of the guide plate by the rotating disc.

As the coins emerge from the ramp 27, the coins enter a referencing and counting recess 30 which still presses all coin denominations firmly against the resilient pad 16. The outer edge of this recess 30 forms an inwardly spiralling wall 31 which engages and precisely positions the outer edges of the coins before the coins reach the exit channels which serve as means for discriminating among coins of different denominations according to their different diameters.

The inwardly spiralling wall 31 reduces the spacing between successive coins, but only to a minor extent so that successive coins remain spaced apart. The inward spiral closes any spaces between the wall 31 and the outer edges of the coins so that the outer edges of all the coins are eventually located at a common radial position, against the wall 31, regardless of where the outer edges of those coins were located when they initially entered the recess 30.

Figure 13:
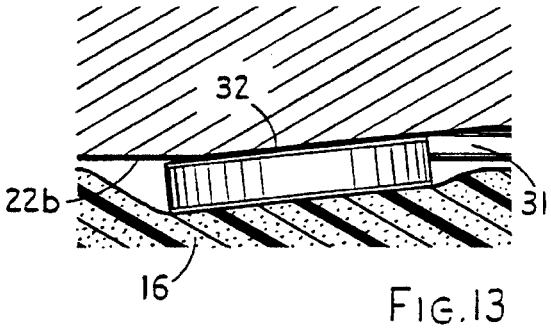
FIG. 13 is an enlarged section taken generally along line 13—13 in FIG. 2.

At the downstream end of the referencing recess 30, a ramp 32 (FIG. 13) slopes downwardly from the top surface of the referencing recess 30 to region 22*b* of the lowermost surface 22 of the guide plate. Thus, at the downstream end of the ramp 32 the coins are gripped between the guide plate 12 and the resilient pad 16 with the maximum compressive force. This ensures that the coins are held securely in the radial position initially determined by the wall 31 of the referencing recess 30.

Beyond the referencing recess 30, the guide plate 12 forms a series of exit channels 40, 41, 42, 43, 44 and 45 which function as selecting means to discharge coins of different denominations at different circumferential locations around the periphery of the guide plate. Thus, the channels 40–45 are spaced circumferentially around the outer periphery of the plate 12, with the innermost edges of successive pairs of channels located progressively farther away from the common radial location of the outer edges of all coins for receiving and ejecting coins in order of increasing diameter. In the particular embodiment illustrated, the six channels 40–45 are positioned and dimensioned to eject only dimes (channels 40 and 41), nickels (channels 42 and 43) and quarters (channel 44 and 45). The innermost edges of the exit channels 40–45 are positioned so that the inner edge of a coin of only one particular denomination can enter each channel; the coins of all other denominations reaching a given exit channel extend inwardly beyond the innermost edge of that particular channel so that those coins cannot enter the channel and, therefore, continue on to the next exit channel.

For example, the first two exit channels 40 and 41 (FIGS. 2 and 14) are intended to discharge only dimes, and thus the innermost edges 40*a* and 41*a* of these channels are located at a radius that is spaced inwardly from the radius of the referencing wall 31 by a distance that is only slightly greater than the diameter of a dime. Consequently, only dimes can enter the channels 40 and 41. Because the outer edges of all denominations of coins are located at the same radial position when they leave the referencing recess 30, the inner edges of the nickels and quarters all extend inwardly beyond the innermost edge 40*a* of the channel 40, thereby preventing these coins from entering that particular channel. This is illustrated in FIG. 2 which shows a dime D captured in the channel 40, while nickels N and quarters Q bypass the channel 40 because their inner edges extend inwardly beyond the innermost edge 40*a* of the channel so that they remain gripped between the guide plate surface 22*b* and the resilient pad 16.

Of the coins that reach channels 42 and 43, the inner edges of only the nickels are located close enough to the periphery of the guide plate 12 to enter those exit channels. The inner edges of the quarters extend inwardly beyond the innermost edge of the channels 42 and 43 so that they remain gripped between the guide plate and the resilient pad. Consequently, the quarters are rotated past the channel 41 and continue on to the next exit channel. This is illustrated in FIG. 2 which shows nickels N captured in the channel 42, while quarters Q bypass the channel 42 because the inner edges of the quarters extend inwardly beyond the innermost edge 42*a* of the channel.

Similarly, only quarters can enter the channels 44 and 45, so that any larger coins that might be accidentally loaded into the sorter are merely recirculated because they cannot enter any of the exit channels.

Figure 14:
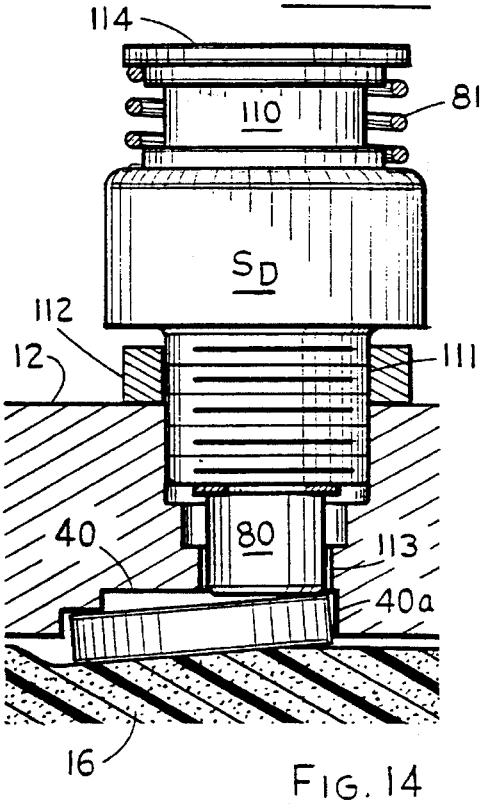
FIG. 14 is an enlarged section taken generally along line 14—14 in FIG. 2, and illustrating a coin in the exit channel with the movable element in that channel in its retracted position.

The cross-sectional profile of the exit channels 40–45 is shown most clearly in FIG. 14, which is a section through the dime channel 40. Of course, the cross-sectional configurations of all the exit channels are similar; they vary only in their widths and their circumferential and radial positions. The width of the deepest portion of each exit channel is smaller than the diameter of the coin to be received and ejected by that particular exit channel, and the stepped surface of the guide plate adjacent the radially outer edge of each exit channel presses the outer portions of the coins received by that channel into the resilient pad so that the inner edges of those coins are tilted upwardly into the channel (see FIG. 14). The exit channels extend outwardly to the periphery of the guide plate so that the inner edges of the channels guide the tilted coins outwardly and eventually eject those coins from between the guide plate 12 and the resilient pad 16.

The first dime channel 40, for example, has a width which is less than the diameter of the dime. Consequently, as the dime is moved circumferentially by the rotating disc, the inner edge of the dime is tilted upwardly against the inner wall 40*a* which guides the dime outwardly until it reaches the periphery of the guide plate 12 and eventually emerges from between the guide plate and the resilient pad. At this point the momentum of the coin causes it to move away from the sorting head into an arcuate guide which directs the coin toward a suitable receptacle, such as a coin bag or box.

Figure 17:
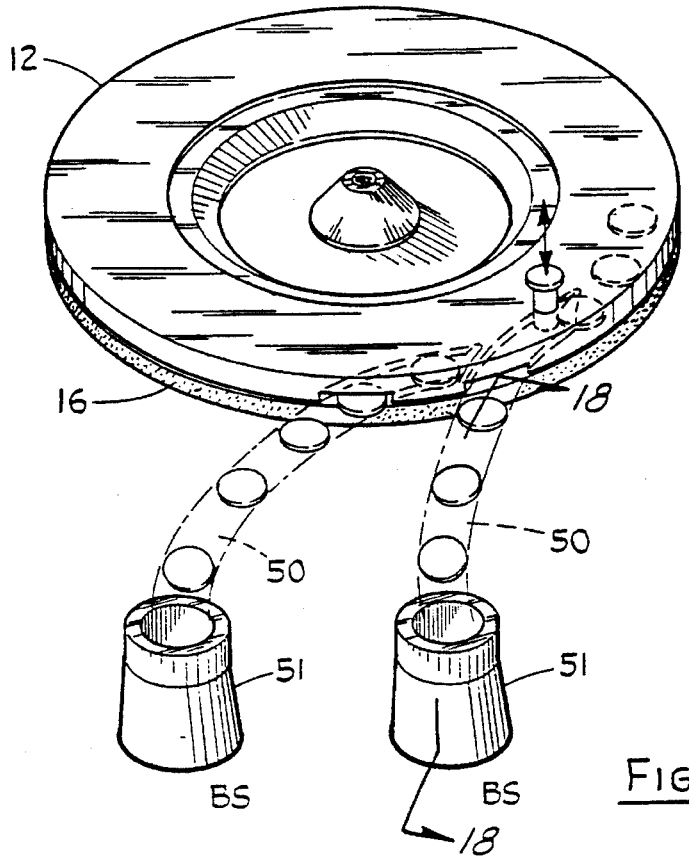
FIG. 17 is a perspective view of a portion of the coin sorter of FIG. 1, showing two of the six coin discharge and bagging stations and certain of the components included in those stations.
Figure 18:
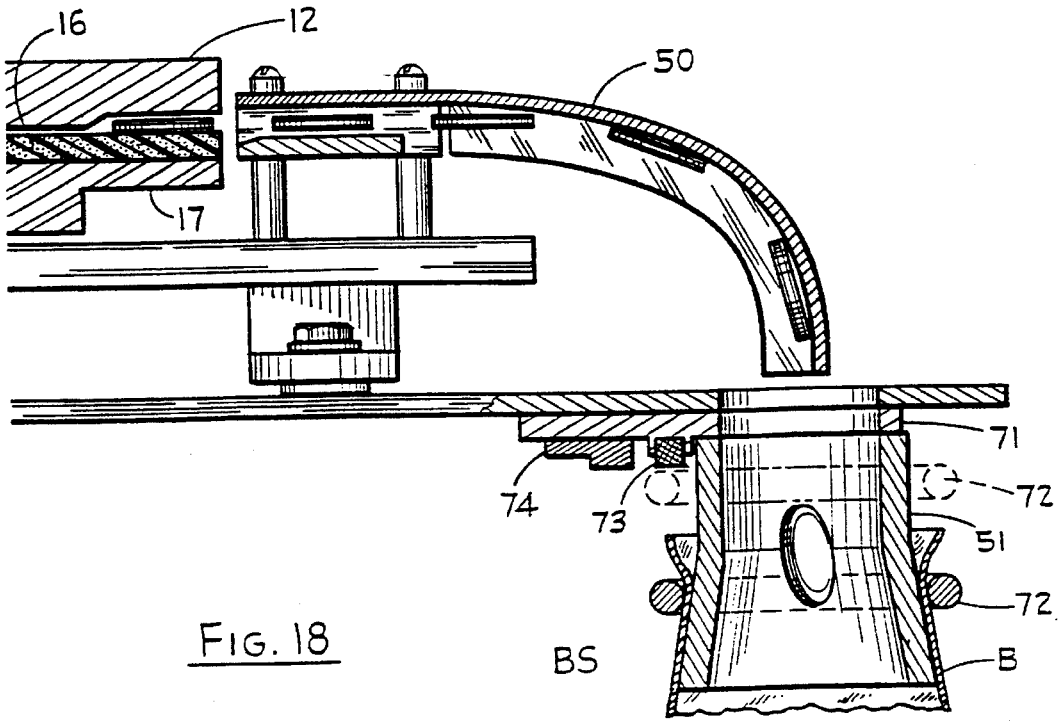
FIG. 18 is an enlarged section taken generally along line 18—18 in FIG. 17 and showing additional details of one of the coin discharge and bagging station.

As coins are discharged from the six exit channels 40–45, the coins are guided down toward six corresponding bag stations BS by six arcuate guide channels 50, as shown in FIGS. 17 and 18. Only two of the six bag stations BS are illustrated in FIG. 17, and one of the stations is illustrated in FIG. 18.

As the coins leave the lower ends of the guide channels 50, they enter corresponding cylindrical guide tubes 51 which are part of the bag stations BS. The lower ends of these tubes 51 flare outwardly to accommodate conventional clamping-ring arrangements for mounting coin bags B directly beneath the tubes 51 to receive coins therefrom.

As can be seen in FIG. 18, each clamping-ring arrangement includes a support bracket 71 below which the corresponding coin guide tube 51 is supported in such a way that the inlet to the guide tube is aligned with the outlet of the corresponding guide channel. A clamping ring 72 having a diameter which is slightly larger than the diameter of the upper portions of the guide tubes 51 is slidably disposed on each guide tube. This permits a coin bag B to be releasably fastened to the guide tube 51 by positioning the mouth of the bag over the flared end of the tube and then sliding the clamping ring down until it fits tightly around the bag on the flared portion of the tube, as illustrated in FIG. 18. Releasing the coin bag merely requires the clamping ring to be pushed upwardly onto the cylindrical section of the guide tube. The clamping ring is preferably made of steel, and a plurality of magnets 73 are disposed on the underside of the support bracket 71 to hold the ring 72 in its released position while a full coin bag is being replaced with an empty bag.

Each clamping-ring arrangement is also provided with a bag interlock switch for indicating the presence or absence of a coin bag at each bag station. In the illustrative embodiment, a magnetic reed switch 74 of the "normally-closed" type is disposed beneath the bracket 71 of each clamping-ring arrangement. The switch 74 is adapted to be activated when the corresponding clamping ring 72 contacts the magnets 73 and thereby conducts the magnetic field generated by the magnets 73 into the vicinity of the switch 74. This normally occurs when a previously clamped full coin bag is released and has not yet been replaced with an empty coin bag. A similar mechanism is provided for each of the other bag stations BS.

As described above, two different exit channels are provided for each coin denomination. Consequently, each coin denomination can be discharged at either of two different locations around the periphery of the guide plate 12, i.e., at the outer ends of the channels 40 and 41 for the dimes, at the outer ends of the channels 43 and 44 for the nickels, and at the outer ends of the channels 45 and 46 for the quarters. In order to select one of the two exit channels available for each denomination, a controllably actuatable shunting device is associated with the first of each of the three pairs of similar exit channels 40–41, 42–43 and 44–45. When one of these shunting devices is actuated, it shunts coins of the corresponding denomination from the first to the second of the two exit channels provided for that particular denomination.

Turning first to the pair of exit channels 40 and 41 provided for the dimes, a vertically movable bridge 80 is positioned adjacent the inner edge of the first channel 40, at the entry end of that channel. This bridge 80 is normally held in its raised, retracted position by means of a spring 81 (FIG. 14), as will be described in more detail below. When the bridge 80 is in this raised position, the bottom of the bridge is flush with the top wall of the channel 40, as shown in FIG. 14, so that dimes D enter the channel 40 and are discharged through that channel in the normal manner.

When it is desired to shunt dimes past the first exit channel 40 to the second exit channel 41, a solenoid $S_D$ (FIGS. 14, 15 and 19) is energized to overcome the force of the spring 81 and lower the bridge 80 to its advanced position. In this lowered position, shown in FIG. 15, the bottom of the bridge 80 is flush with the lowermost surface **22*b* of the guide plate 12, which has the effect of preventing dimes D from entering the exit channel 40. Consequently, the quarters are rotated past the exit channel 40 by the rotating disc, sliding across the bridge 80, and enter the second exit channel 41**.

To ensure that precisely the desired number of dimes are discharged through the exit channel 40, the bridge 80 must be interposed between the last dime for any prescribed batch and the next successive dime (which is normally the first dime for the next batch). To facilitate such interposition of the bridge 80 between two successive dimes, the dimension of the bridge 80 in the direction of coin movement is relatively short, and the bridge is located along the edges of the coins, where the space between successive coins is at a maximum. The fact that the exit channel 40 is narrower than the coins also helps ensure that the outer edge of a coin will not enter the exit channel while the bridge is being moved from its retracted position to its advanced position. In fact, with the illustrative design, the bridge 80 can be advanced after a dime has already partially entered the exit channel 40, overlapping all or part of the bridge, and the bridge will still shunt that dime to the next exit channel 41.

Vertically movable bridges 90 and 100 (FIG. 2) located in the first exit channels 42 and 44 for the nickels and quarters, respectively, operate in the same manner as the bridge 80. Thus, the nickel bridge 90 is located along the inner edge of the first nickel exit channel 42, at the entry end of that exit channel. The bridge 90 is normally held in its raised, retracted position by means of a spring. In this raised position the bottom of the bridge 90 is flush with the top wall of the exit channel 42, so that nickels enter the channel 42 and are discharged through that channel. When it is desired to divert nickels to the second exit channel 43, a solenoid $S_N$ (FIG. 19) is energized to overcome the force of the spring and lower the bridge 90 to its advanced position, where the bottom of the bridge 60 is flush with the lowermost surface **22*b* of the guide plate 12. When the bridge 90 is in this advanced position, the bridge prevents any coins from entering the first exit channel 42. Consequently, the nickels slide across the bridge 90, continue on to the second exit channel 43 and are discharged therethrough. The quarter bridge 100 (FIG. 2) and its solenoid $S_Q$ (FIG. 19) operate in exactly the same manner. The edges of all the bridges 80, 90 and 100** are preferably chamfered to prevent coins from catching on these edges.

Figure 15:
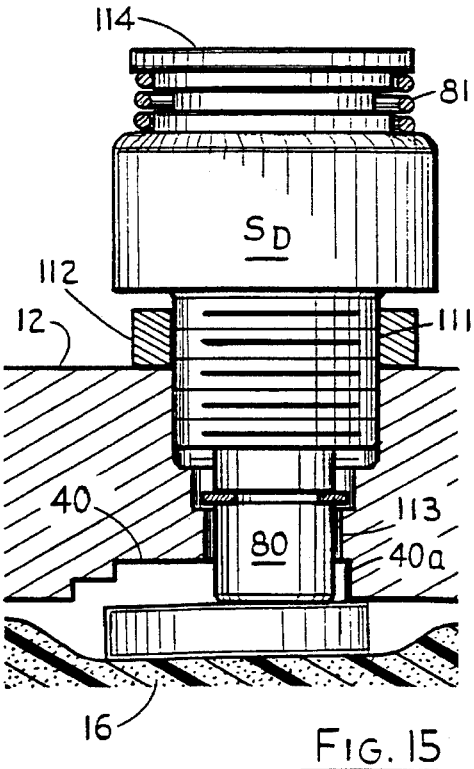
FIG. 15 is the same section shown in FIG. 14 with the movable element in its advanced position.

The details of the actuating mechanism for the bridge 80 are illustrated in FIGS. 14 and 15. The bridges 90 and 100 have similar actuating mechanisms, and thus only the mechanism for the bridge 80 will be described. The bridge 80 is mounted on the lower end of a plunger 110 which slides vertically through a guide bushing 111 threaded into a hole bored into the guide plate 12. The bushing 111 is held in place by a locking nut 112. A smaller hole 113 is formed in the lower portion of the plate 12 adjacent the lower end of the bushing 111, to provide access for the bridge 80 into the exit channel 40. The bridge 80 is normally held in its retracted position by the coil spring 81 compressed between the locking nut 112 and a head 114 on the upper end of the plunger 110. The upward force of the spring 81 holds the bridge 80 against the lower end of the bushing 111.

To advance the plunger 110 to its lowered position within the exit channel 40 (FIG. 15), the solenoid coil is energized to push the plunger 110 downwardly with a force sufficient to overcome the upward force of the spring 81. The plunger is held in this advanced position as long as the solenoid coil remains energized, and is returned to its normally raised position by the spring 81 as soon as the solenoid is de-energized.

Solenoids $S_N$ and $S_Q$ control the bridges 90 and 100 in the same manner described above in connection with the bridge 80 and the solenoid $S_D$.

As the coins move along the wall 31 of the referencing recess 30, the outer edges of all coin denominations are at the same radial position at any given angular location along the edge. Consequently, the inner edges of coins of different denominations are offset from each other at any given angular location, due to the different diameters of the coins (see FIG. 2). These offset inner edges of the coins are used to separately count each coin before it leaves the referencing recess 30.

As can be seen in FIGS. 2 and 10–12, three coin sensors $S_1$, $S_2$ and $S_3$ in the form of insulated electrical contact pins are mounted in the upper surface of the recess 30. The outermost sensor $S_1$ is positioned so that it is contacted by all three coin denominations, the middle sensor $S_2$ is positioned so that it is contacted only by the nickels and quarters, and the innermost sensor $S_3$ is positioned so that it is contacted only by the quarters. An electrical voltage is applied to each sensor so that when a coin contacts the pin and bridges across its insulation, the voltage source is connected to ground via the coin and the metal head surrounding the insulated sensor. The grounding of the sensor during the time interval when it is contacted by the coin generates an electrical pulse which is detected by a counting system connected to the sensor. The pulses produced by coins contacting the three sensors $S_1$, $S_2$ and $S_3$ will be referred to herein as pulses $P_1$, $P_2$ and $P_3$, respectively, and the accumulated counts of those pulses in the counting system will be referred to as counts $C_1$, $C_2$ and $C_3$, respectively.

As a coin traverses one of the sensors, intermittent contact can occur between the coin and the sensor because of the contour of the coin surface. Consequently, the output signal from the sensor can consist of a series of short pulses rather than a single wide pulse, which is a common problem referred to as "contact bounce." This problem can be overcome by simply detecting the first pulse and then ignoring subsequent pulses during the time interval required for one coin to cross the sensor. Thus, only one pulse is detected for each coin that contacts the sensor.

The outer sensor $S_1$ contacts all three coin denominations, so the actual dime count $C_D$ is determined by subtracting $C_2$ (the combined quarter and nickel count) from $C_1$ (the combined count of quarters, nickels and dimes). The middle sensor $S_2$, contacts both the quarters and the nickels, so the actual nickel count $C_N$ is determined by subtracting $C_3$ (the quarter count) from $C_2$ (the combined quarter and nickel count). Because the innermost sensor $S_3$ contacts only quarters, the count $C_3$ is the actual quarter count $C_Q$.

Another counting technique uses the combination of (1) the presence of a pulse $P_1$ from the sensor $S_1$ and (2) the absence of a pulse $P_2$ from the sensor $S_2$ to detect the presence of a dime. A nickel is detected by the combination of (1) the presence of a pulse $P_2$ from the sensor $S_2$ and (2) the absence of a pulse $P_3$ from sensor $S_3$, and a quarter is detected by the presence of a pulse $P_3$ from the sensor $S_3$. The presence or absence of the respective pulses can be detected by a simple logic routine which can be executed by either hardware or software.

To permit the simultaneous counting of prescribed batches of coins of each denomination using the first counting technique described above, i.e., the subtraction algorithm, counts $C_2$ and $C_3$ must be simultaneously accumulated over two different time periods. For example, count $C_3$ is the actual quarter count $C_Q$, which normally has its own operator-selected limit $C_{QMAX}$. While the quarter count $C_Q$ ($=C_3$) is accumulating toward its own limit $C_{QMAX}$, however, the nickel count $C_N$ ($=C_2-C_3$) might reach its limit $C_{NMAX}$ and be reset to zero to start the counting of another batch of nickels. For accurate computation of $C_N$ following its reset to zero, the count $C_3$ must also be reset at the same time. The count $C_3$, however, is still needed for the ongoing count of quarters; thus the pulses $P_3$ are supplied to a second counter $C_3'$ which counts the same pulses $P_3$ that are counted by the first counter $C_3$ but is reset each time the counter $C_2$ is reset. Thus, the two counters $C_3$ and $C_3'$ count the same pulses $P_3$, but can be reset to zero at different times.

The same problem addressed above also exists when the count $C_1$ is reset to zero, which occurs each time the dime count $C_D$ reaches its limit $C_{MAX}$. That is, the count $C_2$ is needed to compute both the dime count $C_D$ and the nickel count $C_N$, which are usually reset at different times. Thus, the pulses $P_2$ are supplied to two different counters $C_2$ and $C_2'$. The first counter $C_2$ is reset to zero only when the nickel count $C_N$ reaches its $C_{CNMAX}$, and the second counter is reset to zero each time $C_1$ is reset to zero when $C_D$ reaches its limit $C_{DMAX}$.

Whenever one of the counts $C_D$, $C_N$ or $C_Q$ reaches its limit, a control signal is generated to initiate a bag-switching or bag-stop function.

For the bag-switching function, the control signal is used to actuate the movable shunt within the first of the two exit channels provided for the appropriate coin denomination. This enables the coin sorter to operate continuously (assuming that each full coin bag is replaced with an empty bag before the second bag for that same denomination is filled) because there is no need to stop the sorter either to remove full bags or to remove excess coins from the bags.

For a bag-stop function, the control signal preferably stops the drive for the rotating disc and at the same time actuates a brake for the disc. The disc drive can be stopped either by de-energizing the drive motor or by actuating a clutch which decouples the drive motor from the disc. An alternative bag-stop system uses a movable diverter within a coin-recycling slot located between the counting sensors and the exit channels. Such a recycling diverter is described, for example, in U.S. Pat. No. 4,564,036 issued Jan. 14, 1986, for "Coin Sorting System With Controllable Stop."

Figure 19:
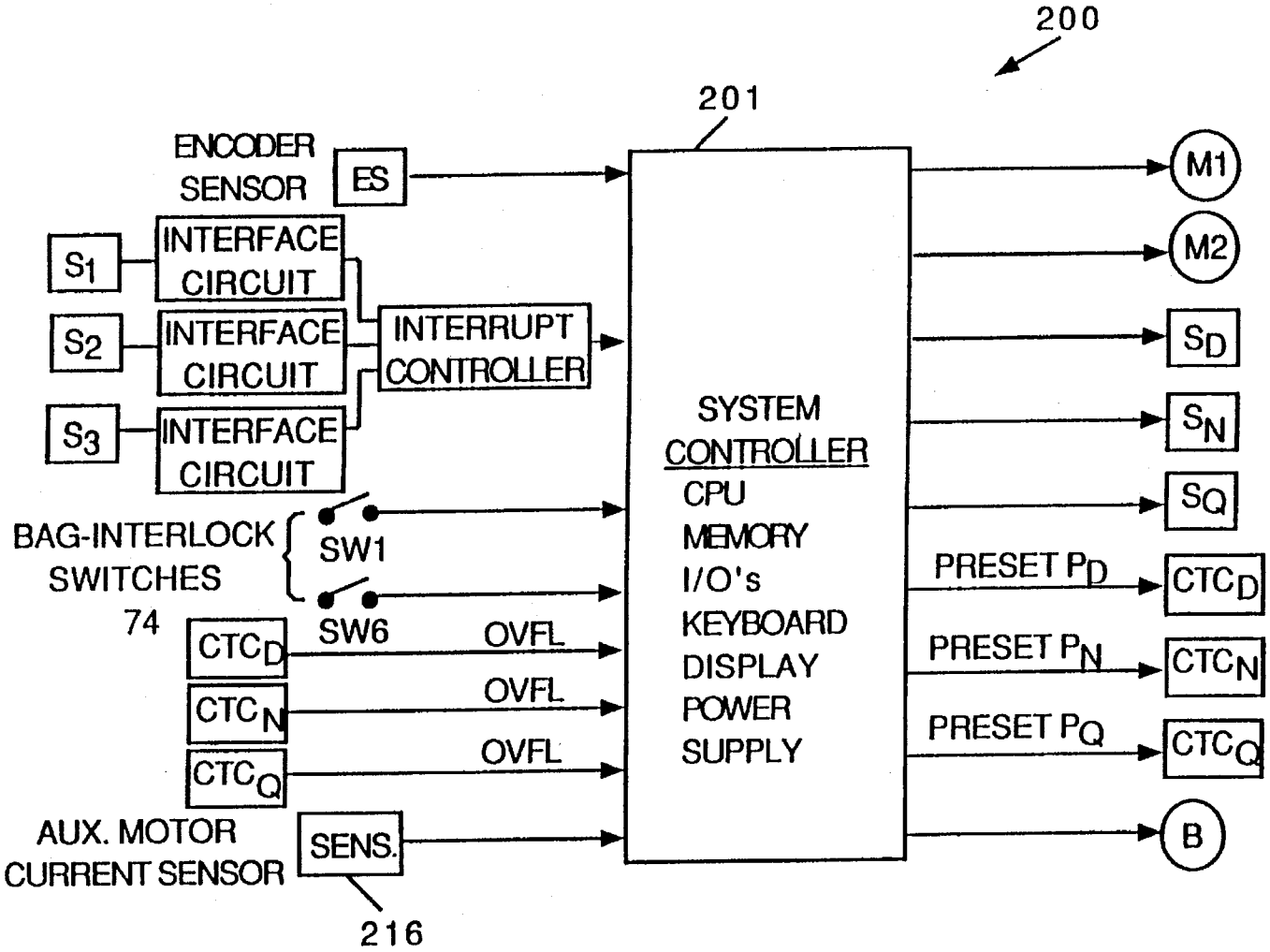
FIG. 19 is a block diagram of a microprocessor-based control system for use in the coin counting and sorting system of FIGS. 1–18.

Referring now to FIG. 19, there is shown an upper level block diagram of an illustrative microprocessor-based control system 200 for controlling the operation of a coin sorter incorporating the counting and sorting system of this invention. The control system 200 includes a central processor unit (CPU) 201 for monitoring and regulating the various parameters involved in the coin sorting/counting and bag-stopping and switching operations. The CPU 201 accepts signals from (1) the bag-interlock switches 74 which provide indications of the positions of the bag-clamping rings 72 which are used to secure coin bags B to the six coin guide tubes 51, to indicate whether or not a bag is available to receive each coin denomination, (2) the three coin sensors $S_1$–$S_3$, (3) an encoder sensor $E_5$ and (4) three coin-tracking counters $CTC_D$, $CTC_N$ and $CTC_Q$. The CPU 201 produces output signals to control the three shunt solenoids $S_D$, $S_N$ and $S_Q$, the main drive motor $M_1$, an auxiliary drive motor $M_2$, a brake B and the three coin-tracking counters.

Figure 16:
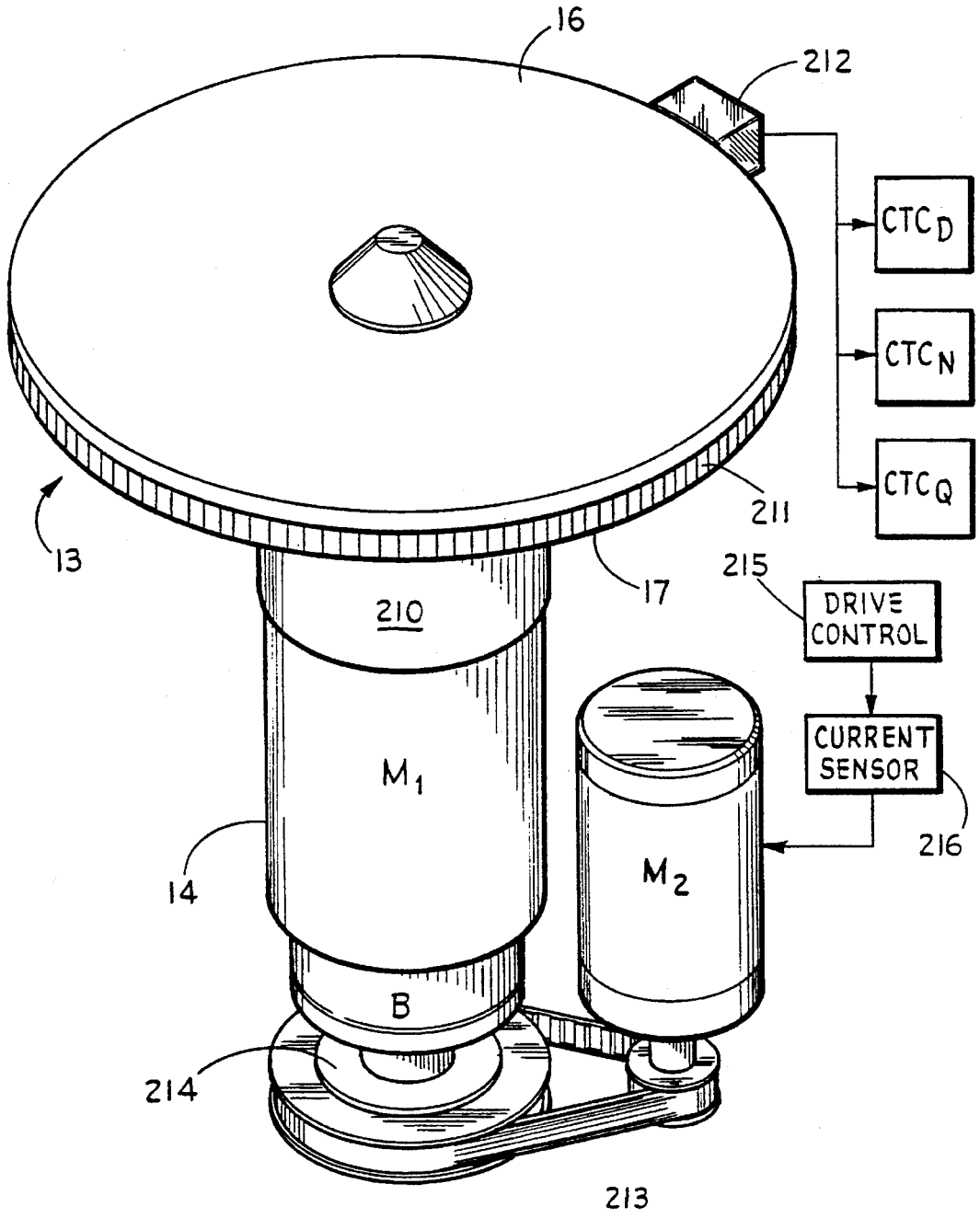
FIG. 16 is an enlarged perspective view of a preferred drive system for the rotatable disc in the system of FIG. 1.

A drive system for the rotating disc, for use in conjunction with the control system of FIG. 19, is illustrated in FIG. 16. The disc is normally driven by a main a-c. drive motor $M_1$ which is coupled directly to the coin-carrying disc 13 through a speed reducer 210. To stop the disc 13, a brake B is actuated at the same time the main motor $M_1$ is de-energized. To permit precise monitoring of the angular movement of the disc 13, the outer peripheral surface of the disc carries an encoder in the form of a large number of uniformly spaced indicia 211 (either optical or magnetic) which can be sensed by an encoder sensor 212. In the particular example illustrated, the disc has 720 indicia 211 so that the sensor 212 produces an output pulse for every 0.5° of movement of the disc 13.

The pulses from the encoder sensor 212 are supplied to the three coin-tracking down counters $CTD_D$, $CTC_N$ and $CTC_Q$ for separately monitoring the movement of each of the three coin denominations between fixed points on the sorting head. The outputs of these three counters $CTC_D$, $CTC_N$ and $CTC_Q$ can then be used to separately control the actuation of the bag-switching bridges 80, 90 and 100 and/or the drive system. For example, when the last dime in a prescribed batch has been detected by the sensors $S_1$–$S_3$, the dime-tracking counter $CTC_D$ is preset to count the movement of a predetermined number of the indicia 211 on the disc periphery past the encoder sensor 212. This is a way of measuring the movement of the last dime through an angular displacement that brings that last dime to a position where the bag-switching bridge 80 should be actuated to interpose the bridge between the last dime and the next successive dime.

In the sorting head of FIG. 2, a dime must traverse an angle of 20° to move from the position where it has just cleared the last counting sensor $S_1$ to the position where it has just cleared the bag-switching bridge 80. At a disc speed of 250 rpm, the disc turns—and the coin moves—at a rate of 1.5° per millisecond. A typical response time for the solenoid that moves the bridge 80 is 6 milliseconds (4 degrees of disc movement), so the control signal to actuate the solenoid should be transmitted when the last dime is 4 degrees from its bridge-clearing position. In the case where the encoder has 720 indicia around the circumference of the disc, the encoder sensor produces a pulse for ever 0.5° of disc movement. Thus the coin-tracking counter $CTC_D$ for the dime is preset to 32 when the last dime is sensed, so that the counter $CTC_D$ counts down to zero, and generates the required control signal, when the dime has advanced 16° beyond the last sensor $S_1$. This ensures that the bridge 80 will be moved just after it has been cleared by the last dime, so that the bridge 80 will be interposed between that last dime and the next successive dime.

In order to expand the time interval available for any of the bag-switching bridges to be interposed between the last coin in a prescribed batch and the next successive coin of that same denomination, control means may be provided for reducing the speed of the rotating disc 13 as the last coin in a prescribed batch is approaching the bridge. Reducing the speed of the rotating disc in this brief time interval has little effect on the overall throughput of the system, and yet it significantly increases the time interval available between the instant when the trailing edge of the last coin clears the bridge and the instant when the leading edge of the next successive coin reaches the bridge. Consequently, the timing of the interposing movement of the bridge relative to the coin flow past the bridge becomes less critical and, therefore, it becomes easier to implement and more reliable in operation.

Reducing the speed of the rotating disc is preferably accomplished by reducing the speed of the motor which drives the disc. Alternatively, this speed reduction can be achieved by actuation of a brake for the rotating disc, or by a combination of brake actuation and speed reduction of the drive motor.

One example of a drive system for controllably reducing the speed of the disc 13 is illustrated in FIG. 16. This system includes an auxiliary d-c. motor $M_2$ connected to the drive shaft of the main drive motor $M_1$ through a timing belt 213 and an overrun clutch 214. The speed of the auxiliary motor $M_2$ is controlled by a drive control circuit 215 through a current sensor 216 which continuously monitors the armature current supplied to the auxiliary motor $M_2$. When the main drive motor $M_1$ is de-energized, the auxiliary d-c. motor $M_2$ can be quickly accelerated to its normal speed while the main motor $M_1$ is decelerating. The output shaft of the auxiliary motor turns a gear which is connected to a larger gear through the timing belt 213, thereby forming a speed reducer for the output of the auxiliary motor $M_2$. The overrun clutch 214 is engaged only when the auxiliary motor $M_2$ is energized, and serves to prevent the rotational speed of the disc 13 from decreasing below a predetermined level while the disc is being driven by the auxiliary motor.

Returning to FIG. 19, when the prescribed number of coins of a prescribed denomination has been counted for a given coin batch, the controller 201 produces control signals which energize the brake B and the auxiliary motor $M_2$ and de-energize the main motor $M_1$. The auxiliary motor $M_2$ rapidly accelerates to its normal speed, while the main motor $M_1$ decelerates. When the speed of the main motor is reduced to the speed of the overrun clutch 214 driven by the auxiliary motor, the brake overrides the output of the auxiliary motor, thereby causing the armature current of the auxiliary motor to increase rapidly. When this armature current exceeds; a preset level, it initiates de-actuation of the brake, which is then disengaged after a short time delay. After the brake is disengaged, the armature current of the auxiliary motor drops rapidly to a normal level needed to sustain the normal speed of the auxiliary motor. The disc then continues to be driven by the auxiliary motor alone, at a reduced rotational speed, until the encoder sensor 212 indicates that the last coin in the batch has passed the position where that coin has cleared the bag-switching bridge in the first exit slot for that particular denomination. At this point the main drive motor is re-energized, and the auxiliary motor is de-energized.

Figure 20A:
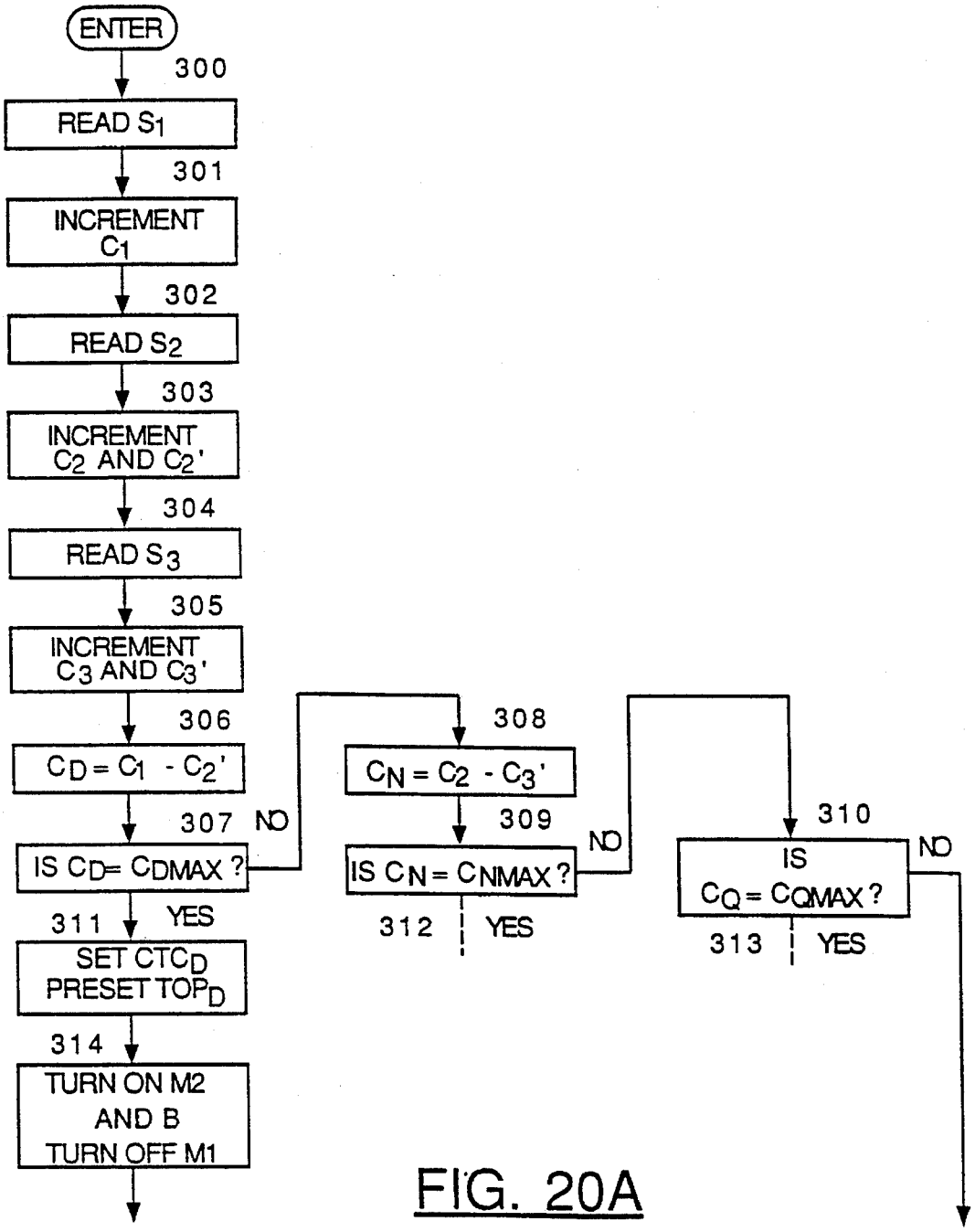
FIGS. 20A and 20B, combined, form a flow chart of a portion of a program for controlling the operation of the microprocessor included in the control system of FIG. 19.
Figure 20B:
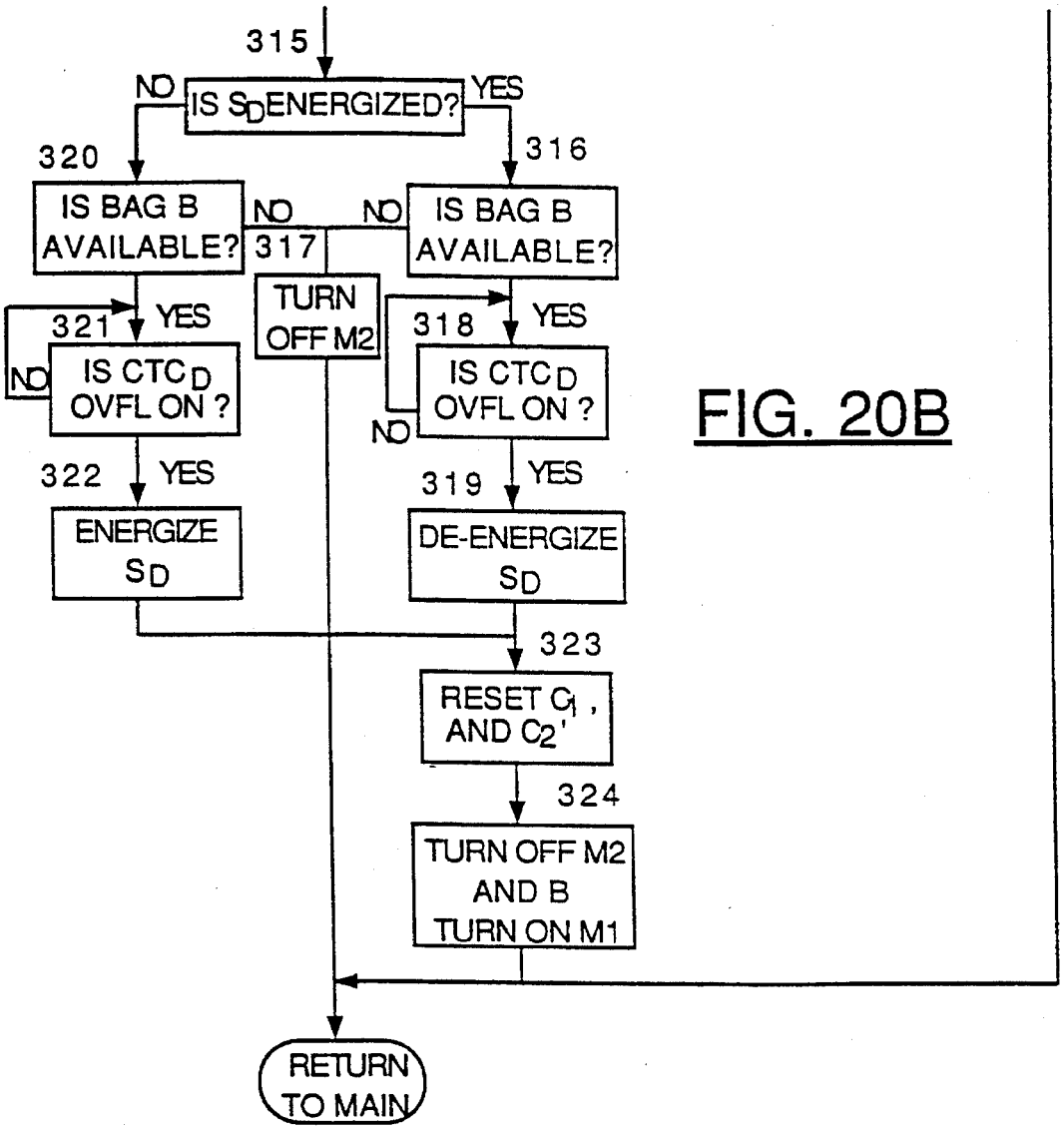

Referring now to FIG. 20, there is shown a flow chart 220 illustrating the sequence of operations involved in utilizing the bag-switching system of the illustrative sorter of FIG. 1 in conjunction with the microprocessor-based system discussed above with respect to FIG. 19.

The subroutine illustrated in FIG. 20 is executed multiple times in every millisecond. Any given coin moves past the coin sensors at a rate of about 1.5° per millisecond. Thus, several milliseconds are required for each coin to traverse the sensors, and so the subroutine of FIG. 20 is executed several times during the sensor-traversing movement of each coin.

The first six steps 300–305 in the subroutine of FIG. 20 determine whether the interrupt controller has received any pulses from the three sensors $S_1$–$S_3$. If the answer is affirmative for any of the three sensors, the corresponding count $C_1$, $C_2$, $C_2'$, $C_3$ and $C_3'$ is incremented by one. Then at step 306 the actual dime count $C_D$ is computed by subtracting count $C_2'$ from $C_1$. The resulting value $C_D$ is then compared with the current selected limit value $C_{DMAX}$ at step 307 to determine whether the selected number of dimes has passed the sensors. If the answer is negative, the subroutine advances to step 308 where the actual nickel count $C_N$ is computed by subtracting count $C_3'$ from $C_2$. The resulting value $C_N$ is then compared with the selected nickel limit value $C_{NMAX}$ at step 309 to determine whether the selected number of nickels has passed the sensors. A negative answer at step 309 advances the program to step 310 where the quarter count $C_Q$ (=$C_3$) is compared with $C_{DMAX}$ to determine whether the selected number of quarters has been counted.

When one of the actual counts $C_D$, $C_N$ or $C_Q$ reaches the corresponding limit $C_{DMAX}$, $C_{NMAX}$ or $C_{QMAC}$, an affirmative answer is produced at step 311, 312 or 313.

An affirmative answer at step 311 indicates that the selected number of dimes has been counted, and thus the bridge 80 in the first exit slot 40 for the dime must be actuated so that: it diverts all dimes following the last dime in the completed batch. To determine when the last dime has reached the predetermined position where it is desired to transmit the control signal that initiates actuation of the solenoid $S_D$, step 311 presets the coin-tracking counter $CTC_D$ to a value $P_D$. The counter $CTC_D$ then counts down from $P_D$ in response to successive pulses from the encoder sensor ES as the last dime is moved from the last sensor $S_3$ toward the bridge 80. To control the speed of the dime so that it is moving at a known constant speed during the time interval when the solenoid $S_D$ is being actuated, step 314 turns off the main drive motor M1 and turns on the auxiliary d-c. drive motor $M_2$ and the brake B. This initiates the sequence of operations described above, in which the brake B is engaged while the main drive motor M1 is decelerating and then disengaged while the auxiliary motor M2 drives the disc 13 so that the last dime is moving at a controlled constant speed as it approaches and passes the bridge 80.

To determine whether the solenoid $S_D$ must be energized or de-energized, step 315 of the subroutine determines whether the solenoid $S_D$ is already energized. An affirmative response at step 315 indicates that it is bag B that contains the preset number of coins, and thus the system proceeds to step 316 to determine whether bag A is available. If the answer is negative, indicating that bag B is not available, then there is no bag available for receiving dimes and the sorter must be stopped. Accordingly, the system proceeds to step 317 where the auxiliary motor M2 is turned off and the brake B is turned on to stop the disc 13 after the last dime is discharged into bag B. The sorter cannot be re-started again until the bag-interlock switches for the dime bags indicate that the full bag has been removed and replaced with an empty bag.

An affirmative answer at step 316 indicates that bag A is available, and thus the system proceeds to step 318 to determine whether the coin-tracking counter $CTC_D$ has reached zero, i.e., whether the $OVFL_D$ signal is on. The system reiterates this query until $OVFL_D$ is on, and then advances to step 319 to generate a control signal to de-energize the solenoid $S_D$ so that the bridge 80 is moved to its retracted (upper) position. This causes all the dimes for the next coin batch to enter the first exit channel 40 so that they are discharged into bag A.

A negative answer at step 315 indicates the full bag is bag A rather than bag B, and thus the system proceeds to step 320 to determine whether bag B is available. If the answer is negative, it means that neither bag A nor bag B is available to receive the dimes, and thus the sorter is stopped by advancing to step 317. An affirmative answer at step 320 indicates that bag B is, in fact, available, and thus the system proceeds to step 321 to determine when the solenoid $S_D$ is to be energized, in the same manner described above for step 318. Energizing the solenoid $S_D$ causes the bridge 80 to be advanced to its lower position so that all the dimes for the next batch are shunted past the first exit channel 40 to the second exit channel 41. The control signal for energizing the solenoid is generated at step 321 when step 320 detects that $OVFL_D$ is on.

Each time the solenoid $S_D$ is either energized at step 322 or de-energized at step 319, the subroutine resets the counters $C_1$ and $C_2'$ at step 323, and turns off the auxiliary motor M2 and the brake B and turns on the main drive motor M1 at step 324. This initializes the dime-counting portion of the system to begin the counting of a new batch of dimes.

It can thus be seen that the sorter can continue to operate without interruption, as long as each full bag of coins is removed and replaced with an empty bag before the second bag receiving the same denomination of coins has been filled. The exemplary sorter is intended for handling coin mixtures of only dimes, nickels and quarters, but it will be recognized that the arrangement described for these three coins in the illustrative embodiment could be modified for any other desired coin denominations, depending upon the coin denominations in the particular coin mixtures to be handled by the sorter.

Figure 21:
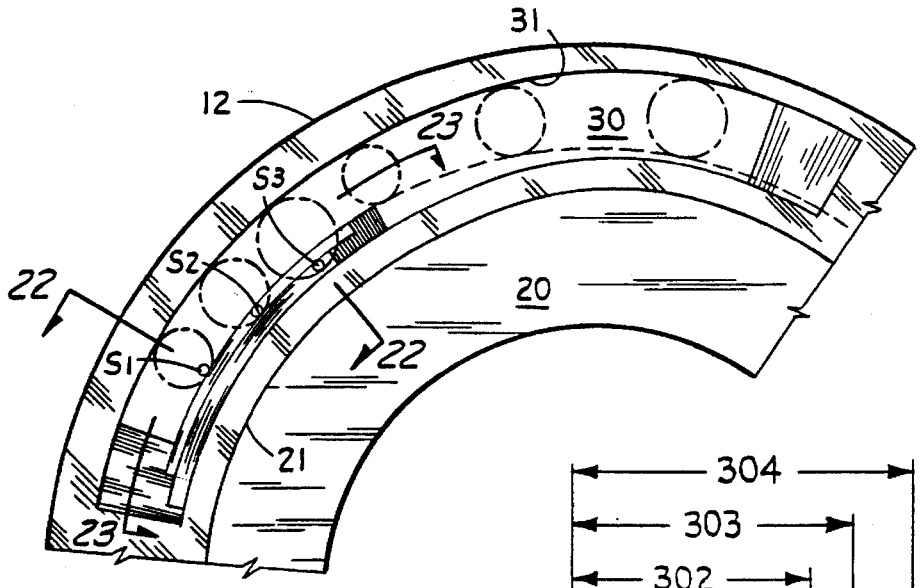
FIG. 21 is a fragmentary section of a modification of the sorting head of FIG. 2.
Figure 22:
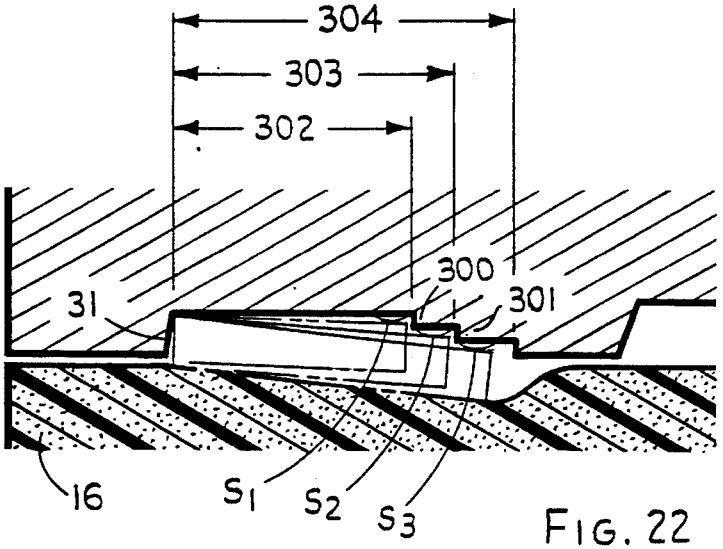
FIG. 22 is an enlarged section taken generally along line 22—22 in FIG. 21.
Figure 23:
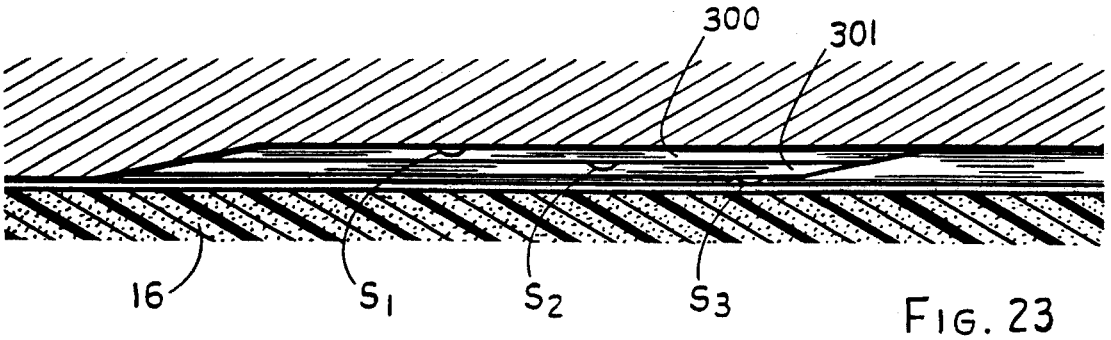
FIG. 23 is an enlarged section taken generally along line 23—23 in FIG. 21.
Figure 24:
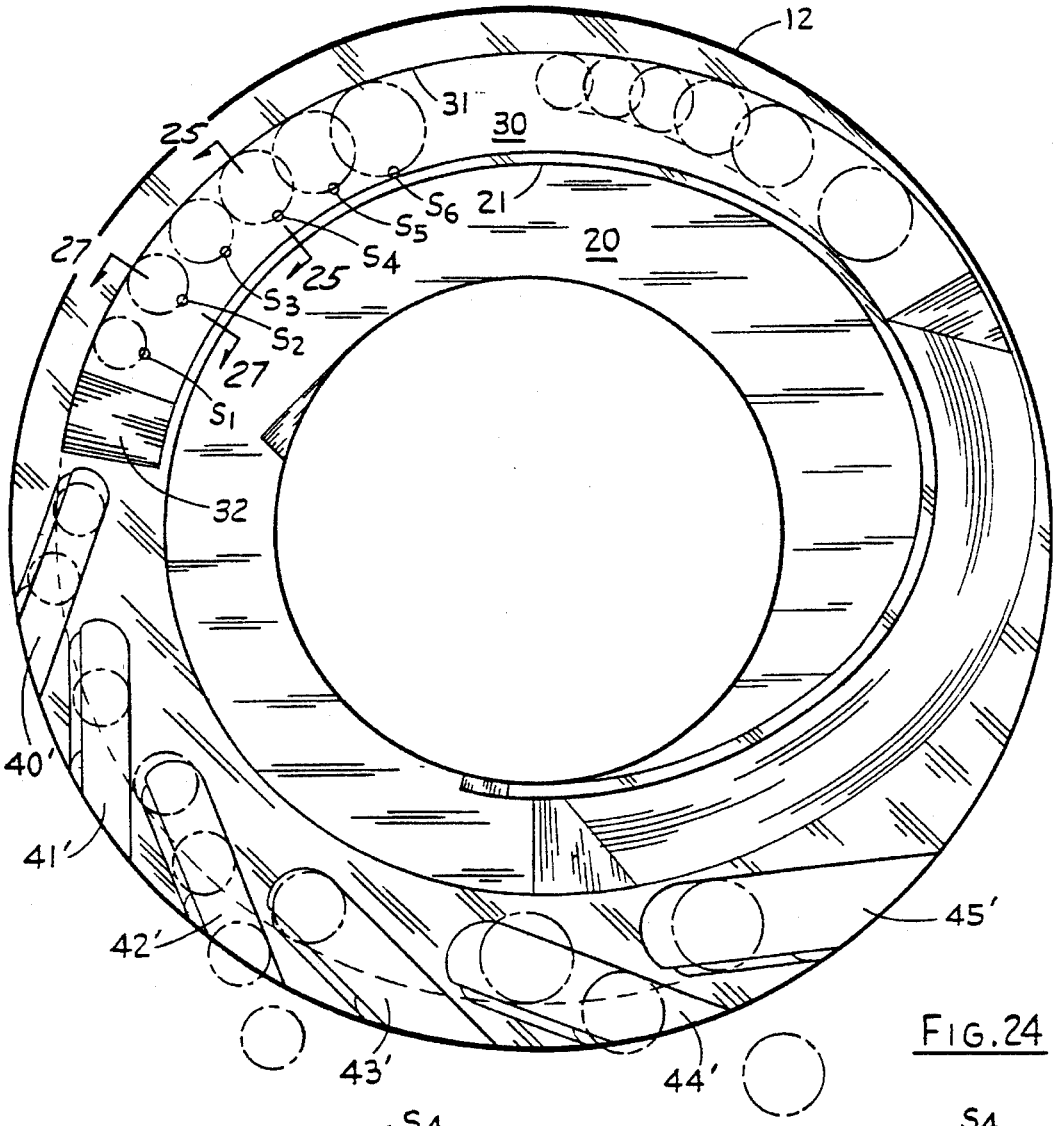
FIG. 24 is a bottom plan view of another modified sorting head for use in the coin counting and sorting system of FIG. 1, and embodying the present invention.

An alternative coin-sensor arrangement is illustrated in FIGS. 21–23. In this arrangement that portion of the top surface of the referencing recess 30 that contains the counting sensors $S_1$–$S_3$ is stepped so that each sensor is offset from the other two sensors in the axial (vertical) direction as well as the radial (horizontal) direction. Thus, the steps 300 and 301 form three coin channels 302, 303 and 304 of different widths and depths. Specifically, the deepest channel 302 is also the narrowest channel, so that it can receive only dimes; the middle channel 303 is wide enough to receive nickels but not quarters; and the shallowest channel 304 is wide enough to receive quarters. The top surfaces of all three channels 302–304 are close enough to the pad 16 to press all three coin denominations into the pad.

The three counting sensors $S_1$, $S_2$ and $S_3$ are located within the respective channels 302, 202 and 304 so that each sensor is engaged by only one denomination of coin. For example, the sensor $S_1$ engages the dimes in the channel 302, but cannot be reached by nickels or quarters because the channel 302 is too narrow to receive coins larger than dimes. Similarly, the sensor $S_2$ is spaced radially inwardly from the inner edges of the dimes so that it engages only nickels in the channel 303. The sensor $S_3$ engages quarters in the channel 304, but is spaced radially inwardly from both the nickels and the dimes.

It will be appreciated from the foregoing description of the sensor arrangement of FIGS. 21–23 that this arrangement permits direct counting of the various coin denominations, without using the subtraction algorithm or the pulse-processing logic described above in connection with the embodiment of FIGS. 2–15.

FIGS. 24–28 show another modification of the sorting head of FIGS. 2–15 to permit the counting and sorting of coins of six different denominations, without automatic bag switching. This sorting head has six different exit channels 40'–45', one for each of six different denominations, rather than a pair of exit channels for each denomination.

Figure 25:
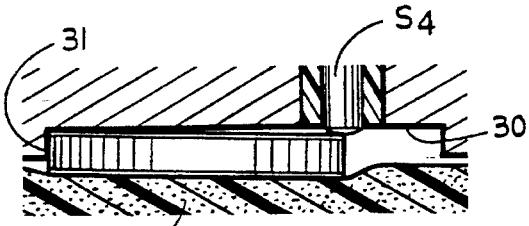
FIG. 25 is an enlarged section taken generally along line 25—25 in FIG. 24.
Figure 26:
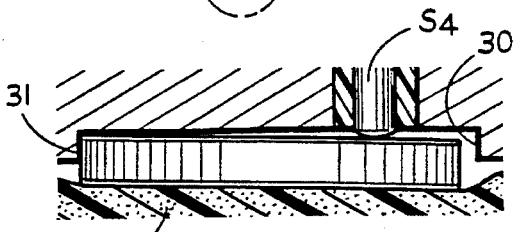
FIG. 26 is the same section shown in FIG. 25 with a larger diameter coin in place of the coin shown in FIGS. 24 and 25.
Figure 27:
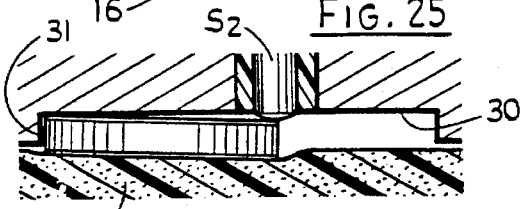
FIG. 27 is an enlarged section taken generally along line 27—27 in FIG. 24.
Figure 28:
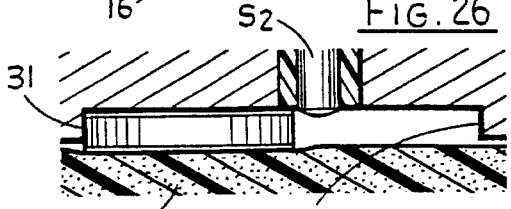
FIG. 28 is the same section shown in FIG. 27 with a smaller diameter coin in place of the coin shown in FIGS. 24 and 27.

In the counting system of FIGS. 24–28, the six sensors $S_1$–$S_6$ are spaced apart from each other in the radial direction so that one of the sensors is engaged only by half dollars, and each of the other sensors is engaged by a different combination of coin denominations. For example, as illustrated in FIGS. 25 and 26, the sensor $S_4$, engages not only quarters (FIG. 25) but also all larger coins (FIG. 26), while missing all coins smaller than the sensor $S_2$ engaging a penny (FIG. 27) but missing a dime (FIG. 28).

The entire array of sensors produces a unique combination of signals for each different coin denomination, as illustrated by the following table where a "1" represents engagement with the sensor and a "0" represents non-engagement with the sensor:

| | $P_1$ | $P_2$ | $P_3$ | $P_4$ | $P_5$ | $P_6$ |
|---|---|---|---|---|---|---|
| 10¢ | 1 | 0 | 0 | 0 | 0 | 0 |
| 1¢ | 1 | 1 | 0 | 0 | 0 | 0 |
| 5¢ | 1 | 1 | 1 | 0 | 0 | 0 |
| 25¢ | 1 | 1 | 1 | 1 | 0 | 0 |
| $1 | 1 | 1 | 1 | 1 | 1 | 0 |
| 50¢ | 1 | 1 | 1 | 1 | 1 | 1 |

by analyzing the combination of signals produced by the six sensors $S_1$–$S_6$ in response to the passage of any coin thereover, the denomination of that coin is determined immediately, and the actual count for that denomination can be incremented directly without the use of any subtraction algorithm. Also, this sensor arrangement minimizes the area of the sector that must be dedicated to the sensors on the lower surface of the sorting head.

The analysis of the signals produced by the six sensors $S_1$–$S_6$ in response to any given coin can be simplified by detecting only that portion of each combination of signals that is unique to one denomination of coin. As can be seen from the above table, these unique portions are $P_1=0$ and $P_2=1$ for the dime, $P_2=0$ and $P_3=1$ for the penny, $P_3=0$ and $P_4=1$ for the nickel, $P_4=0$ and $P_5=1$ for the quarter, $P_5=0$ and $P_6=1$ for the dollar, and $P_6=1$ for the half dollar.

As an alterative to the signal-processing system described above, the counts $C_1$–$C_6$ of the pulses $P_1$–$P_6$ from the six sensors $S_1$–$S_6$ in FIGS. 24–28 may be processed as follows to yield actual counts $C_D$, $C_P$, $C_N$, $C_Q$, $C_S$ and $C_H$ of dimes, pennies, nickels, quarters, dollars and half dollars:

$$C_D=C_1-C_2$$

$$C_P=C_2-C_3$$

$$C_N=C_3-C_4$$

$$C_Q=C_4-C_5$$

$$C_S=C_5-C_6$$

$$C_H=C_6$$

Figure 29:
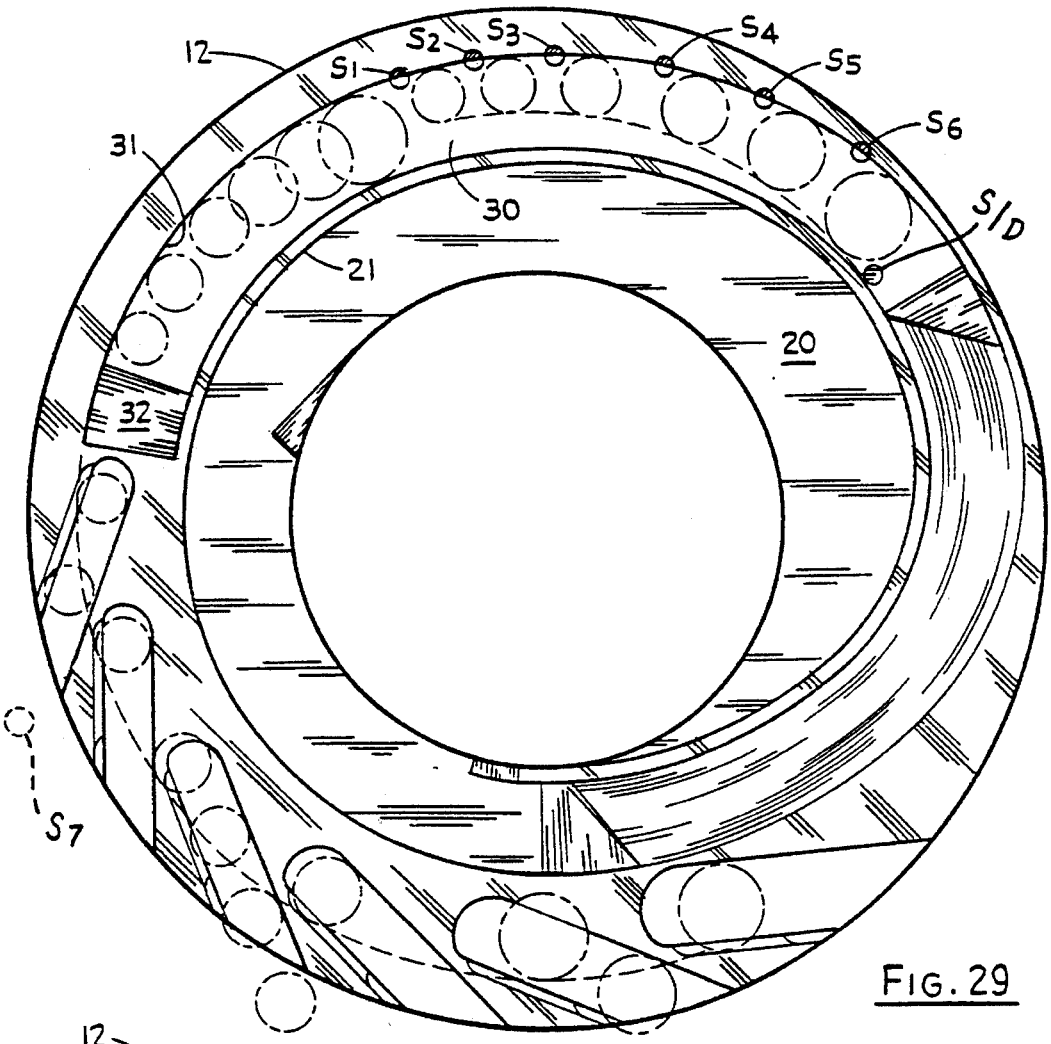
FIG. 29 is a bottom plan view of another modified sorting head for use in the coin counting and sorting system of FIG. 1, and embodying the present invention of FIG. 24.
Figure 30:
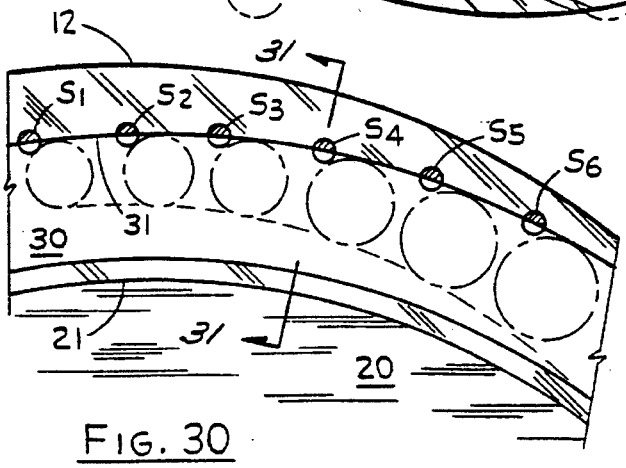
FIG. 30 is an enlargement of the upper right-hand portion of FIG. 29.
Figure 31:
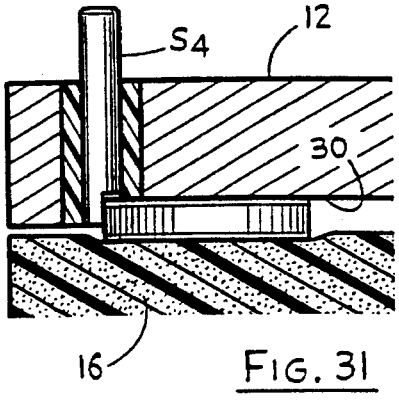
FIG. 31 is a section taken generally along line 31—31 in FIG. 30.

FIGS. 29–31 illustrate a six-denomination sorting head using yet another coin-sensor arrangement. In this arrangement the sensors $S_1$–$S_6$ are located at the upstream end of the referencing recess 30, in the outer wall 31 of that recess. Because the coins leave the outwardly spiralling channel 25 with the inner edges of all coin denominations at a common radius, the outer edges of the coins are offset from each other according to the diameters (denominations) of the coins. Consequently, coins of different denominations engage the inwardly spiralling wall 31 at different circumferential positions, and the six sensors $S_1$–$S_6$ are located at different circumferential positions so that each sensor is engaged by a different combination of denominations.

The end result of the sensor arrangement of FIGS. 29–31 is the same as that of the sensor arrangement of FIGS. 24–28. That is, the sensor $S_1$ is engaged by six denominations, sensor $S_2$ is engaged by five denominations, sensor $S_3$ is engaged by four denominations, sensor $S_4$ is engaged by three denominations,s sensor $S_5$ is engaged by two denominations, and sensor $S_6$ is engaged by only one denomination. The counts $C_1$–$C_6$ of the pulses $P_1$–$P_6$ from the six sensors $S_1$–$S_6$ may be processed in the same manner described above for FIGS. 24–28 to yield actual counts $C_D$, $C_P$, $C_N$, $C_Q$, $C_S$ and $C_H$.

As shown in FIG. 31, the sensors used in the embodiment of FIGS. 29–31 may be formed as integral parts of the outer wall 31 of the recess 30. Thus, the insulated contact pins may be installed in the metal plate used to form the sorting head before the various contours are formed by machining the surface of the plate. Then when the recess 30 is formed in the plate, the cutting tool simply cuts through a portion of each contact pin just as though it were part of the plate.

Figure 32:
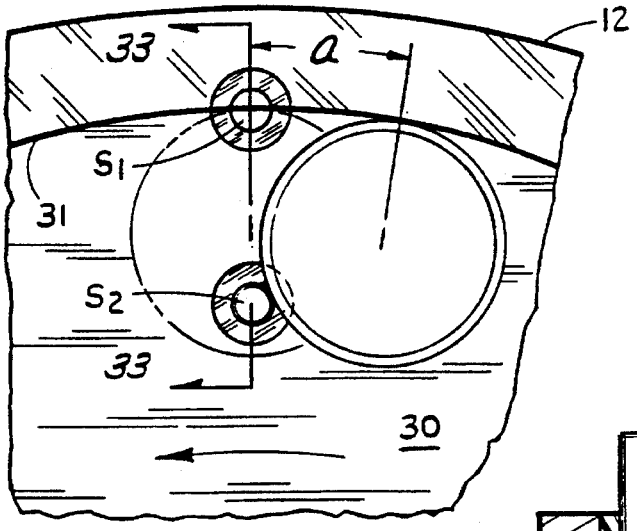
FIG. 32 is a fragmentary bottom plan view of a modified coin-counting area for the sorting head of FIG. 29.
Figure 33:
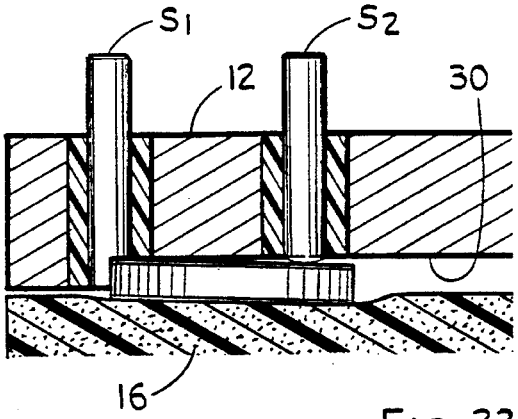
FIG. 33 is a section taken generally along line 33—33 in FIG. 32.

Still another coin sensor arrangement is shown in FIGS. 32 and 33. In this arrangement only two sensors are used to detect all denominations. One of the sensors $S_1$, is located in the wall that guides the coins while they are being sensed, and the other sensor $S_2$ is spaced radially away from the sensor $S_1$ by a distance that is less than the diameter of the smallest coin to be sensed by $S_2$. Every coin engages both sensors $S_1$ and $S_2$, but the time interval between the instant of initial engagement with $S_2$ and the instant of initial engagement with $S_1$ varies according to the diameter of the coin. A large-diameter coin engages $S_2$ earlier (relative to the engagement with $S_1$) than a small-diameter coin. Thus, by measuring the time interval between the initial contacts with the two sensors $S_1$ and $S_2$ for any given coin, the diameter of that coin can be determined.

Alternatively, the encoder on the periphery of the disc 13 can be used to measure the angular displacement a of each coin from the time it initially contacts the sensor $S_1$ until it initially contacts the sensor $S_2$. This angular displacement a increases as the diameter of the coin increases; so the diameter of each coin can be determined from the magnitude of the measured angular displacement. This denomination-sensing technique is insensitive to variations in the rotational speed of the disc because it is based on the position of the coin, not its speed.

Figure 34:
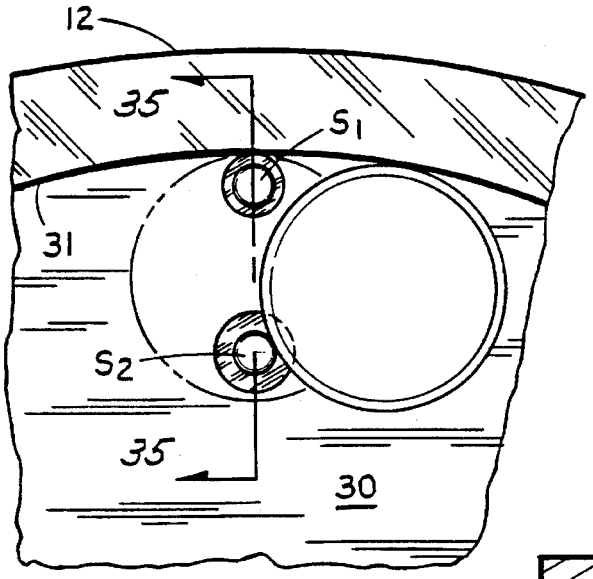
FIG. 34 is a fragmentary bottom plan view of still another modified coin-counting area for the sorting head of FIG. 29.
Figure 35:
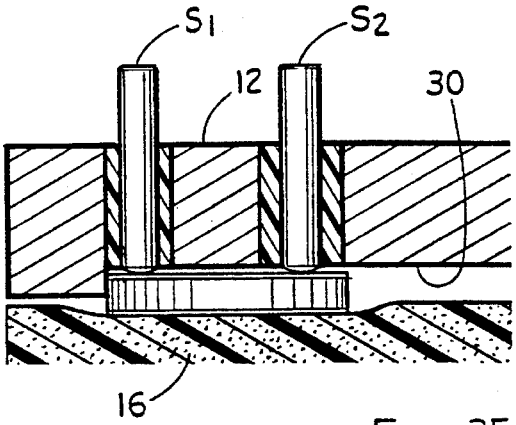
FIG. 35 is a section taken generally along line 35—35 in FIG. 34.

FIGS. 34 and 35 show a modified form of the two-sensor arrangement of FIGS. 32 and 33. In this case the sensor $S_1$ engages the flat side of the coin rather than the edge of the coin. Otherwise the operation is the same.

Figure 36:
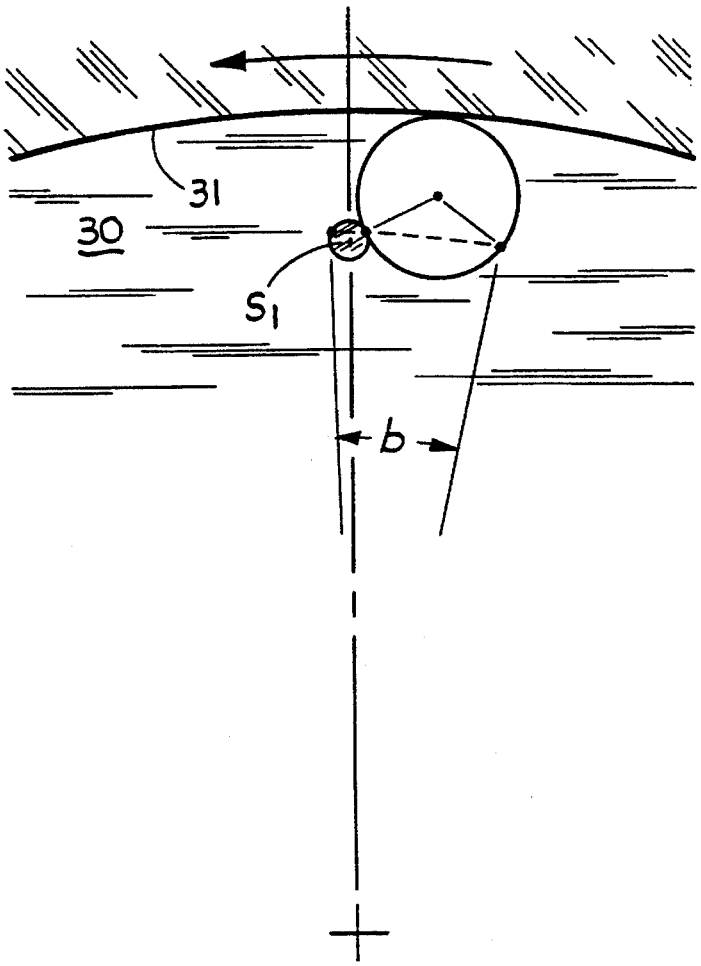
FIG. 36 is a fragmentary bottom plan view of yet another modified coin-counting area for the sorting head of FIG. 24.
Figure 37:
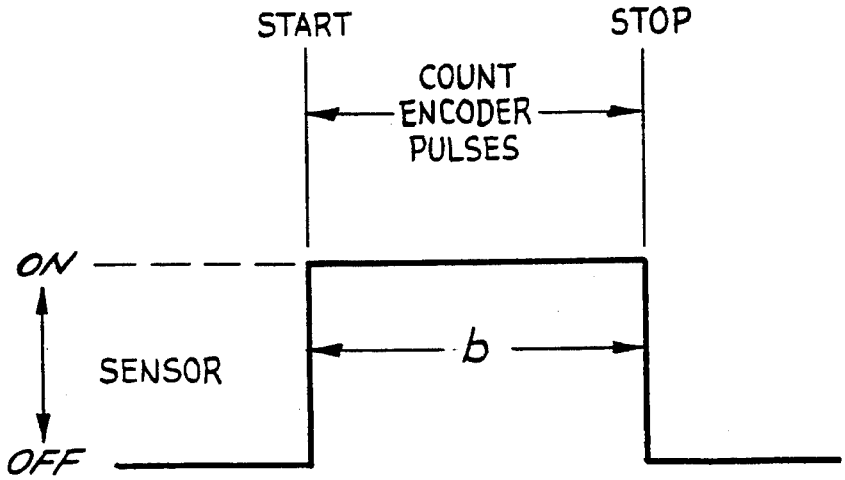
FIG. 37 is a timing diagram illustrating the operation of the counting area shown in FIG. 36.

Another modified counting arrangement is shown in FIG. 36. This arrangement uses a single sensor $S_1$ which is spaced away from the coin-guiding wall 31 by a distance that is less than the diameter of the smallest coin. Each coin denomination traverses the sensor $S_1$ over a unique range of angular displacement b, which can be accurately measured by the encoder on the periphery of the disc 13, as illustrated by the timing diagram in FIG. 37. The counting of pulses from the encoder sensor 212 is started when the leading edge of a coin first contacts the sensor $S_1$, and the counting is continued until the trailing edge of the coin clears the sensor. As mentioned previously, the sensor will not usually produce a uniform flat pulse, but there is normally a detectable rise or fail in the sensor output signal when a coin first engages the sensor, and again when the coin clears the sensor. Because each coin denomination requires a unique angular displacement b to traverse the sensor, the number of encoder pulses generated during the sensor-traversing movement of the coin provides a direct indication of the size, and therefore the denomination, of the coin.

FIGS. 38–43 illustrate a system in which each coin is sensed after it has been sorted but before it has exited from the rotating disc. One of six proximity sensors $S_1$–$S_6$ is mounted along the outboard edge of each of the six exit channels 350–355 in the sorting head. By locating the sensors $S_1$–$S_6$ in the exit channels, each sensor is dedicated to one particular denomination of coin, and thus it is not necessary to process the sensor output signals to determine the coin denomination. The effective fields of the sensors $S_1$–$S_6$ are all located just outboard of the radius $R_g$ at which the outer edges of all coin denominations are gaged before they reach the exit channels 350–355, so that each sensor detects only the coins which enter its exit channel and does not detect the coins which bypass that exit channel. Thus, in FIG. 38 the circumferential path followed by the outer edges of all coins as they traverse the exit channels is illustrated by the dashed-line arc $R_g$. Only the largest coin denomination (e.g., U.S. half dollars) reaches the sixth exit channel 355, and thus the location of the sensor in this exit channel is not as critical as in the other exit channels 350–354.

Figure 38:
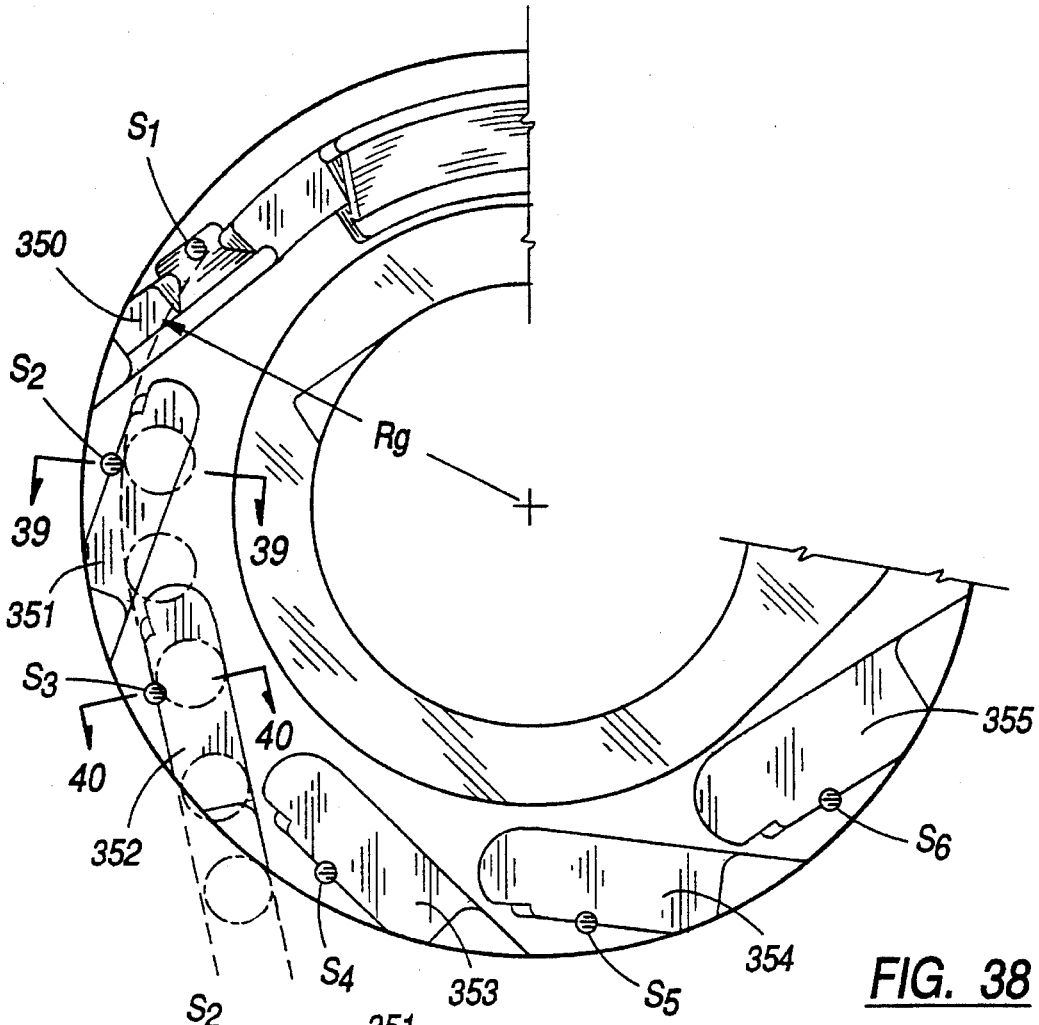
FIG. 38 is a bottom plan view of a further modified sorting head for use in the coin counting and sorting system of FIG. 1, and embodying the present invention.
Figure 39:
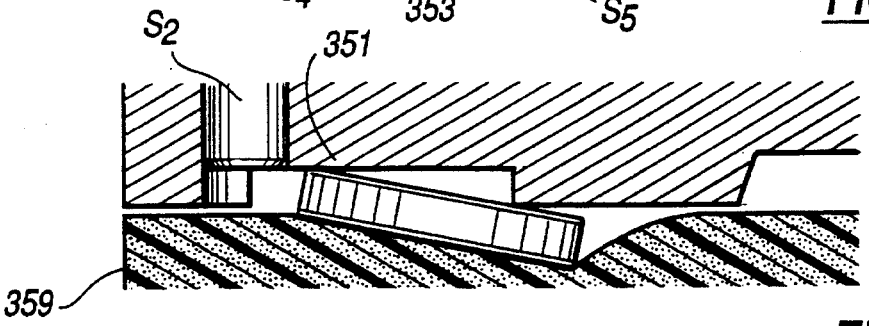
FIG. 39 is a section taken generally along line 39—39 in FIG. 38.
Figure 40:
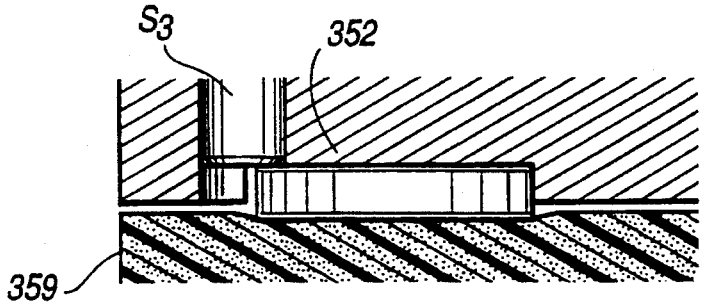
FIG. 40 is a section taken generally along line 40—40 in FIG. 38.

It is preferred that each exit channel have the straight side walls shown in FIG. 38, instead of the curved side walls used in the exit channels of many previous disc-type coin sorters. The straight side walls facilitate movement of coins through an exit slot during the jogging mode of operation of the drive motor, after the last coin has been sensed, which will be described in more detail below.

To ensure reliable monitoring of coin movement downstream of the respective sensors, as well as reliable sensing of each coin, each of the exit channels 350–355 is dimensioned to press the coins therein down into the resilient top surface of the rotating disc. This pressing action is a function of not only the depth of the exit channel, but also the clearance between the lowermost surface of the sorting head and the uppermost surface of the disc.

Figure 42:
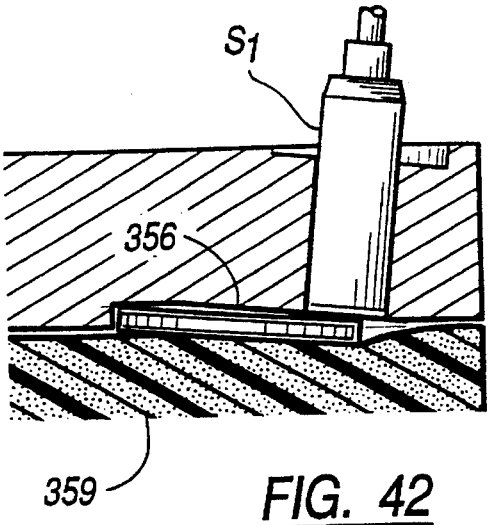
FIG. 42 is a section taken generally along line 42—42 in FIG. 41.
Figure 43:
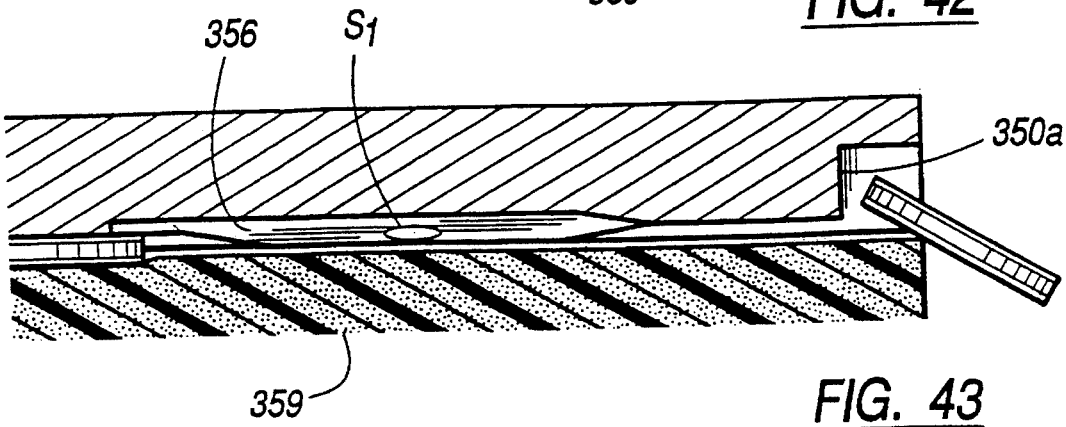
FIG. 43 is a section taken generally along line 43—43 in FIG. 41.

To ensure that the coins are pressed into the resilient surface of the rotating disc, the depth of each of the exit channels 350–355 must be substantially smaller than the thickness of the coin exited through that channel. In the case of the dime channel 350, the top surface 356 of the channel is inclined, as illustrated in FIGS. 42 and 43, to tilt the coins passing through that channel and thereby ensure that worn dimes are retained within the exit channel. As can be seen in FIG. 42, the sensor $S_1$ is also inclined so that the face of the sensor is parallel to the coins passing thereover.

Because the inclined top surface 356 of the dime channel 350 virtually eliminates any outer wall in that region of the channel 350, the dime channel is extended into the gaging recess 357. In the region where the outer edge of the channel 350 is within the radius $R_g$, the top surface of the dime channel is flat, so as to form an outer wall 358. This outer wall 358 prevents coins from moving outwardly beyond the gaging radius $R_g$ before they have entered one of the exit channels. As will be described in more detail below, the disc which carries the coins can recoil slightly under certain stopping conditions, and without the outer wall 358 certain coins could be moved outwardly beyond the radius $R_g$ by small recoiling movements of the disc. The wall 358 retains the coins within the radius $R_g$, thereby preventing the missorting that can occur if a coin moves outside the radius $R_g$ before that coin reaches its exit channel. The inner wall of the channel 350 in the region bounded by the wall 358 is preferably tapered at an angle of about 45° to urge coins engaging that edge toward the outer wall 358.

The inclined surface 356 is terminated inboard of the exit edge 350 of the exit channel to form a flat surface 360 and an outer wall 361. This wall 361 serves a purpose similar to that of the wall 358 described above, i.e., it prevents coins from moving away from the inner wall of the exit channel 350 in the event of recoiling movement of the disc after a braked stop.

Figure 41:
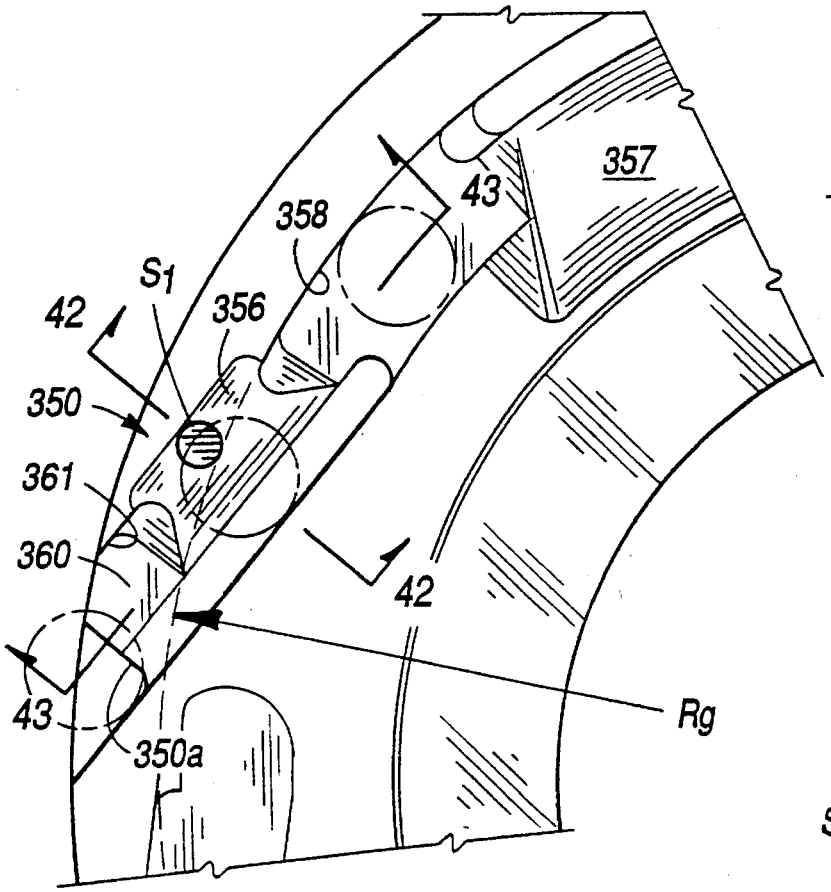
FIG. 41 is an enlarged plan view of a portion of the sorting head shown in FIG. 38.

As shown in FIGS. 38, 41 and 43, the exit end of each exit channel is terminated along an edge that is approximately perpendicular to the side walls of the channel. For example, in the case of the dime exit channel 350 shown in FIGS. 41–43, the exit channel terminates at the edge 350*a*. Although the upper portion of the sorting head extends outwardly beyond the edge 350*a*, that portion of the head is spaced so far above the disc and the coins (see FIG. 43) that it has no functional significance.

Having the exit edge of an exit channel perpendicular to the side walls of the channel is advantageous when the last coin to be discharged from the channel is followed closely by another coin. That is, a leading coin can be completely released from the channel while the following coin is still completely contained within the channel. For example, when the last coin in a desired batch of n coins is closely followed by coin n+1 which is the first coin for the next batch, the disc must be stopped after thee discharge of coin n but before the discharge of coin n+1. This can be more readily accomplished with exit channels having exit edges perpendicular to the side walls.

As soon as any one of the sensors $S_1$–$S_6$ detects the last coin in a prescribed count, the disc 359 is stopped by de-energizing or disengaging the drive motor and energizing a brake. In a preferred mode of operation, the disc is initially stopped as soon as the trailing edge of the "last" or nth coin clears the sensor, so that the nth coin is still well within the exit channel when the disc comes to rest. The nth coin is then discharged by jogging the drive motor with one or more electrical pulses until the trailing edge of the nth coin clears the exit edge of its exit channel. The exact disc movement required to move the trailing edge of a coin from its sensor to the exit edge of its exit channel, can be empirically determined for each coin denomination and then stored in the memory of the control system. The encoder pulses are then used to measure the actual disc movement following the sensing of the nth coin, so that the disc 359 can be stopped at the precise position where the nth coin clears the exit edge of its exit channel, thereby ensuring that no coins following the nth coin are discharged.

Figure 44A:
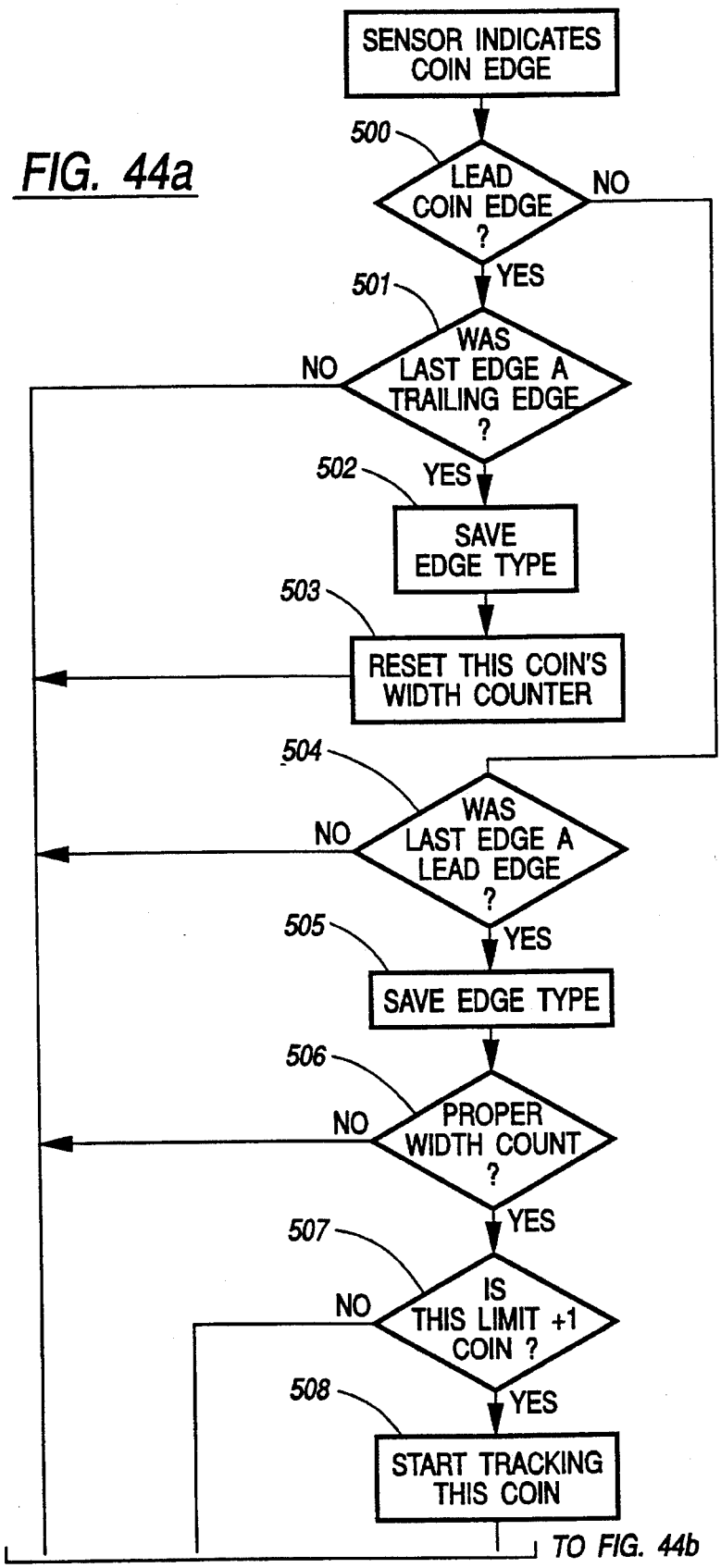
FIGS. 44*a* and 44*b* form a flow chart of a microprocessor program for controlling the disc drive motor and brake in a coin sorter using the modified sorting head of FIG. 38.
Figure 44B:
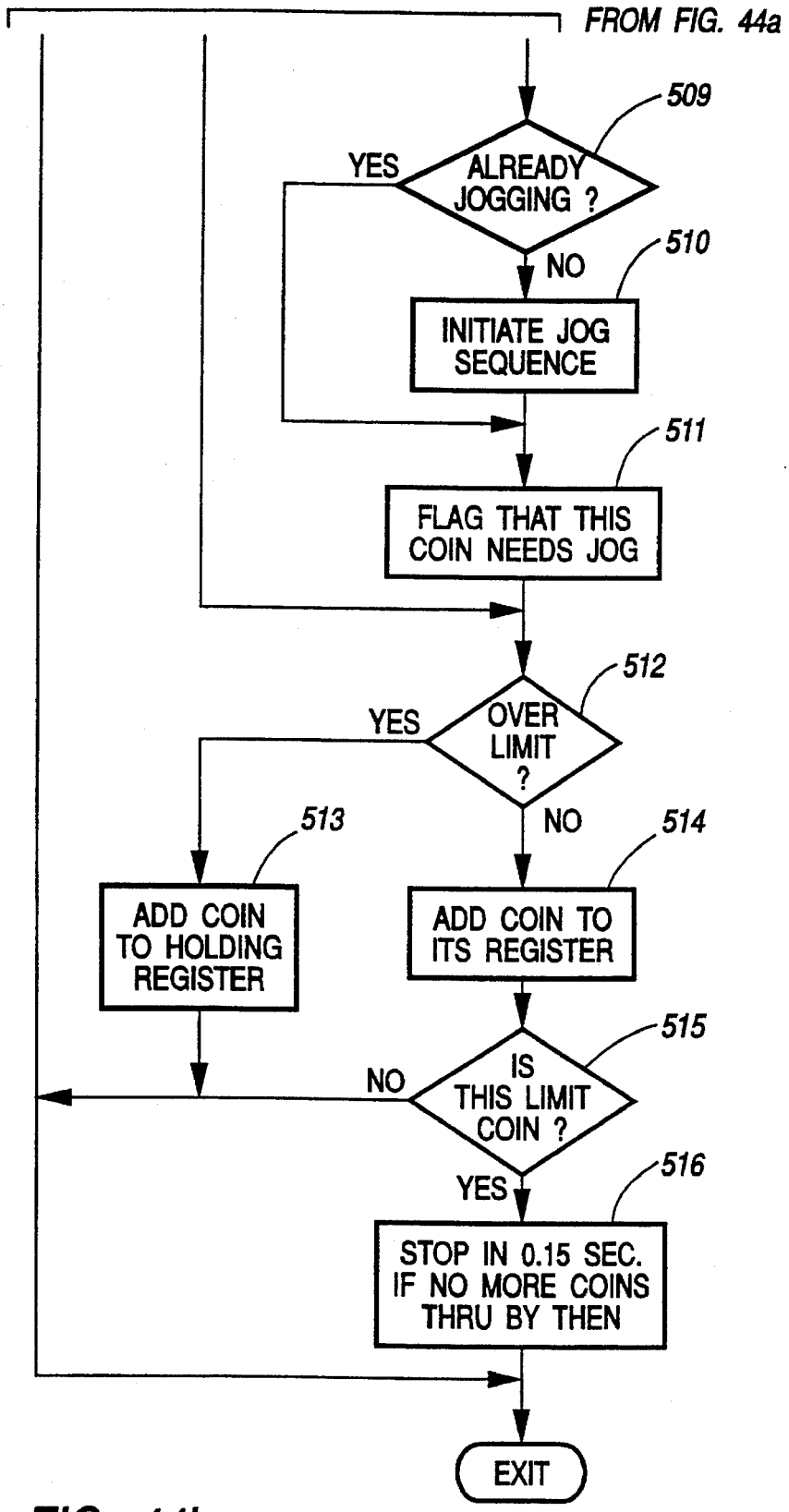
Figure 45A:
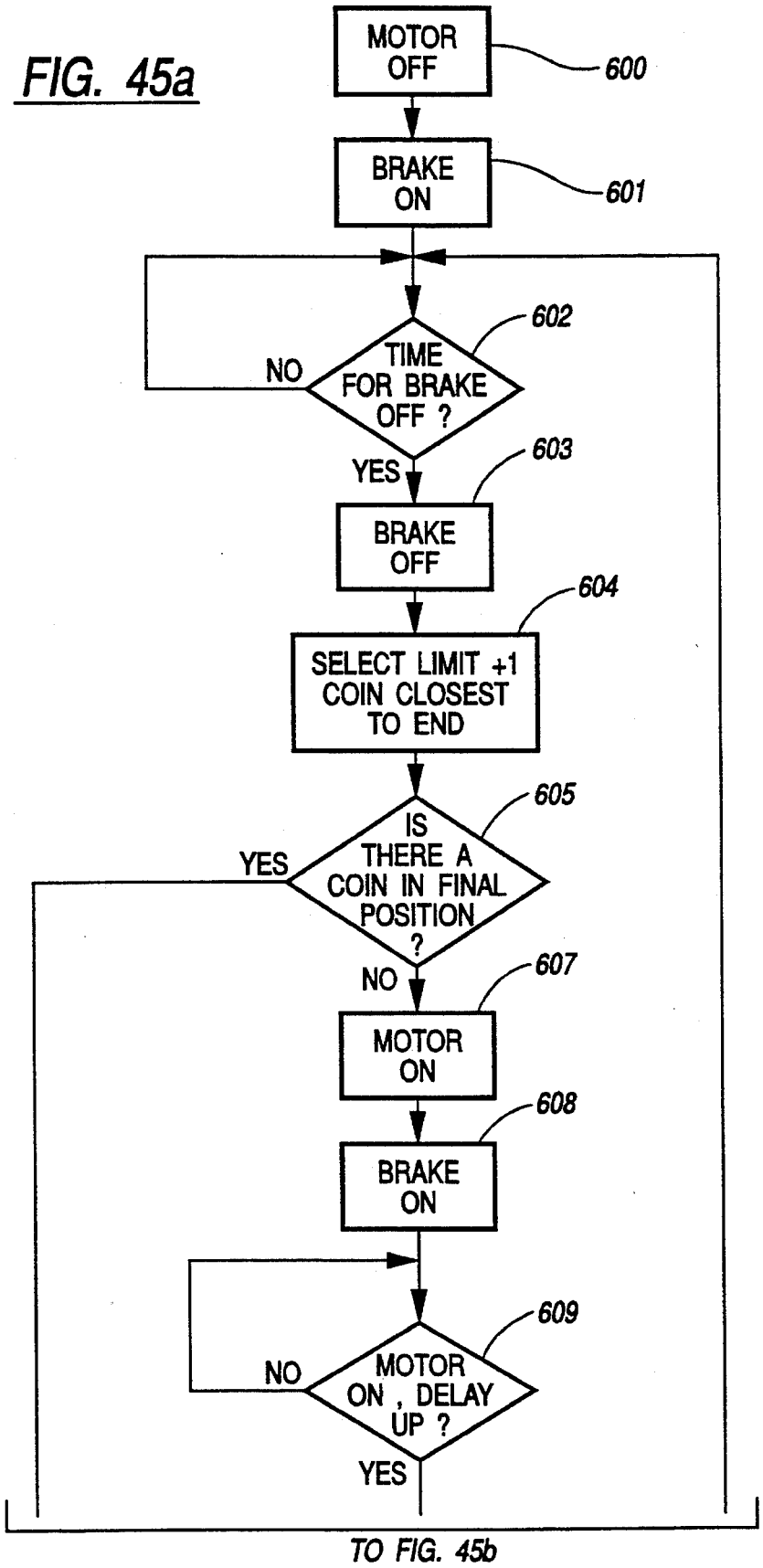
FIGS. 45*a* and 45*b* form a flow chart of a "jog sequence" subroutine initiated by the program of FIGS. 44*a* and 44*b;*
Figure 45B:
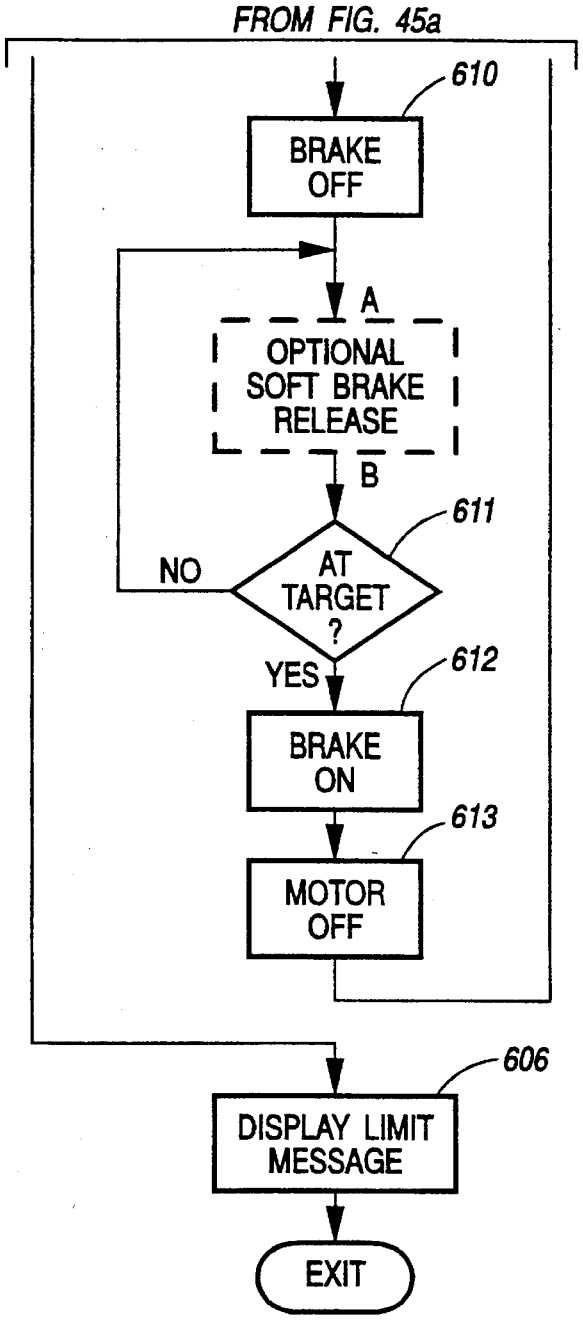
Figure 46:
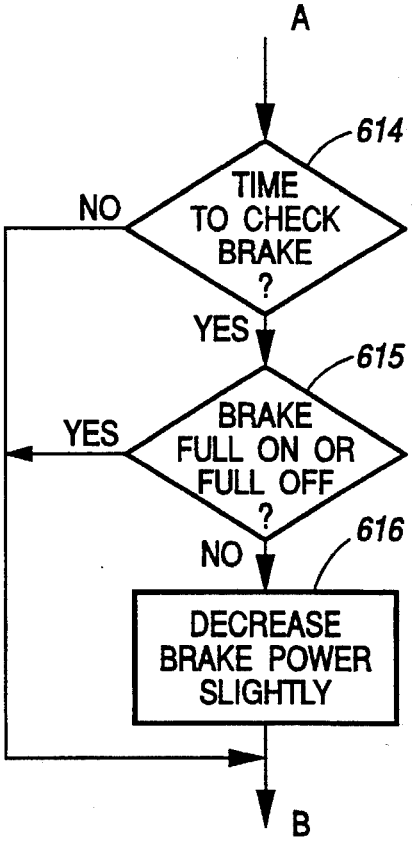
FIG. 46 is a flow chart of an optional subroutine that can be initiated by the subroutine of FIGS. 45*a* and 45*b;*
Figure 47:
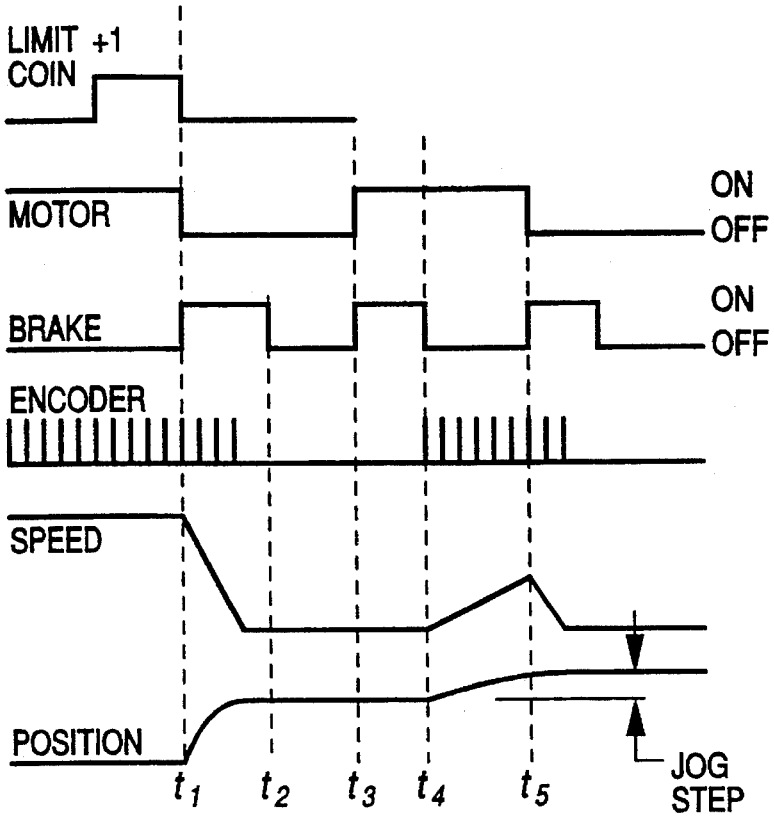
FIG. 47 is a timing diagram illustrating the operations controlled by the subroutine of FIGS. 45*a* and 45*b;*
Figure 48:
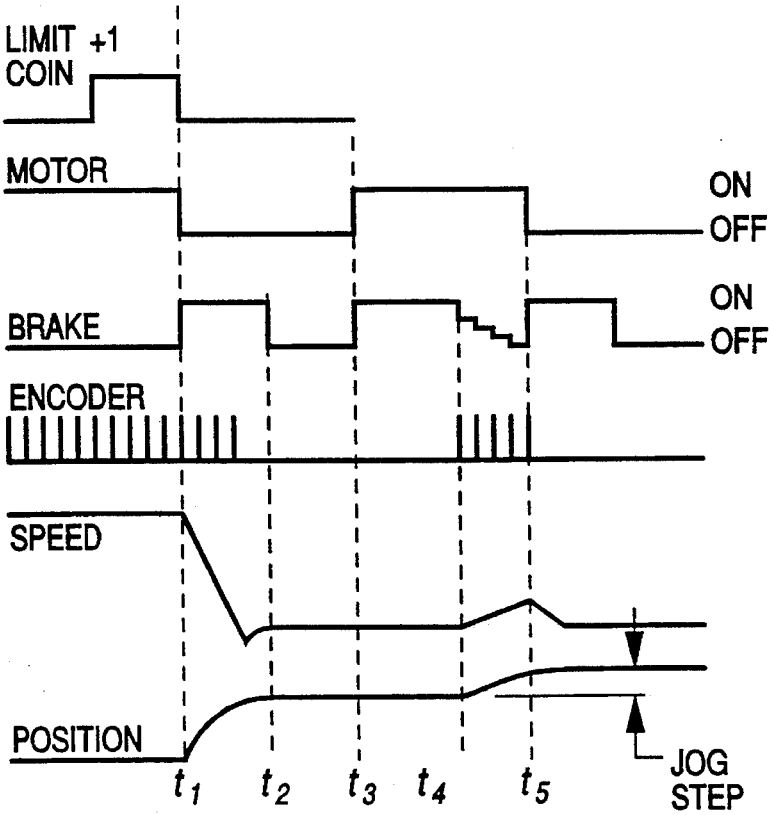
FIG. 48 is a timing diagram illustrating the operations controlled by the subroutines of FIGS. 45 and 46.

The flow chart of a software routine for controlling the motor and brake following the sensing of the nth coin of any denomination is illustrated in FIGS. 44–46, and corresponding timing diagrams are shown in FIGS. 47 and 48. This software routine operates in conjunction with a microprocessor receiving input signals from the six proximity sensors $S_1$–$S_6$ and the encoder 212, as well as manually set limits for the different coin denominations. Output signals from the microprocessor are used to control the drive motor and brake for the disc 359. One of the advantages of this program is that it permits the use of a simple a-c. induction motor as the only drive motor, and a simple electromagnetic brake. The routine charted in FIGS. 44*a* and 44*b* is entered each time the output signal from any of the sensors $S_1$–$S_6$ changes, regardless of whether the change is due to a coin entering or leaving the field of the sensor. The microprocessor can process changes in the output signals from all six sensors in less time than is required for the smallest coin to traverse its sensor.

The first step of the routine in FIG. 44*a* is step 500 which determines whether the sensor signal represents a leading edge of the coin, i.e., that the change in the sensor output was caused by metal entering the field of the sensor. The change in the sensor output is different when metal leaves the field of the sensor. If the answer at step 500 is affirmative, the routine advances to step 501 to determine whether the previous coin edge detected by the same sensor was a trailing edge of a coin. A negative answer indicates that the sensor output signal which caused the system to enter this routine was erroneous, and thus the system immediately exits from the routine. An affirmative answer at step 501 confirms that the sensor has detected the leading edge of a new coin in the exit slot, and this fact is saved at step 502. Step 503 resets a coin-width counter which then counts encoder pulses until a trailing edge is detected. Following step 503 the system exits from this routine.

A negative response at step 500 indicates that the sensor output just detected does not represent a leading edge of a coin, which means that it could be a trailing edge. This negative response advances the routine to step 504 to determine whether the previous coin edge detected by the same sensor was a leading edge. If the answer is affirmative, the system has confirmed the detection of a trailing coin edge following the previous detection of a leading coin edge. This affirmative response at step 504 advances the routine to step 505 where the fact that a trailing edge was just detected is saved, and then step 506 determines whether the proper number of encoder pulses has been counted by the encoder pulses in the interval between the leading-edge detection and the trailing-edge detection. A negative answer at either step 504 or step 506 causes the system to conclude that the sensor output signal which caused the system to enter this routine was erroneous, and thus the routine is exited.

An affirmative answer at step 506 confirms the legitimate sensing of both the leading and trailing edges of a new coin moving in the proper direction through the exit channel, and thus the routine advances to step 507 to determine whether the sensed coin is an n+1 coin for that particular denomination. If the answer is affirmative, the routine starts tracking the movement of this coin by counting the output pulses from the encoder.

At step 509, the routine determines whether the drive motor is already in a jogging mode. If the answer is affirmative, the routine advances to step 511 to set a flag indicating that this particular coin denomination requires jogging of the motor. A negative response at step 509 initiates the jogging mode (to be described below) at step 510 before setting the flag at step 511.

At step 512, the routine of FIG. 44*b* determines whether the most recently sensed coin is over the limit of n set for that particular coin denomination. If the answer is affirmative, the count for that particular coin is added to a holding register at step 513, for use in the next coin count. A negative response at step 512 advances the routine to step 514 where the count for this particular coin is added to the current count register, and then step 515 determines whether the current count in the register has reached the limit of n for that particular coin denomination. If the answer is negative, the routine is exited. If the answer is affirmative, a timer is started at step 516 to stop the disc at the end of a preselected time period, such as 0.15 second, if no further coins of this particular denomination are sensed by the end of that time period. The purpose of this final step 516 is to stop the disc when the nth coin has been discharged, and the time period is selected to be long enough to ensure that the nth coin is discharged from its exit channel after being detected by the sensor in that channel. If a further coin of the same denomination is sensed before this time period has expired, then the disc may be stopped prior to the expiration of the preselected time period in order to prevent the further coin from being discharged, as will be described in more detail below in connection with the jogging sequence routine.

Whenever step 510 is reached in the routine of FIG. 44*b*, the jog sequence routine of FIGS. 45*a* and 45*b* is entered. The first two steps of this routine are steps 600 and 601 which turn off the drive motor and turn on the brake. This is time $t_1$ in the timing diagrams of FIGS. 47 and 48, and a timer is also started at time $t_1$ to measure a preselected time interval between $t_1$ and $t_2$; this time interval is selected to be long enough to ensure that the disc has been brought to a complete stop, as can be seen from the speed and position curves in FIGS. 47 and 48. Step 602 of the routine of FIG. 45*a* determines when the time $t_2$ has been reached, and then the brake is turned off at step 603.

It will be appreciated that the n+1 coin may be reached for more than one coin denomination at the same time, or at least very close to the same time. Thus, step 604 of the routine of FIG. 45*a* determines which of multiple sensed n+1 coins is closest to its final position. Of course, if an n+1 coin has been sensed for only one denomination, then that is the coin denomination that is selected at step 604. Step 605 then determines whether the n+1 coin of the selected denomination is in its final position. This final position is the point at which the n+1 coin has been advanced far enough to ensure that the nth coin has been fully discharged from the exit channel, but not far enough to jeopardize the retention of the n+1 coin in the exit channel. Ideally, the final position of the n+1 coin is the position at which the leading edge of the n+1 coin is aligned with the exit edge 350*a* of its exit channel.

When the n+1 coin has reached its final position, step 605 yields an affirmative response and the routine advances to step 606 where a message is displayed, to indicate that the nth coin has been discharged. The routine is then exited. If the response at step 605 is negative, the drive motor is turned on at step 607 and the brake is turned on at step 608. This is time $t_3$ in the timing diagrams of FIGS. 47 and 48. After a predetermined delay interval, which is measured at step 609, the brake is turned off at time $t_4$ (step 610). Up until the time $t_4$ when the brake is turned off, the brake overrides the drive motor so that the disc remains stationary even though the drive motor has been turned on. When the brake is turned off at time $t_4$, however, the drive motor begins to turn the disc and thereby advance both the n+1 coin and the nth coin along the exit channel.

Step 611 determines when the n+1 coin has been advanced through a preselected number of encoder pulses. When step 611 produces an affirmative response, the brake is turned on again at step 612 and the motor is turned off at step 613. This is time $t_5$ in the timing diagrams. The routine then returns to step 602 to repeat the jogging sequence. This jogging sequence is repeated as many times as necessary until step 605 indicates that the n+1 coin has reached the desired final position. As explained above, the final position is the position at which the n+1 coin is a position which ensures that the nth coin has been discharged from the exit channel and also ensures that the n+1 coin has not been discharged from the exit channel. The routine is then exited after displaying the limit message at step 606.

Instead of releasing the brake abruptly at time $t_4$, as indicated in the timing diagram of FIG. 47, the brake may be turned only partially off at step 610 and then released gradually, according to the subroutine of FIG. 46 and the timing diagram of FIG. 48. In this "soft" brake release mode, step 614 measures small time increments following time $t_4$, and at the end of each of these time increments step 615 determines whether the brake is fully on or fully off. If the answer is affirmative, the subroutine exits to step 611. If the answer is negative, the brake power is decreased slightly at step 616. This subroutine is repeated each time the jogging sequence is repeated, until step 615 yields an affirmative response. The resulting "soft" release of the brake is illustrated by the steps in the brake curve following time $t_4$ in FIG. 48.

Figure 49:
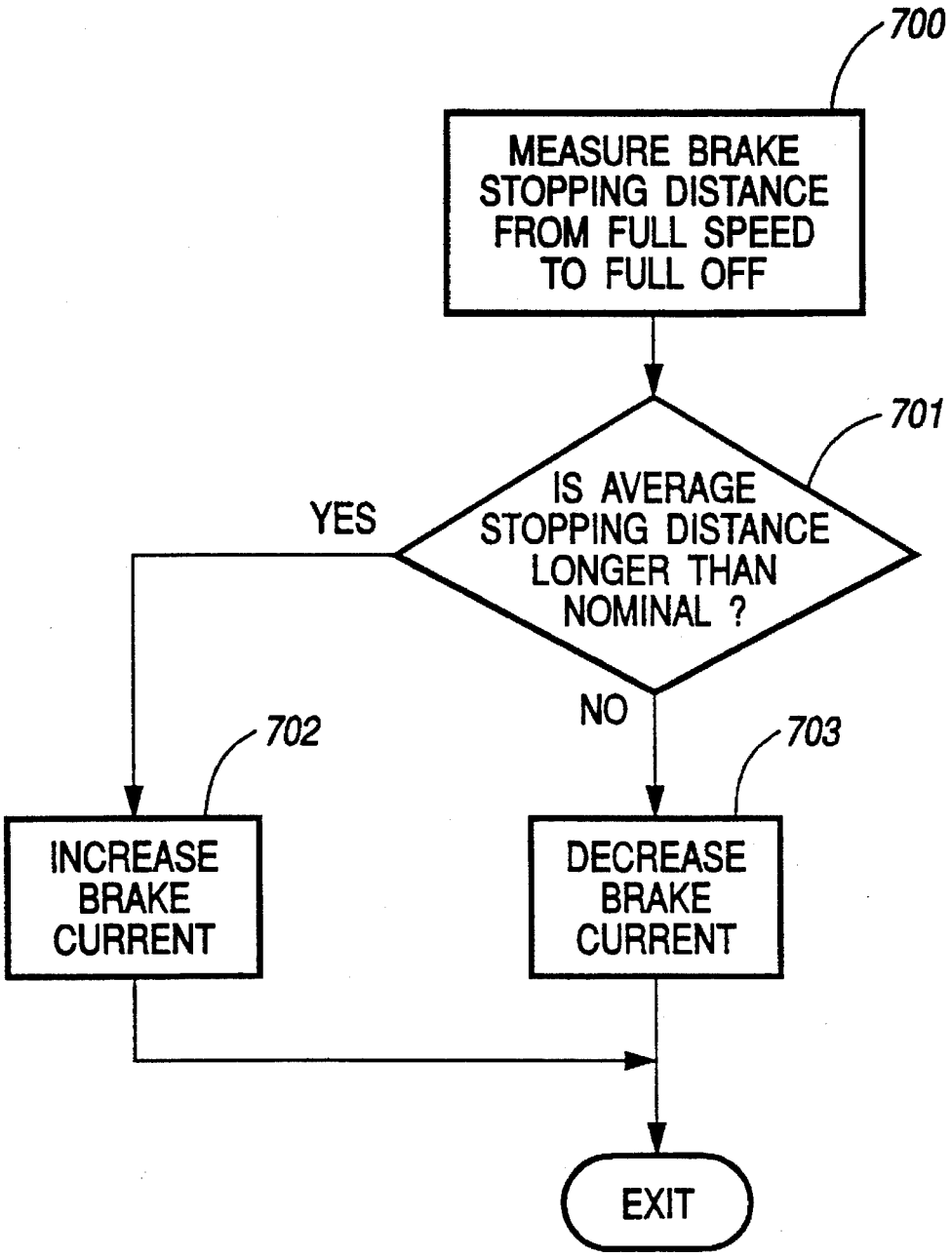
FIG. 49 is a flow chart of a subroutine for controlling the current supplied to the brake.

An additional subroutine, illustrated in FIG. 49, automatically adjusts the energizing current supplied to the brake in order to compensate for variations in the line voltage, temperature and other variables that can affect the stopping distance after the brake has been energized. Step 700 of this subroutine measures the stopping distance each time the brake is turned off. Step 701 then determines whether that measured stopping distance is longer than a preselected nominal stopping distance. If the answer is affirmative, the brake current is increased at step 702, and is the answer is negative, the brake current is decreased at step 703. The subroutine is then exited.

Figure 50:
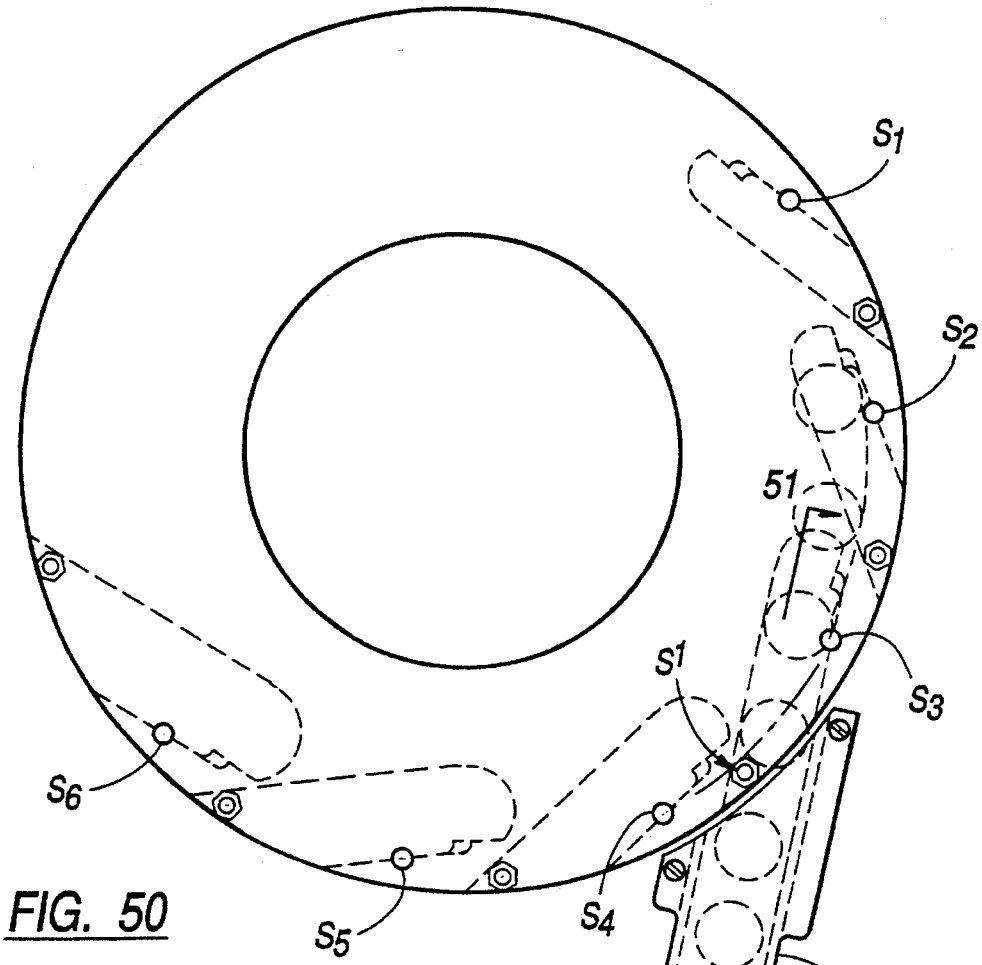
FIG. 50 is a top plan view of another modified sorting head and a cooperating exit chute.
Figure 51:
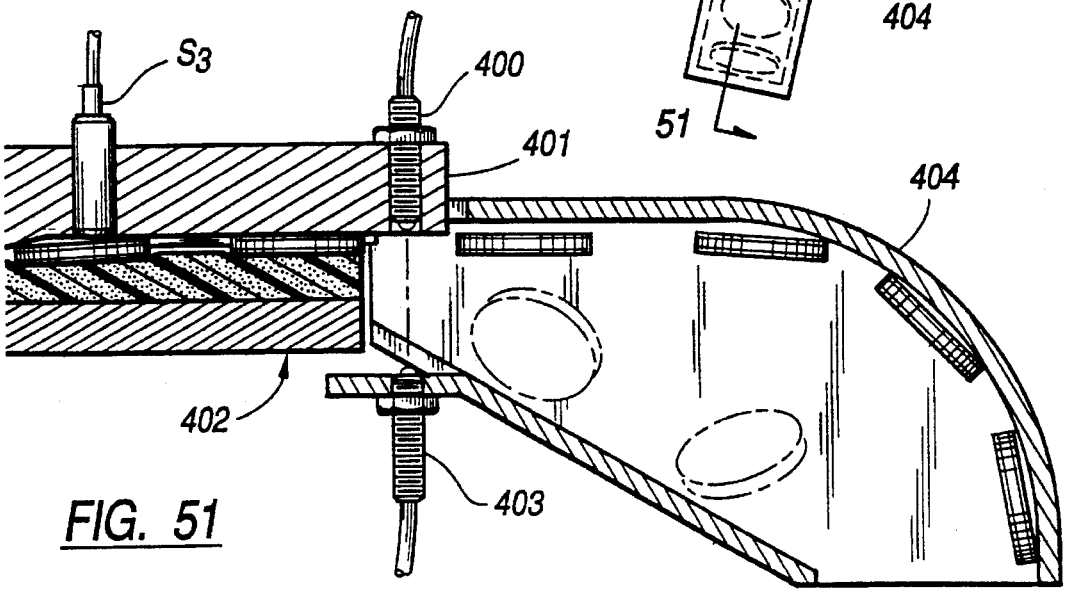
FIG. 51 is an enlarged section taken generally along line 51—51 in FIG. 50.

In the modified embodiment of FIGS. 50 and 51, a second sensor S' is provided outboard of the disc at the end of each exit channel to confirm that the nth coin has, in fact, been discharged from the disc. With this arrangement, no encoder is required and the software routine of FIG. 52 can be utilized. As can be seen in FIG. 51, the second sensor S' is formed by a light source 400 mounted in an extension of the head 401 beyond the disc 402, and a photodetector 403 mounted in the bottom wall on exit chute 404.

Figure 52:
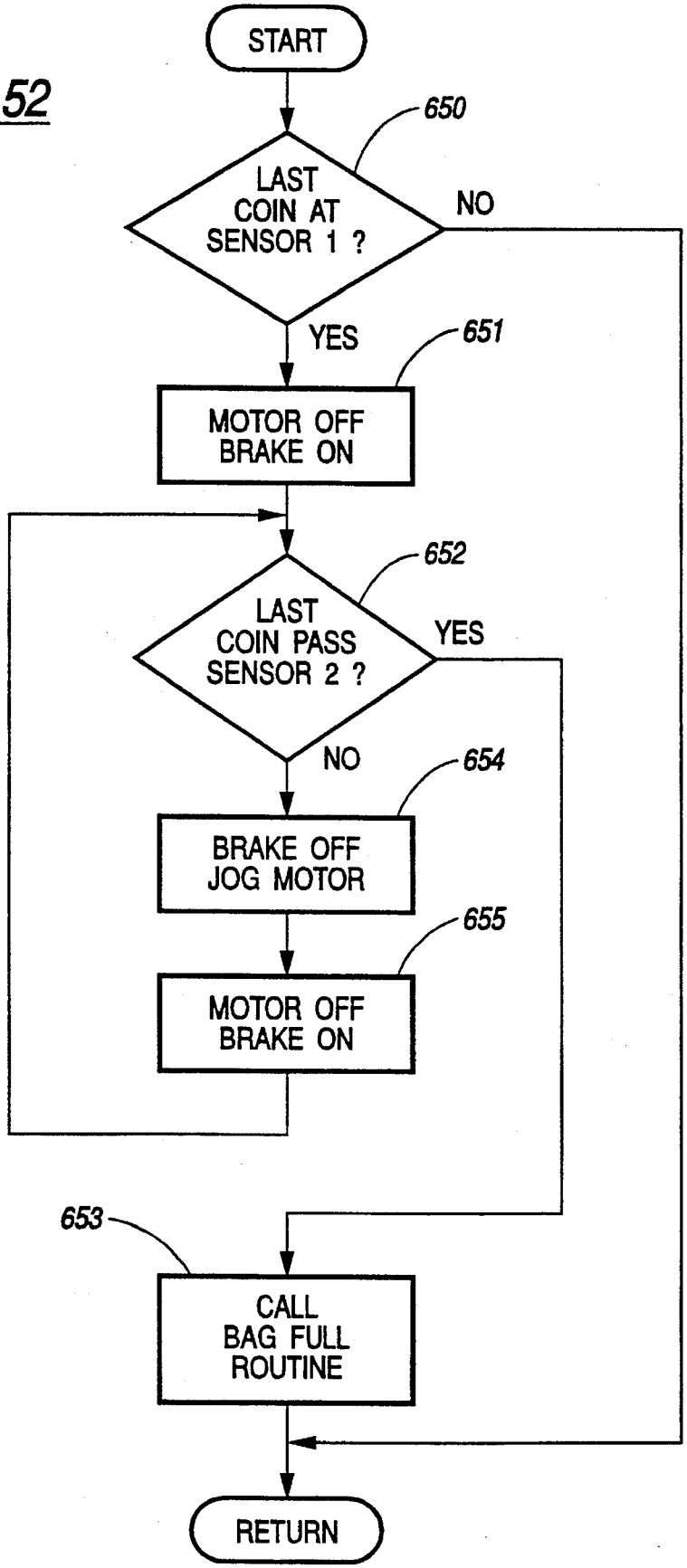
FIG. 52 is a flow chart of a micro-processor program for controlling the disc drive motor and brake in a coin sorter using the modified sorting head of FIG. 50.

The routine of FIG. 52 begins at step 650, which determines whether the coin sensed at the first sensor is the nth coin in the preselected number of coins of that denomination. If the answer is negative, the routine is exited. If the answer is affirmative, the subroutine stops the disc at step 651 by de-energizing the motor and energizing the brake. Step 652 then determines whether the nth coin has been detected by the second sensor S'.

As long as step 652 produces a negative answer, indicating that the nth coin has not been detected by the second sensor S' the routine advances to step 654 which turns off the brake and jogs the motor by momentarily energizing the motor with a controlled pulse. The motor is then immediately turned off again, and the brake is turned on, at step 655. The routine then returns to step 652.

When step 652 produces an affirmative answer, indicating that the nth coin has been detected by the second sensor, a "bag full" routine is entered at step 653. The "bag full" routine ensures that the disc remains stationary until the full bag is removed and replaced with an empty bag.

Figure 53:
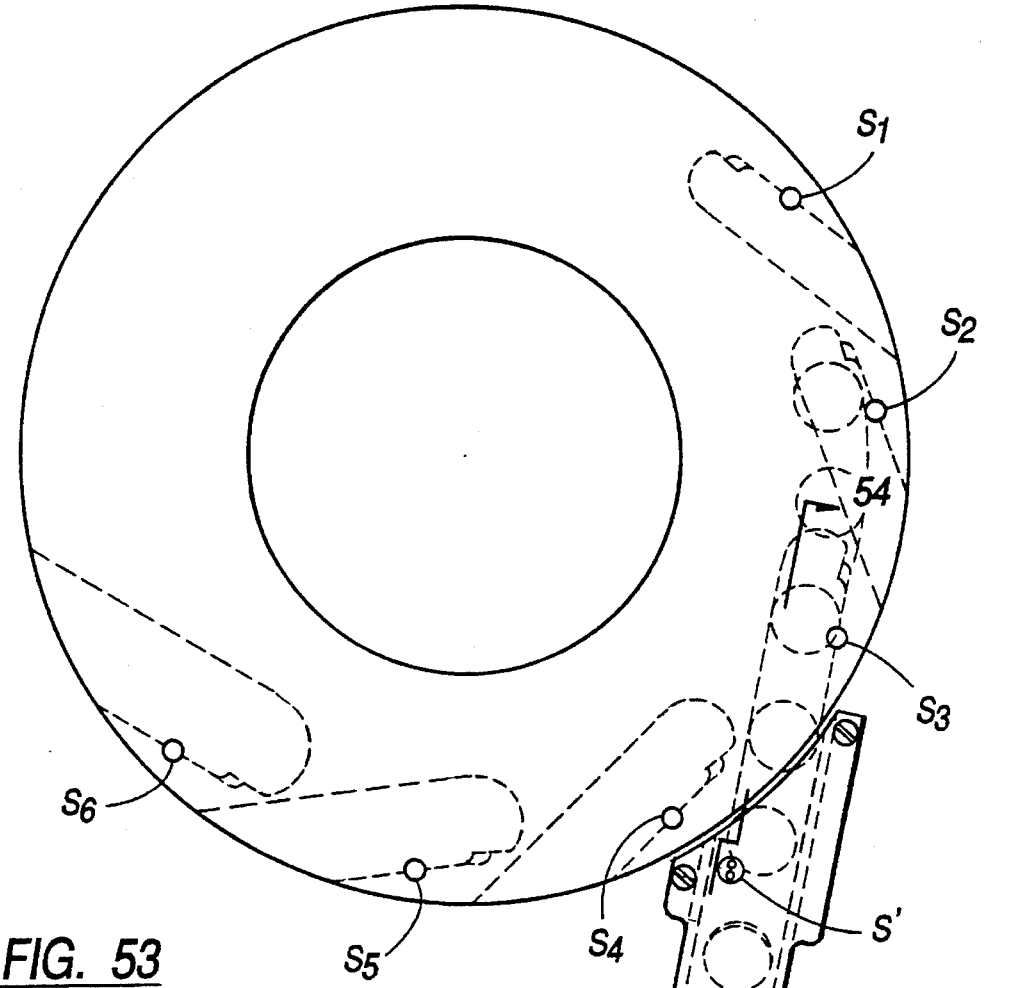
FIG. 53 is a top plan view of another modified sorting head and a cooperating exit chute.
Figure 54:
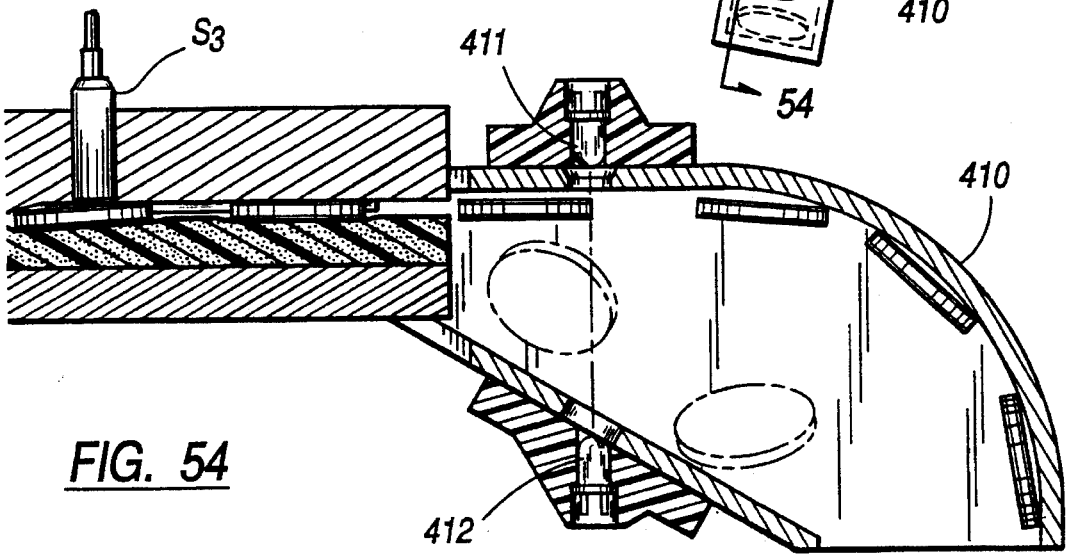
FIG. 54 is an enlarged section taken generally along line 54—54 in FIG. 53.

In FIGS. 53 and 54, there is shown another modified embodiment which the second sensor S' is located entirely in the exit chute 410. Here again, the second sensor S' is formed by a light source 411 and a photodetector 412, but in this case both elements are mounted in the exit chute 410. Also, both the source 411 and the detector 412 are spaced away from the outer edge of the disc by a distance which is approximately the same as the diameter of the particular coin denomination being discharged at this location. Consequently, whenever the sensor S' detects a new coin, that coin has already been released from the disc and the sorting head.

Figure 55:
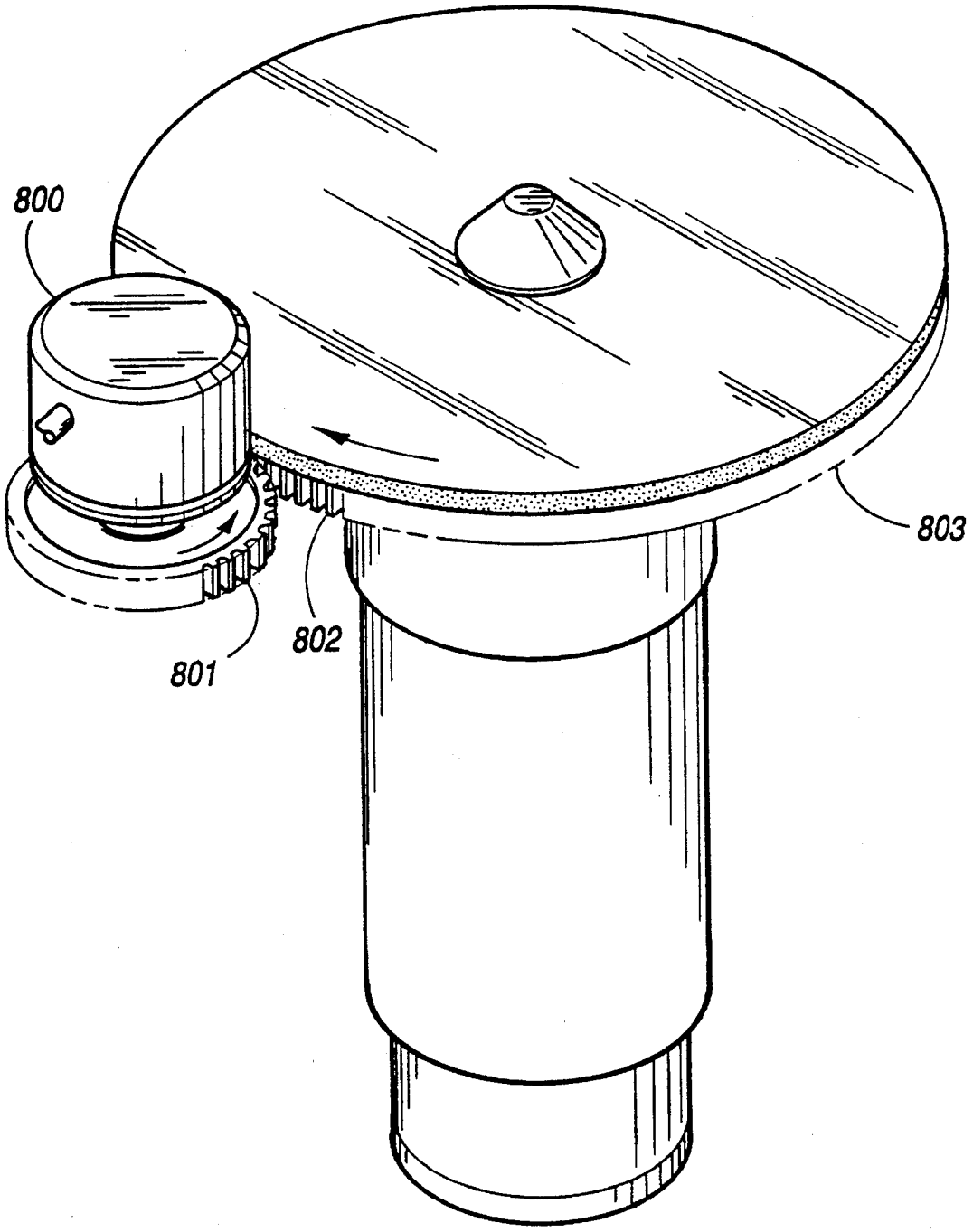
FIG. 55 is a perspective view of a modified encoder for monitoring the angular movement of the disc.

FIG. 55 illustrates a preferred encoder 800 to be used in place of the encoder 212 shown in FIG. 16. The encoder 800 has a gear wheel 801 meshing with gear teeth 802 on the periphery of the metal disc 803. The meshing gear teeth ensure that the encoder 800 positively tracks the rotational movement of the disc 803.

Figure 56:
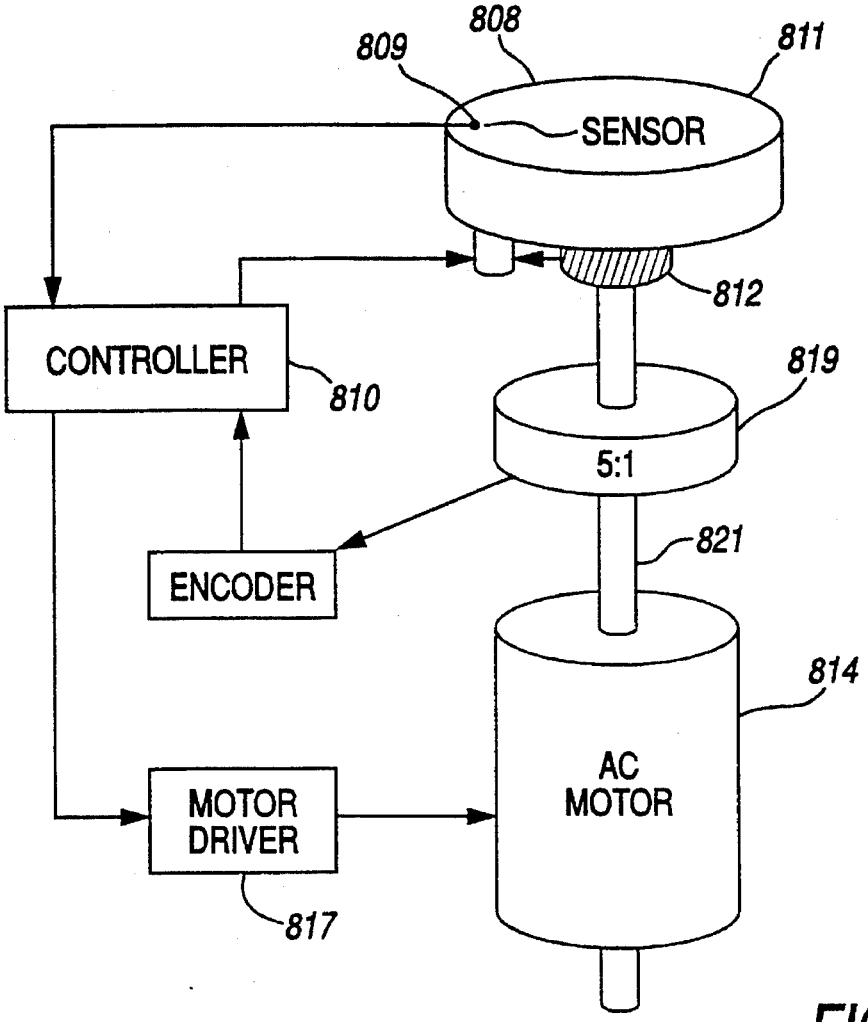
FIG. 56 is a diagram illustrating a coin sorting system using an encoder, a brake and a rotation-speed reducer, according to the principles of the present invention.

Referring now to FIG. 56, there is shown another coin handling system, in accordance with the present invention, which provides coin-discharge control for coins on a rotating coin disc 808 using a microprocessor-based controller 810. The controller 810 controls a brake 812 and an AC motor 814, via a motor driver 817, in response to a coin sensor 809 embedded in the stationary head 811 and an encoder 816. The coin sensor 809 is used to count the number of coins of each denomination passing the sensor, and the encoder 816 is used to monitor the angular displacement of a speed reducer 819. The coin sensor 809 may be implemented in a number of ways, such as those described in connection with FIGS. 17, 24, 29 and 38.

Figure 57:
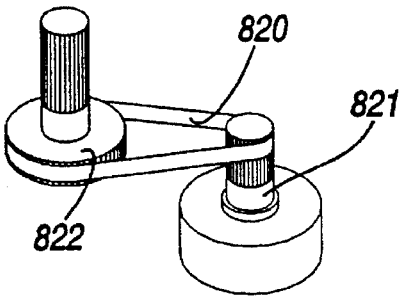
FIG. 57 is a diagram illustrating an implementation for the rotation-speed reducer, shown in FIG. 56.
Figure 58:
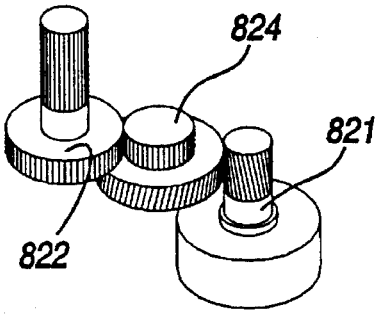
FIG. 58 is diagram illustrating another implementation for the rotation-speed reducer shown in FIG. 56.

As shown in FIGS. 57 and 58, the speed reducer 819 can be implemented using a ridged belt 820 to couple the motor drive shaft 821 with a gear 822, or using a gear train 824, or a combination of both types of speed reducers. Speed reducers of this type, such as shown in U.S. Pat. Nos. 5,021,026 and 5,055,086, are conventional.

By configuring the encoder 816 such that it monitors the motor-axle side of the speed reducer 819, each turn of the motor axle 821 is translated to only a fraction of the angular movement of the coin disc 808, thereby permitting precise monitoring of the coin disc position. For example, using a speed reducer 819 which has a 5:1 gear ratio, a 100 degree rotation of the motor axle 821 translates to only a 20 degree rotation of the coin disc 808. The controller 810 uses this translatory arrangement to determine exactly how far a coin has progressed once it is detected by the coin sensor on the stationary sorting head.

Figure 59A:
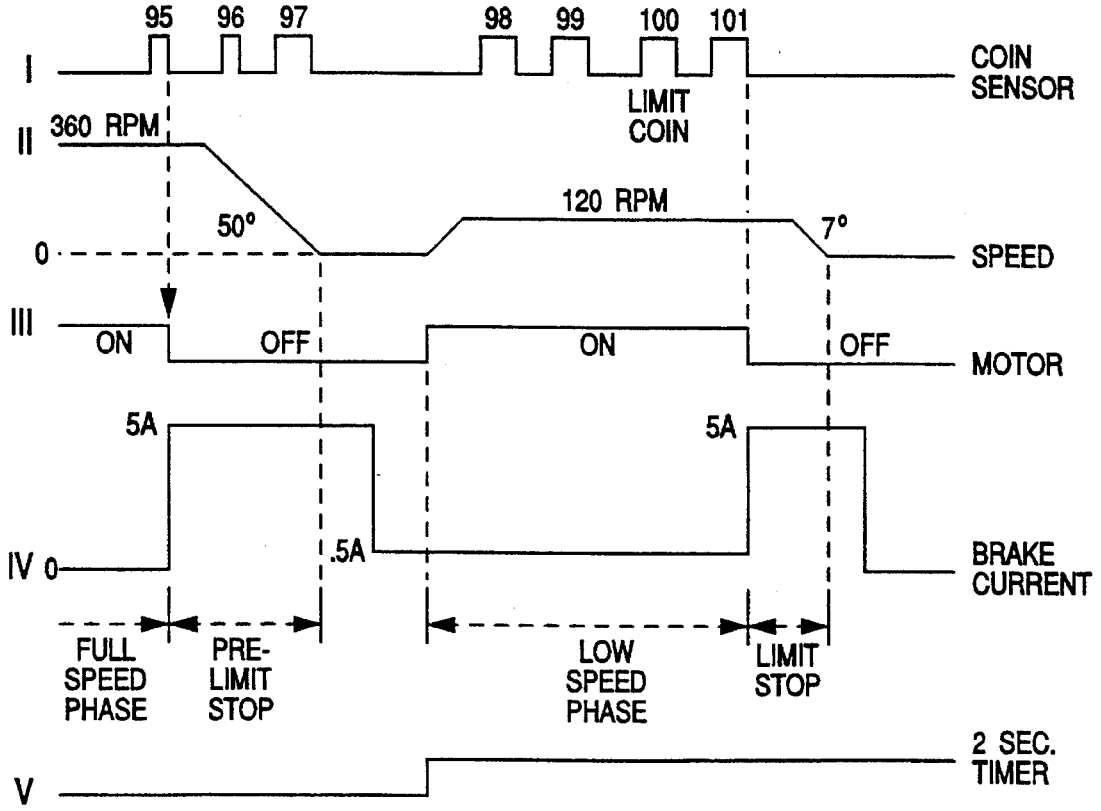
FIG. 59*a* is a timing diagram showing various control and status signals for the system of FIG. 56 when operating in accordance with the present invention.

FIG. 59*a* illustrates the timing for an exemplary operation of the system shown in FIG. 56. The first line of the timing diagram of FIG. 59*a*, depicted by I, represents the signal output from the coin sensor 809, using the one-hundredth coin of a particular coin denomination as the limit coin. The second and third lines II and III of the timing diagram represent, respectively, the speed of the motor 814 and the power control signal (ON or OFF) to the motor 814. The controller 810 controls the speed of the motor by using the power control signal (line III) to turn the power to the motor on and off and to selectively actuate the brake 812. The timing and magnitude of the brake current is shown on line IV. Line V represents an internal timing signal used by the controller 810 to determine if too much time has passed before sensing the limit coin.

Assuming that the controller has been programmed with the one-hundredth coin of a particular denomination as the limit coin and the ninety-fifth coin of that denomination as the prelimit coin, the controller runs the motor at full speed until the prelimit coin is sensed by the coin sensor. When the prelimit coin has been sensed, the controller initiates immedidate deceleration of the rotating disc, and then slowly advances the disc until the limit coin is sensed, sorted and discharged. This ensures that the higher speed at which the disc sorts coins does not discharge any coins beyond the preselected coin limit.

To achieve this goal, in response to sensing the prelimit coin, the controller sends a signal to a relay or solenoid or other device (not shown in the figures) to shut down power to the motor. The timing for this shut-down signal is shown on line III of FIG. 59*a* in the first falling edge of the motor power control signal. At essentially the same time the power to the motor is interrupted, the controller sends a signal to the brake so as to apply maximum braking force against the rotating disc. The timing for this signal is shown on line IV as the first rising edge of the brake current signal. A short time later and within about fifty degrees of disc rotation, the rotating disc is brought from full speed (e.g., 360 RPM) to a static position, as indicated by the second horizontal line on the speed plot of line II. In the meantime and during this fifty degree of disc-rotation, the coin sensor has sensed the ninety-sixth and ninety-seventh coins, depicted on line I.

A short time after the disc is halted, the controller sends a signal to the brake to apply a reduced braking force against the rotating disc. The timing for this signal is shown on line IV as the first falling edge of the brake current signal. As depicted after this first falling edge, this reduced braking force corresponds to a current level of 0.5 amperes, or about ten percent of the maximum braking force. With the braking force at this reduced level, the controller next turns the motor on again and simultaneously activates a two-minute internal timer. The disc begins rotating again but at a much slower speed, e.g., 120 RPM.

This slower rotation of the disc continues until the earlier of three events occurs.

The first event is the controller receiving an indication that the first coin beyond the limit coin (limit+1) has been sensed. If this condition occurs, the controller engages the brake and removes power to the motor simultaneously. By the time the rotation of the disc is stopped, the limit coin will have been rotated out of the appropriate coin exit path.

The second event is based on a timing signal, preferably internal to the controller, indicating that 100 milliseconds has lapsed since the limit coin was sensed. Once the disc has rotated for 100 milliseconds after the limit coin has been sensed at the reduced speed, the controler can assume that the limit coin has been discharged. The 100-millisecond period is selected based on the reduced speed of the disc, the size of the disc and the position of the sensor with respect to the coin-exit channel.

Figure 59B:
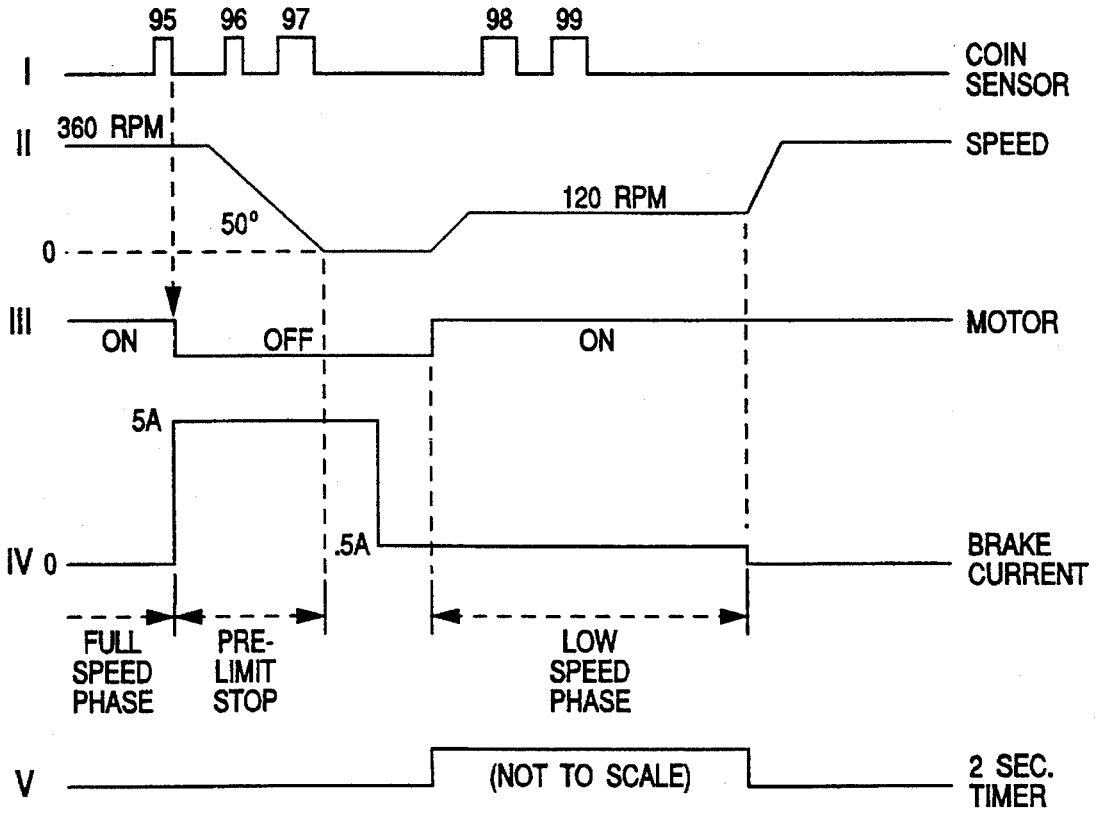
FIG. 59*b* is another timing diagram showing various control and status signals for the system of FIG. 56.

The third event is based on the two-second timing signal shown on line V of FIG. 59*b*. The controller begins the timing signal, using an internal counter, once power has been provided to the motor to initiate the reduced speed (120 RPM) mode. After the two-second period has lapsed, the controller operates under the assumption that neither of the first two conditions has occurred or is imminent. In anticipation that additional full-speed sorting will produce the limit coin, the controller removes the braking force on the disc completely until the limit coin is sensed and counted. If there are coins after the limit coin, this resumption to full-speed rotation will typically cause a coin-discharge overage, the amount of which is dependent on the number of coins counted in the low speed phase (e.g., 120 RPM). The worst case overage will be equal to one less than the sorter inherent overage (SIO). The SIO is the the worst coin overage for a specific coin denomination when the disk is stopped from the full speed.

The probability of not achieving the exact stop is very low and depends on the coin distribution immediately before the limit is reached. This probability is described mathematically as follows: if the last N coins are found within R revolutions for the disc then the overage is zero, where N is the SIO and R is the number of disc revolutions allowed in the reduced speed mode. Exemplary values for N and R are 5 and 4, respectively. The actual overages will always be lower than the SIO number. The value of R is somewhat arbitrary and, if desired, can be changed to meet the specific coin-sorting application.

The likelihood that 5 coins of a selected denomination will not be found within 4 disc revolutions is relatively low.

In response to the occurrence of either the first or second event or to sensing of the limit coin in the third event, the controller sends the appropriate signals to bring the disc to an immediate halt. Thus, power to the motor is removed and the controller commands the brake to apply maximum braking force against the rotating disc. During this phase, the disc is stopped after about seven degrees of disc rotation. Halting the disc in response to the first event is illustrated in FIG. 59*a*. For example, in response to the controller receiving the trailing edge (line I) of the signal corresponding to sensing the coin after the limit coin, the power to the motor is shown being removed on the second trailing edge of line III.

As an alternative to the controller being programmed to determine the occurrence of the first and second of the above three events, a second sensor located outboard of the rotating disc may be used in combination with the encoder to indicate to the controller when the limit coin has been discharged from the disc. Because the outboard sensor cannot alleviate the problem when the limit coin is not sensed after an extended period of time, in this embodiment the controller is programmed to determine and react to the occurrence of the third event described above. The disc arrangement of any of the previously-described implementations may be used, in combination with an outboard sensor to accomplish this approach. The outboard coin sensor referred to above is shown for one of the coin-discharge exit paths in FIG. 29, depicted in dotted lines as S7.

FIG. 59*b* is another timing diagram showing the operation of the system of FIG. 56 in response to the above-described third event. By comparing the signals of the timing diagrams of FIGS. 59*a* and 59*b*, it can be seen that operation of the system is identical through the sensing of the ninety-ninth coin. After sensing this coin, however, the limit coin is not sensed within the two-second period of the timing signal represented by line V of FIG. 59*b*. At the end of this two-second period, the controller completely removes the braking force on the disc, so that the rotation of the disc ramps up to maximum speed until the limit coin is sensed. Where this two-second period ends (trailing edge of the signal depicted by line V of FIG. 59*b*), the speed of the motor is shown ramping up to full speed at 360 RPM on line II of FIG. 59*b*.

Alternatively, the controller is programmed to ramp up the disc rotation speed only for a predetermined period of time, after which the controller displays a signal to the system user indicating whether or not the limit coin was reached and, if not, the amount of the shortage.

An acceptable coin sorting system, according to the configuration of the system of FIG. 56, includes the exact bag stop 13-inch diameter sorting head used on Cummins Model 3400, modified as illustrated in FIG. 56 to include the in-head sensors.

Figure 60:
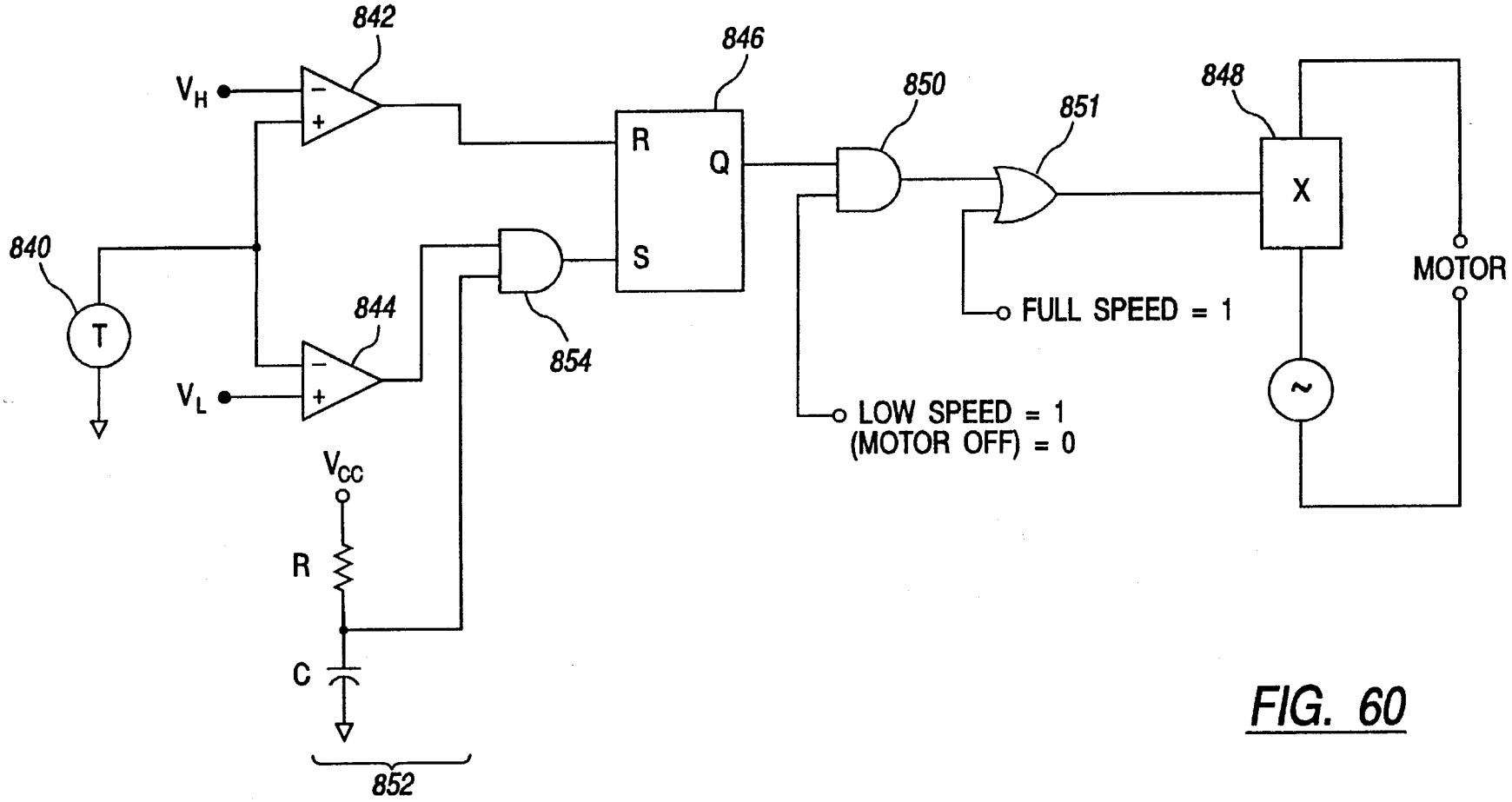
FIG. 60 is a block diagram illustrating a circuit for controlling a motor in accordance with the present invention.

FIG. 60 illustrates a system for controlling the AC motor shown in FIG. 56 to obtain the low-speed (120 RPM) mode. The block diagram of FIG. 60 includes a tachometer 840 providing a signal representative of the speed of the AC motor, and two comparators 842 and 844. The comparators 842 and 844 compare the speed of the motor, using the signal provided by the tachometer 840, with respective high and low speed thresholds, $V_H$ and $V_L$, to determine when the motor is rotating too fast and too slow. By setting the high and low speed thresholds, $V_H$ and $V_L$, so that their average corresponds to the low speed disc rotation, the power to the motor is controlled to maintain an average speed corresponding to the low speed disc rotation. For example, for a desired average speed of 120 RPM, the respective high and low speed thresholds, $V_H$ and $V_L$, can be set at levels corresponding to disc speeds of 125 RPM and 115 RPM. When the speed of the disc exceeds the 125 RPM limit, the output of the comparator 842 provides a high-level output signal to indicate that the power to the motor should be shut off. When the speed of the disc falls below the 115 RPM limit, the output of the comparator 844 provides a low-level output signal to indicate that the power to the motor should be turned back on. In this way, the power to the motor is pulsed on and off to effect a much more controlled disc speed.

The output signals from the comparators 842 and 844 are coupled to the respective S-R inputs of an S-R flip-flop 846, which provides an output signal Q based on the signals at the S-R inputs. The output signal Q is coupled to a switch 848, via an AND gate 850 and an OR gate 851, to control power to the AC motor. When the output of the comparator 844 is high, the S-R flip-flop 846 produces a high-level output signal, providing power to the motor to speed up the motor. When the output of the comparator 842 is high, the S-R flip-flop 846 produces a low-level output signal, causing the switch 848 to disconnect power to the motor to slow down the motor. When the signal provided by the tachometer 840 indicates that the motor speed corresponds to a speed which is between the high and low threshold levels, $V_H$ and $V_L$, the outputs of the comparators 842 and 844 are low and the S-R flip-flop does not change state.

The output of the comparator 844 should not be high when the output of the comparator 842 is high, because the outputs of the comparators 842 and 844 provide mutually exclusive signals. Either the motor is too fast or it is too slow; it cannot be too fast and too slow. To ensure that this logical boundary is not violated upon powering-up the comparators 842 and 844 and the flip-flop 846, an R-C circuit 852 is used in combination with an AND gate at the S input to the S-R flip-flop 846. The RC time constant for the R-C circuit 852 is therefore selected so that the S input to the S-R flip-flop 846 remains low, via the AND gate 854, until the comparators 842 and 844 and the flip-flop 846 are fully powered.

The AND gate 850 receives the Q output from the S-R flip-flop 846 and a low-speed enable signal from the controller, so that the low-speed mode is operative only when the controller provides the low-speed enable signal (high). When the controller does not provide the low-speed enable signal, the output of the AND gate 850 is low and the flip-flop 846 is disabled.

The OR gate 851 receives the output from the AND gate 850 and a full-speed enable signal from the controller, so that the motor operates at full speed whenever the controller provides the full-speed enable signal (high). When the controller does not provide the full-speed enable signal, the output of the OR gate 851 is controlled by the Q output from the S-R flip-flop 846 and the low-speed enable signal. To shut down power to the motor, the controller sends both the low-speed enable signal and the full-speed enable signal low.

Figure 61A:
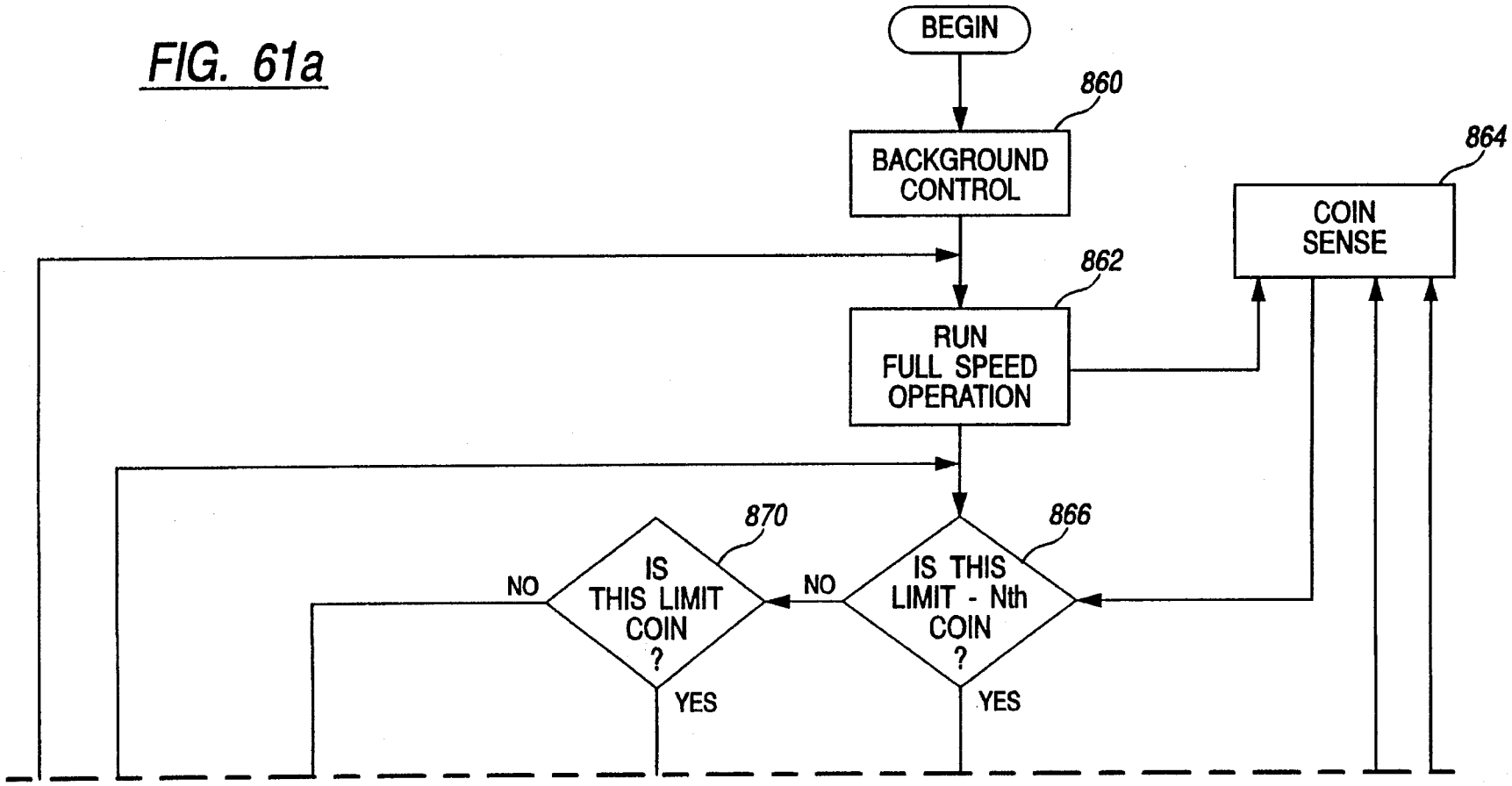
FIG. 61 is a flow chart, according to the present invention, showing a way to program a microcomputer for controlling an AC motor and a brake in a coin sorting system such as the one shown in FIG. 56.
Figure 61B:
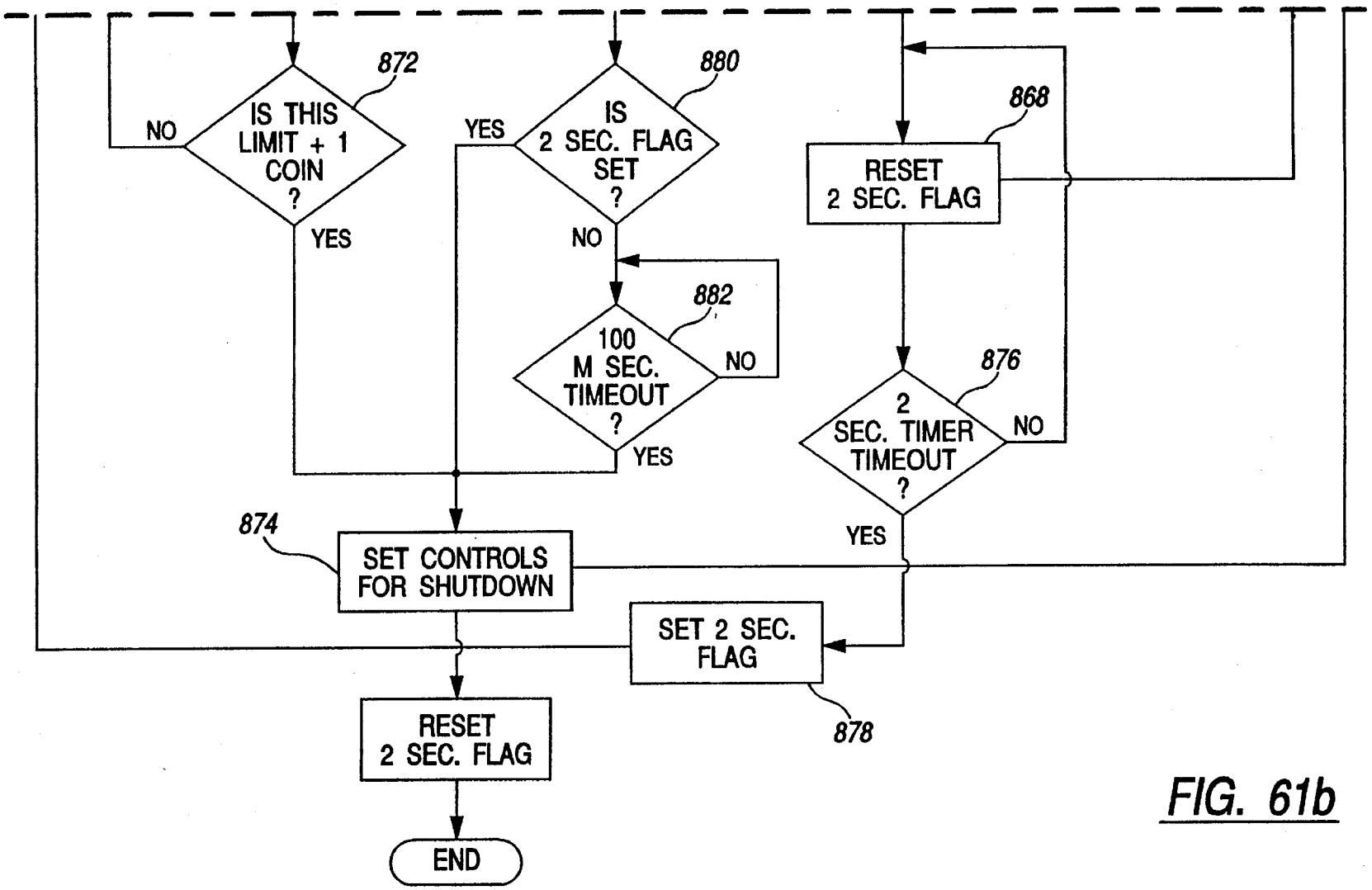

Turning now to FIG. 61, a flow chart shows how the controller (implemented, for example, using a microcomputer) of FIG. 56 may be programmed in accordance with the discussion of FIGS. 56–60 for sorting and counting coins of a particular coin denomination from coins of multiple denominations. Substantive execution begins at block 860 where the controller performs background control functions, such as register and display initialization and timer updates. At block 862, the controller initiates full-speed sorting by turning on the motor and removing the braking force, if any, from the disc.

From block 862, flow proceeds to either block 864 or 866. Block 864 depicts an interrupt routine which is executed in response to the coin sensor (for the particular coin denomination) reporting to the controller that a coin has been sensed, and the interrupt routine may be entered from any of blocks 862–882. The interrupt routine is used to increment the coin count for the particular denomination. Once the interrupt routine has been completed or if no coin is sensed, flow proceeds to block 866, where the controller determines if the coin count has reached the prelimit count, N–1. If the coin count has reached the prelimit count, flow proceeds to block 868 where the controller runs the prelimit speed and begins counting down for the two-second timeout. If the coin count has not reached the prelimit count, flow proceeds to block 870 where the controller determines if this most-recently sensed coin is the limit coin.

At block 870, if this most-recently sensed coin is not the limit coin flow proceeds to block 872 where the controller determines if this coin is the first coin after the limit coin. If the coin is the first coin after the limit coin, flow proceeds to block 874 where the controller disconnects power from the motor and applies full braking force to the disc. If the coin is not the first coin after the limit coin, the controller concludes that the prelimit count has not been reached and flow returns to block 866 where the controller continues execution with the disc sorting at full-speed.

Referring back to blocks 866 and 868, once the controller begins executing the pre-limit speed for the disc, the controller checks its internal timer to determine if the two-second period has lapsed. This is depicted at block 876. Thus, while this period has not lapsed, flow proceeds from block 868 to block 876, to block 868, to block 876, etc. Once this period expires, this loop is exited and flow proceeds from block 876 to block 878 where the controller sets a flag (2SEC flag) to indicate that the two-second period has expired. From block 878, flow proceeds to block 862 where the full-speed sorting is resumed.

If a coin for the particular denomination is sensed before this period expires, flow proceeds from this loop to block 864 where the coin count is incremented. As previously discussed, from block 864 flow returns to block 866 but in this instance with the disc running at the pre-limit speed.

At block 870, if the controller determines that the limit coin has been sensed, the controller begins counting down using the previously discussed 100 millisecond timeout. The controller must next determine whether or not to monitor the 100 millisecond timeout. This determination is depicted at block 880 where the controller queries whether the 2SEC flag is set. If this flag is set, then the system is operating at full speed, the two-second period for running the pre-limit speed has expired, and therefore the 100 millisecond timeout is moot. Flow proceeds from block 880 to block 874 to halt the sorting operation.

At block 880, if the 2SEC flag is not set, then the system is running at the pre-limit speed and the controller monitors the 100 millisecond timeout. Flow proceeds from block 880 to block 882 where the controller begins monitoring the 100 millisecond timeout. Until this timeout period expires, the controller remains in a loop at block 882 with an exit therefrom being provided via the interrupt routine at block 864. If this loop is exited via the interrupt routine, flow returns to block 866, to block 870, to block 872 where the controller determines that the sensed coin is the coin after the limit coin. The controller then shuts down power to the motor, as depicted at block 874. If this loop is exited by timing out, flow also proceeds to block 874 for shutting down power to the motor.

From block 874, flow proceeds to block 880 where the 2SEC flag is reset and the sorting operation terminates for that particular coin denomination.

Figure 62:
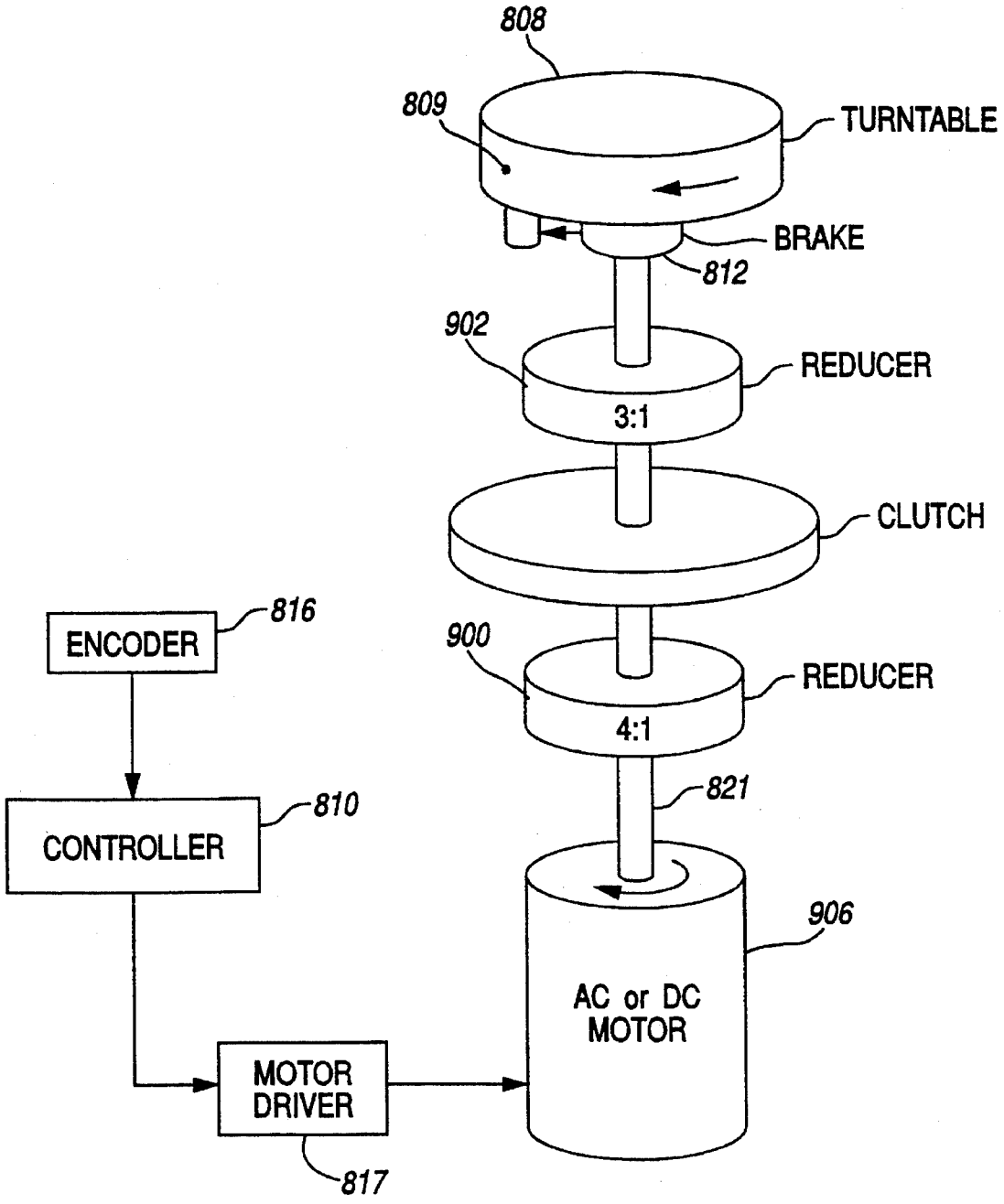
FIG. 62 is a diagram illustrating another coin sorting system using two rotation speed reducers, an encoder, a clutch and a brake, according to the principles of the present invention.

FIG. 62 illustrates a coin sorting system like the one shown in FIG. 56, but modified to include two speed reducers 900 and 902 and a clutch 904. The motor 906 illustrated in FIG. 62 can be an AC-powered motor or a DC-powered motor. Otherwise, common designation numerals are used in both FIGS. 56 and 62 for the same type of component.

The speed reducers 900 and 902 and the clutch 904 permit the system of FIG. 62 to sort at significantly higher speeds than the system shown in FIG. 56, yet with the same quality level of controlling the discharge of the sorted coins. The speed reducers 900 and 902 may be implemented using the configuration shown in either FIG. 57 or FIG. 58 to provide 3:1 and 4:1 speed reduction ratios, respectively, between the motor 906 and the disc (or turntable) 808. The motor 906 may be powered by AC or DC.

Figure 63:
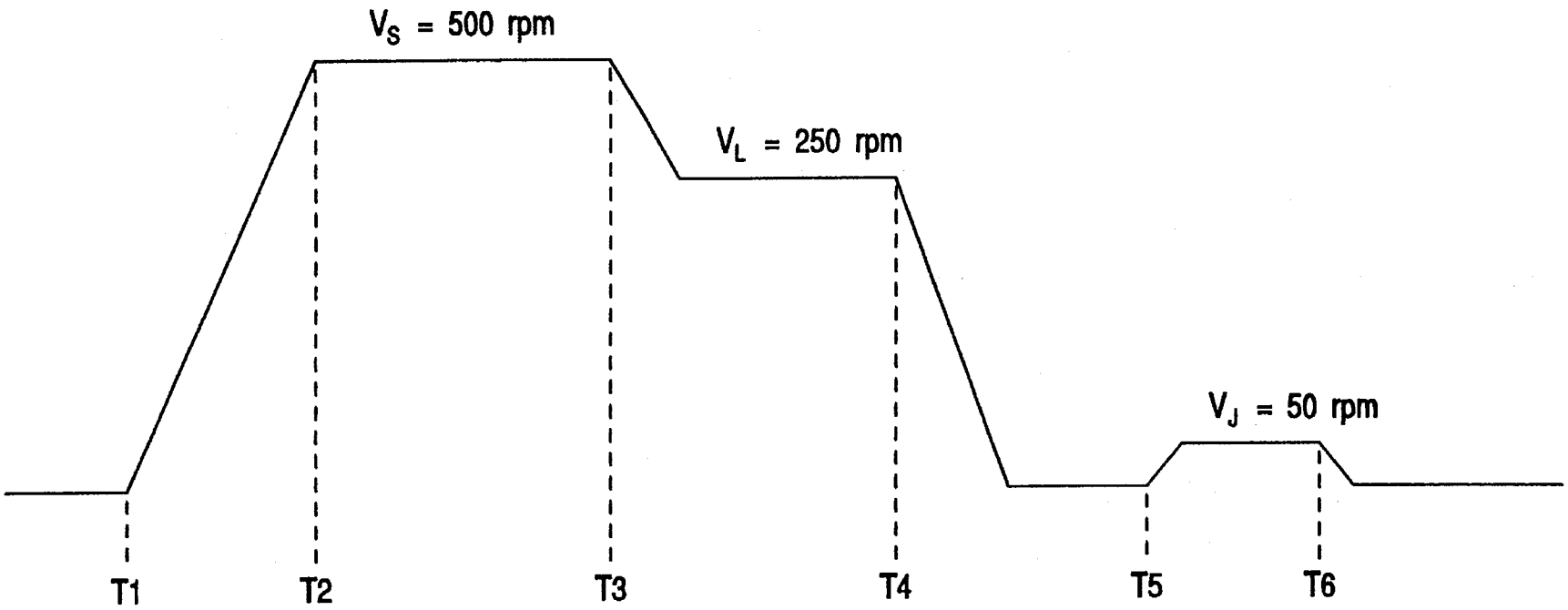
FIG. 63 is a timing diagram illustrating the operation of the system of FIG. 62.

FIG. 63 illustrates a preferred operation for the system of FIG. 62. The sorter is started at time T1. The sorter reaches the nominal sorting speed, $V_s$, at time T2. The value of $V_s$ is dependent upon the sorting process (coin behavior) and the particular application requirements. Assume, for instance, that the value of $V_s$ is 500 RPM.

At time T3, that is to say, at a predetermined number of coins before the limit, the sorter is warned about the impending limit. As a result, the table speed is decreased from the sort speed ($V_s$=500 RPM) to the limit speed, $V_L$. The value of $V_L$ depends on the brake torque and the inertia of the disc (or turn table). In this example, the value of $V_L$ is assumed to be 360 RPM.

Finally, at time T4, the limit coin is detected and the sorter is stopped. The stopping distance of approximately 20 degrees will result in the limit coin being placed in the bag and the coin immediately behind the limit coin being retained in the sort head.

If the stopping distance for the discharge of the limit coin falls short, as indicated by a tracking signal from the encoder or from by the absence of a signal from an outboard sensor (e.g., S7 of FIG. 29), the controller activates a jog phase. This is shown at time T5, where the sorter is restarted at the jog speed of $V_J$ (for example, $V_J$=50 RPM). At time T6, the required head position is reached and the sorter makes its final stop.

Since the jog phase is not a desirable part of the overall machine operation, the brake torque is preferably set to a value that permits achieving the required accuracy of limit stops without the jogging. The jog phase will occur only sporadically when the machine is forced to stop while operating at speeds that are lower than the limit speed, $V_L$.

A primary difference between this approach and the one described in connection with FIGS. 56 and **59*a*, 59*b*** is the introduction of the clutch which permits a significant increase in the limit speed, $V_L$, from 120 to 360 RPM. The window of opportunity to deliver the required last five coins at the limit speed of 120 RPM would have to be limited to no more than several seconds. On the other hand, the high limit speed of 360 RPM allows this time interval to be open-ended. To bring the speed of the disc down to a controllable level sufficiently rapidly, disengagement of the clutch and engagement the brake occur simultaneously.

Consistent with the timing diagram of FIG. 63, the controller for the system of FIG. 62 may be programmed for sorting and counting coins of a particular denomination in a manner which is similar to that described in connection with the flow chart of FIG. 61. By adding a few steps just after the background control block (860 of FIG. 61), the $V_s$ (500 RPM) speed corresponds to the highest operating speed for the system. With this modification, the full- and pre-limit speeds referred to in FIG. 61 translate into the three speed operation shown in the timing diagram of FIG. 63. The $V_s$ speed is executed until say 15 coins less than the limit coin are sensed. At this point, the full-limit speed translates to the limit speed $V_L$ (e.g., 360), and the pre-limit speed translates to the jog speed ($V_J$).

Figure 64A:
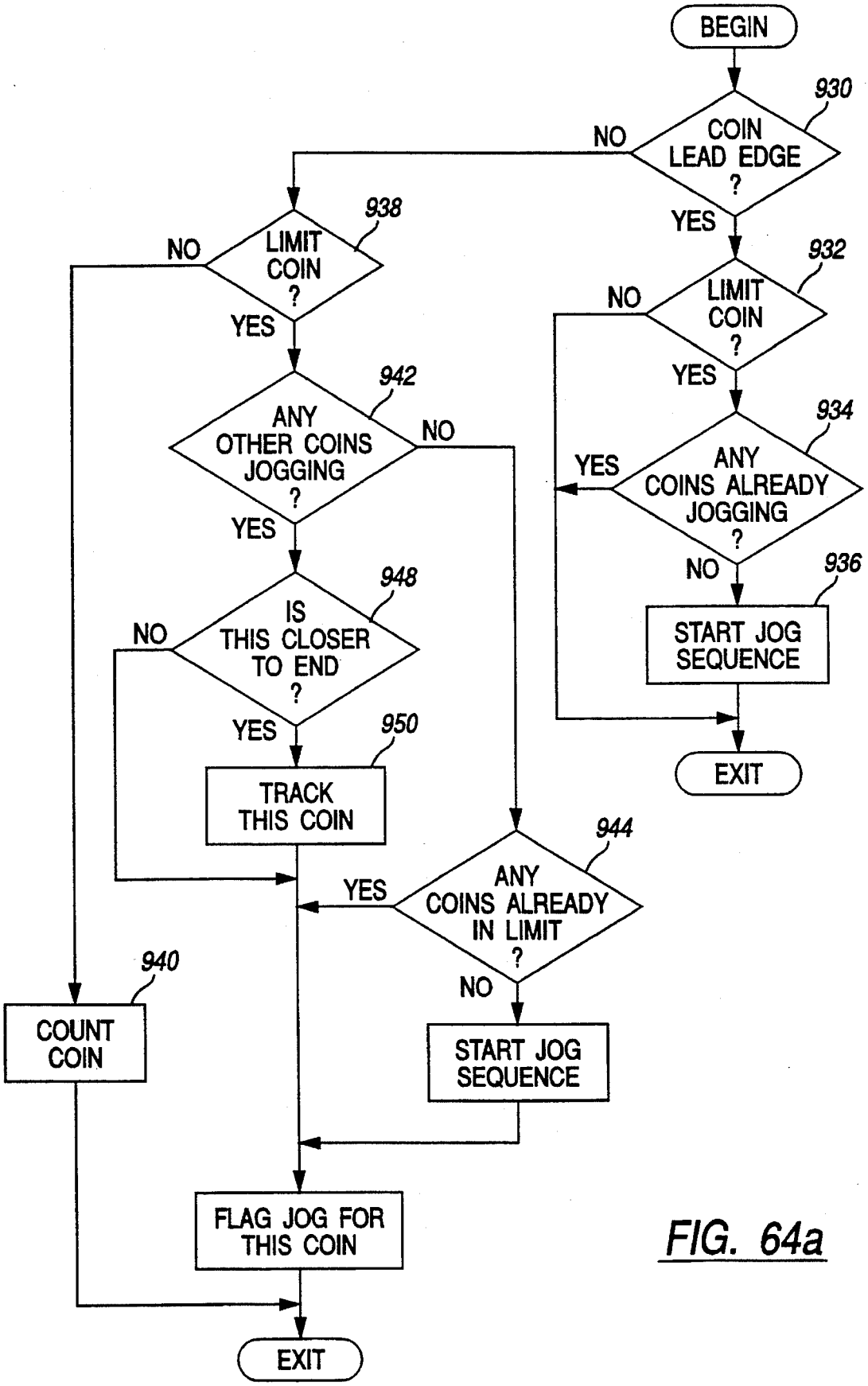
FIGS. 64*a* and 64*b* comprise a flow chart, according to the present invention, showing a way to program a microcomputer for sorting and counting coins of multiple denominations in a coin sorting system, such as the one shown in FIG. 62.
Figure 64B:
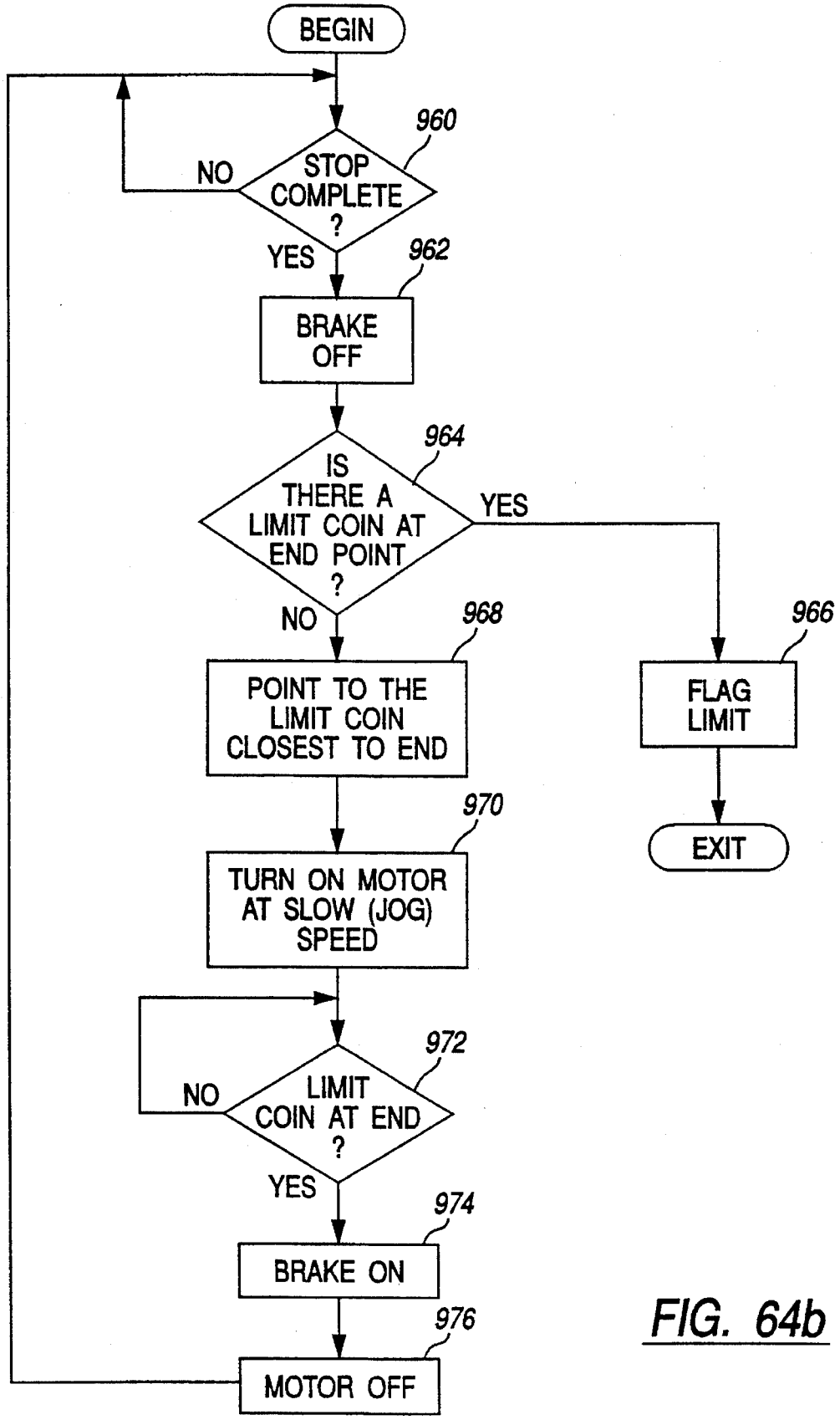

FIGS. 64*a* and 64*b* show a preferred operation for a microcomputer (as part of the controller) for controlling the system of FIG. 62 when sorting and counting coins of multiple denominations. FIG. 64*a* shows the flow for the main program beginning at a point in which the coin sensor for a particular coin denomination indicates that a coin has been sensed. The sensing of the coin is detected by the leading or trailing edge of the coin with the sensor located slightly off center from the coin path. In this way, two coins traveling back-to-back are separately detected. Thus, at block 930 of FIG. 64*a*, the controller performs a test to determine if the coin leading edge or the coin trailing edge has been sensed. If the coin leading edge is sensed, flow proceeds from block 930 to block 932 where another test performed to determine if the coin for the particular coin denomination is the limit coin. If the sensed coin is not the limit coin, flow proceeds from block 932 to the end of the flow chart for exiting this section of the program. The program section is exited at this point, because coins are only counted when their trailing edge is sensed.

If the sensed coin is the limit coin, flow proceeds from block 932 to block 934 to determine whether any coins are already jogging, that is to say, moving on the disc at the jogging speed $V_J$. If the disc is not already operating at the jog speed, flow proceeds from block 934 to block 936 to begin the jog operation. If there are coins already jogging, flow proceeds to the end of the program section for exiting.

Referring back to the decision block 930, if the sensed coin does not correspond to the coin leading edge, flow proceeds from block 930 to block 938 where a test is performed to determine if the sensed coins for the particular coin denomination (corresponding to the sensor location) is the limit coin. This block corresponds exactly to block 932, as previously discussed. If this is not the limit coin that has been sensed, flow proceeds from block 938 to block 940 where the sensed coin is counted. As previously mentioned, the coins are counted in response to sensing their trailing edge. After counting the coin at block 940, this section of the program is exited.

At block 938, if the sensed coin is the limit coin, flow proceeds from block 938 to block 942 to perform a test concerning whether there are coins of other denominations that have prompted the jog sequence. Thus, at block 942, the controller queries whether any other coins are already jogging. If no other coins are jogging, flow proceeds from block 942 to block 944 where the controller performs a test to determine if there are other coins (of other denominations) in the limit, i.e., whether coins of other denominations have been sensed as limit coins. If not, there is no conflict and flow proceeds from block 944 to block 946 where the jog sequence for the limit coin of this sensed coin denomination begins.

At block 942, if there are coins of other denominations already in the jog sequence, flow proceeds from block 942 to block 948 where the controller performs a test to determine which limit coin (of the respective denominations) is closest to being discharged. If this most recently sensed coin is the closest to being discharged, flow proceeds from block 948 to block 950 where the controller tracks this coin using the encoder. If this coin is not the closest to being discharged, flow proceeds from block 948 (skipping block 950) on to block 952. Block 950 is skipped in this event, because a limit coin of another denomination is already being tracked by the encoder. Thus, from block 946 or from block 950, flow proceeds to block 952 where a flag is set to indicate that this sensed coin (for this particular denomination) should be in the jog sequence for proper discharge. Using this flag, the controller is able to perform the determination discussed in connection with block 944, that is to say, whether there are any other coins (of other denominations) in the limit. From block 952 flow proceeds to exit from this section of the program.

Referring now to the flow chart depicted in block 64*b*, this is the jog sequence operation that is executed in blocks 936 and 946 of the flow chart of FIG. 64*a*. Assuming that the limit speed has already been halted by applying the brake (is optionally disengaging the clutch), a decision is performed at block 960 to determine if the rotation of the disc has completely stopped. If not, flow continues in a loop around 960 until the encoder indicates that the disc is completely stopped. From block 960, flow proceeds to block 962 where the controller commands release of the brake. From block 962, flow proceeds to block 964 where the control performs a decision to determine if there is a limit coin at the end point, that is already discharged. If there is a limit coin at the end point, flow proceeds from block 964 to block 966 where a flag is set to indicate that the coin is discharged. The flag of block 966 is used in conjunction with block 942 of FIG. 64A to indicate that there are no longer any coins jogging. From block 966, flow proceeds to execute an exit command to exit from this jog sequence routine. An exit at this point corresponds to a termination of either block 936 or block 946 in FIG. 64*a*.

From block 964, flow proceeds to block 968 when the controller determines that there is no limit coin at the end point. At block 968, the controller uses the encoder to track the limit coin closest to the end point. From block 968, flow proceeds to block 970 where the motor is jogged (pulsing for an AC motor) and variably controlling the power for a DC motor (to slowly direct the coin closest to the end point to the end). From block 970, flow proceeds to block 972 where the controller performs a test to determine if the limit coin is at the end point. If not, flow remains in a loop about block 972 until this limit coin is discharged. From block 972, flow proceeds to block 974 where the brake is applied at full force, and on to block 976 where the motor is turned off. From block 976, flow returns to the top of this routine (block 960) to determine if the jogging speed has come to a stop. In a recursive manner, blocks 960 through blocks 976 are executed again after the user has cleared the insert limit coin's container until all of the limit coins for the respective denominations are discharged.

Yet another important feature embodied by the principles of the present invention concerns the steps of detecting and processing invalid coins. Use of the term "invalid coin" refers to items being circulated on the rotating disc that are not one of the coins (including tokens) to be sorted. For example, it is common that foreign or counterfeit coins enter the coin sorting system. So that such items are not sorted and counted as valid coins, it is helpful to detect and discard the invalid coins from the sorting system. FIG. 65*a* illustrates a block diagram of a circuit arrangement that may be used for this purpose.

The circuit arrangement of FIG. 65*a* includes an oscillator 1002 and a digital signal processor (DSP) 1004, which operate together to detect invalid coins passing under the coil 1006. The coil 1006 is located in the sorting head and is slightly recessed so that passing coins do not contact the coil 1006. The dotted lines, shorting the coil 1006 and connecting another coil 1006, illustrate an alternative electrical implementation of the sensing arrangement. The DSP internally converts analog signals to corresponding digital signals and then analyzes the digital signals to determine whether or not the coin under test is a valid coin. The oscillator 1002 sends an oscillating signal through an inductor 1006. The oscillating signal on the other side of the inductor 1006 is level-adjusted by an amplifier 1007 and then analyzed for phase, amplitude and/or harmonic characteristics by the DSP 1004. The phase, amplitude and/or harmonic characteristics are respectively analyzed and recorded in symbolic form by the DSP 1004 in the absence of any coin passing by the inductor 1006 and also for each coin denomination when a coin of that denomination is passing by the inductor 1006. These recordings are made in the factory, or during set up, before any actual sorting of coins occurs. The characteristics for no coin passing by the inductor 1006 are recorded in memory which is internal to the DSP 1004, and the characteristics for each coin denomination when a coin of that particular denomination is passing by the inductor 1006 are respectively stored in memory circuits 1008, 1010 and 1012. The memory circuits 1008, 1010, 1012 depict an implementation for sorting three denominations of coins, dimes, pennies and nickels, but more or fewer denominations can be used.

With these recordings in place, each time a valid or invalid coin passes by the inductor 1006, the DSP 1004 provides an enable signal (on lead 1013) and an output signal for each of the digital multi-bit comparators 1014, 1016, 1018. When a valid coin passes by the inductor 1006, the output signal corresponds to the characteristics recorded in symbolic form for the subject coin denomination. This output signal is received by each of the comparators 1014, 1016 and 1018 along with the recorded multi-bit output in the associated memory circuit 1014, 1016, 1018. The comparator 1014, 1016 or 1018 for the subject coin denomination generates a high-level (digital "1") output to inform the controller that a valid coin for the subject denomination has been sensed. Using the timing provided by the enable signal, the controller then maintains a count of the coins sensed by the circuit arrangement of FIG. 65*a*.

When an invalid coin passes by the inductor 1006, the output signal provided by the DSP 1004 does not correspond to the characteristics recorded in symbolic form for any of the subject coin denominations. None of the comparators 1014, 1016 and 1018 provides an output signal indicating that a "match" has occurred and the output of each comparator 1014, 1016, 1018 therefore remains at a low level. These low-level outputs from the comparators 1014, 1016, 1018 are combined via a NOR gate 1019 to produce a high-level output for an AND gate 1020. When the enable signal is present, the AND gate 1020 produces a high-level signal indicating that a invalid coin has passed by the inductor 1006 (or sensor/discriminator circuit).

If desired and also using the timing provided by the enable signal, the controller maintains a count of the invalid coins sensed by the circuit arrangement of FIG. 65*a*. The number of detected invalid coins is then displayed on a display driven by the controller.

For further information with respect to the operation of the oscillator 1002, the digital signal processor 1004, the memory circuits 1008, 1010, 1012 and the comparators 1014, 1016, 1018, reference may be made to U.S. Pat. No. 4,579,217 to Rawicz-Szcerbo, entitled Electronic Coin Validator, which is incorporated herein by reference. It should be noted that the coin-equivalent circuits discussed therein may be used in combination with the above-described implementation of the present invention.

An alternative circuit arrangement for sensing valid coins and discriminating invalid coins is shown in FIGS. 65*b-a* and 65*b-b*. This circuit arrangement includes a low-frequency oscillator 1021 and a high-frequency oscillator 1022 providing respective which are summed via a conventional summing circuit 1023. Once amplified using an amplifier 1024, the signal from the output of the summing circuit 1023 is transmitted through a first coil 1025 for reception by a second coil 1026. Preferably, the coils 1025 and 1026 are arranged within a sensor housing (depicted in dotted lines), which is mounted within the underside of the fixed guide plate, so that a coin passing thereunder attenuates the signal received by the second coil 1026. The amount of attentuation is dependent, for example, on a coin's thickness and conductivity.

In this manner, the signal received by the coil 1026 has characteristics which are unique to the condition in which no coin is present under the sensor housing and to each respective type of coin passing under the sensing housing. By using a high-frequency oscillator 1021, e.g., operating at 25 KHz, and a low-frequency oscillator 1021, e.g., operating at 2 KHz, there is a greater likelihood that the signal difference between the various coins will be detected. Thus, after the signal received by the coil 1026 is amplified by an amplifier 1027, it is processed along a first signal path for analyzing the high-frequency component of the signal and along a second signal path for analyzing the low-frequency component of the signal.

From a block diagram perspective, the circuit blocks in each of the first and second signal paths are similar and corresponding designating numbers are used to illustrate this similarity.

There are essentially two modes of operation for the circuit of FIGS. 65*b-a* and 65*b-b*, a normal mode in which there is no coin passing below the sensor housing and a sense mode in which a coin is passing below the sensor housing.

During the normal mode, the high-frequency components of the received signal are passed through a high-pass filter 1028, amplified by a gain-adjustable ampllifier 1029, converted to a DC signal having a voltage which corresponds to the received signal and sent through a switch 1032 which is normally closed. At the other side of the switch 1032, the signal is temporarily preserved in a voltage storage circuit 1033, amplified by an amplifier 1034 and, via an analog-to-digital converter (ADC) 1035, converted to a digital word which a microcomputer (MPU) 1036 analyzes to determine the characteristics of the signal when no coin is passing under the sensor housing. During this normal mode, the gain of the gain-adjustable amplifier 1029 is set according to an error correcting comparator 1030, which receives the output of the amplifier 1034 and a reference voltage ($V_{Ref}$) and corrects the output of the amplifier 1034 until the output of the amplifier matches the reference voltage. In this way, the microcomputer 1036 uses the signal received by the coil 1026 as a reference for the condition of the received signal just before a coin passes under the coil 1026. Because this reference is regularly adjusted, any tolerance variations in the components used to implement the circuit arrangement of FIGS. 65*b-a* and 65*b-b*.

As a coin passes under the sensor housing, a sudden rise is exhibited in the signal at the output of the signal converter 1031. This signal change is sensed by an edge detector 1037, which responds by immediately opening the switch 1032 and notifying the microcomputer 1036 that a coin is being sensed. The switch 1032 is opened to preserve the voltage stored in the voltage storage circuit 1033 and provided to the microcomputer 1036 via the ADC 1035. In response to being notified of the passing coin, the microcomputer 1036 begins comparing the signal at the output of the signal converter 1031, via an ADC 1038, with the voltage stored in the voltage storage circuit 1033. Using the difference between these two signals to define the characteristics of the passing coin, the microcomputer 1036 compares these characteristics to a predetermined range of characteristics for each valid coin denomination to determine which of the valid coin denominations matches the passing coin. If there is no match, the microcomputer 1036 determines that the passing coin is invalid. The result of the comparison is provided to the controller at the output of the microcomputer 1036 as one of several digital words, e.g., respectively corresponding to "one cent," "five cents," "ten cents," "invalid coin."

The signal path for the low-frequency component is generally the same, with the microcomputer 1036 using the signals in each signal path to determine the characteristics of the passing coin. It is noted, however, that the edge detector circuit 1037 is responsive only to the signal in the high-frequency signal path. For further information concerning an exemplary implementation of the structure and/or function of the blocks 1021–1034, 1037 illustrated in FIGS. 65*b-a* and 65*b-b*, reference may be made to U.S. Pat. No. 4,462,513.

The predetermined characteristics for the valid coin denominations are stored in the internal memory of the microcomputer 1036 using a tolerance-calibration process, for each valid coin denomination. The process is implemented using a multitude of coins for each coin denomination. For example, the following process can be used to establish the predetermined characteristics for nickels and dimes. First, the sorting system is loaded with nickels only (the greater the quantity and diversity of type (age and wear level), the more accurate the tolerance range will be). With the switches 1032 and 1032' closed and the microcomputer 1036 programmed to store the high and low frequency attenuation values for each nickel, the sorting system is activated until each nickel is passed under the sensor housing. The microcomputer then searches for the high and low values, for the low frequency and the high frequency, for the set of nickels passing under the sensor housing. The maximum value and the minimum value are stored and used as the outer boundaries, defining the tolerance range for the nickel coin denomination. The same process is repeated for dimes.

Accordingly, the respective circuit arrangements of FIGS. 65*a*, and 65*b-a* and 65*b-b* provde the controller with when a valid coin or an invalid coin passes by the inductor 1006, whether the coin is valid or invalid, and, if valid, the type of coin denomination. By using this circuit arrangement of FIGS. 65*a*, 65*b-a* and 65*b-b* in combination with a properly configured stationary guide, plate, the controller is able to provide an accurate count of each coin denomination, to provide accurate exact bag stop (EBS) sorting, and to detect invalid coins and prevent their discharge as a valid coin.

In addition to the coin sensor/discriminators described in U.S. Pat. Nos. 4,462,513 and 4,579,217, various other types of coin sensor/discriminators which are well-known to the art may be mounted in the stationary sorting head 12 for discriminating between valid and invalid coins. These coin sensor/discriminators detect invalid coins on the basis of an examination of one or more of the following coin characteristics: coin thickness; coin diameter; imprinted or embossed configuration on coin face (e.g., penny has profile of Abraham Lincoln, quarter has profile of George Washington, etc.); smooth or milled peripheral edge of coin; coin weight or mass; metallic content of coin; conductivity of coin; impedance of coin; ferromagnetic properties of coin; imperfections such as holes resulting from damage or otherwise; and optical reflection characteristics of coin. Examples of such coin sensor/discriminators are described in several U.S. Patents, including U.S. Pat. No. 3,559,789 to Hastie et at., No. 3,672,481 to Hastie et at., No. 3,910,394 to Fujita, No. 3,921,003 to Greene, No. 3,978,962 to Gregory, Jr., No. 3,980,168 to Knight et at., No. 4,234,072 to Prumm, No. 4,254,857 to Levasseur et at., No. 4,326,621 to Davies, No. 4,353,452 to Shah et at., No. 4,483,431 to Pratt, No. 4,538,719 to Gray et at., No. 4,667,093 to MacDonald, No. 4,681,204 to Zimmerman, No. 4,696,385 to Davies, No. 4,715,223 to Kaiser et at., No. 4,963,118 to Gunn et at., No. 4,971,187 to Furuya et al., No. 4,995,497 to Kai et al., No. 5,002,174 to Yoshihara, No. 5,021,026 to Goi, No. 5,033,602 to Saarinen et al., No. 5,067,604 to Metcalf, No. 5,141,443 to Rasmussen et al., and No. 5,213,190 to Furneaux et al. The descriptions of the coin sensor/discriminators in the foregoing patents are incorporated herein by reference.

The present invention encompasses a number of ways to detect and process the invalid coins. They can be categorized in one or more of the following types: continual recycling, inboard deflection (or diversion), and outboard deflection.

Figure 66:
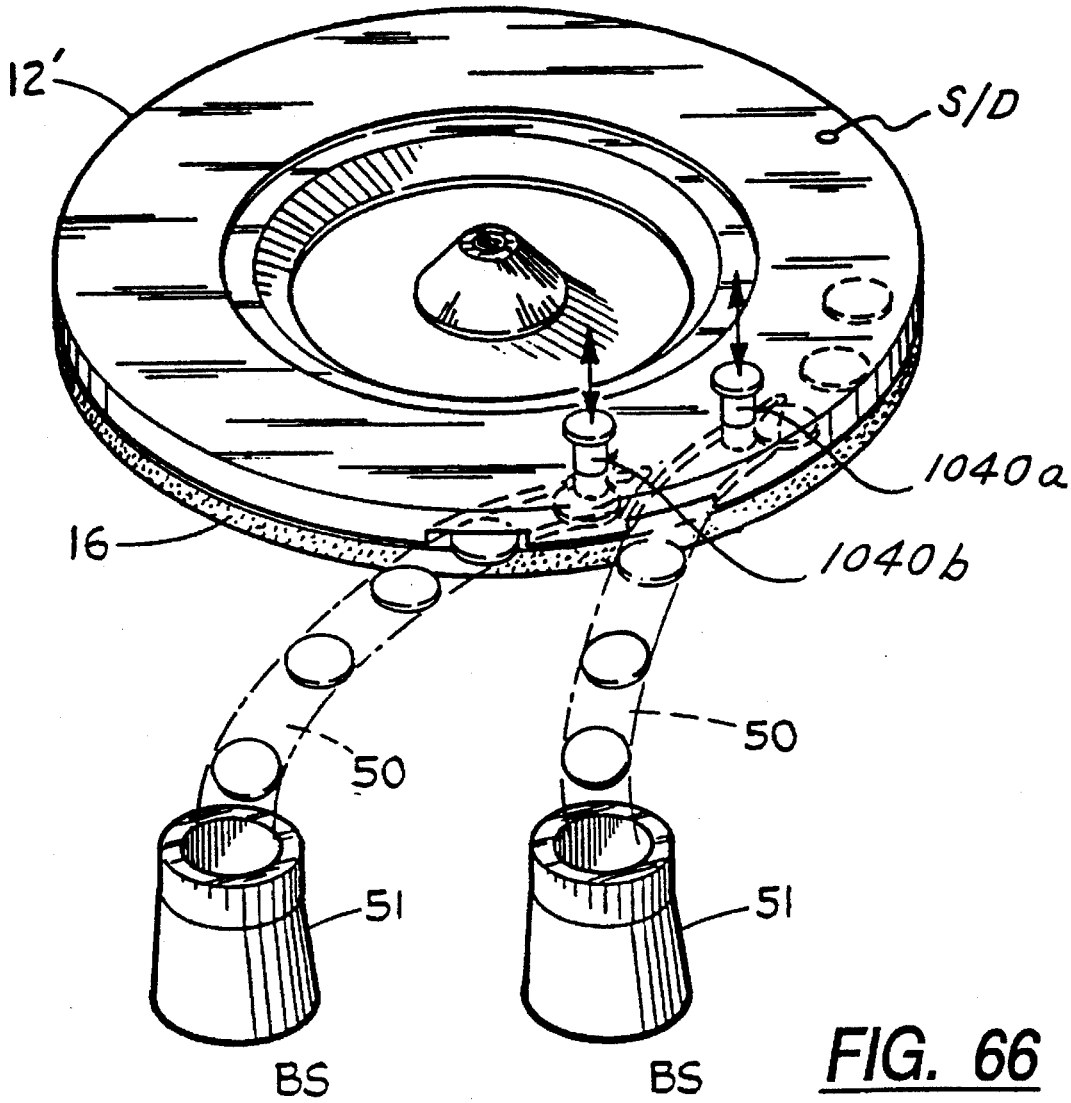
FIG. 66 is a perspective view of a coin sorting arrangement, also in accordance with the present invention, including the sensor/discriminator of FIG. 65 and a coin diverter which is controlled in response to the sensor/discriminator.
Figure 67:
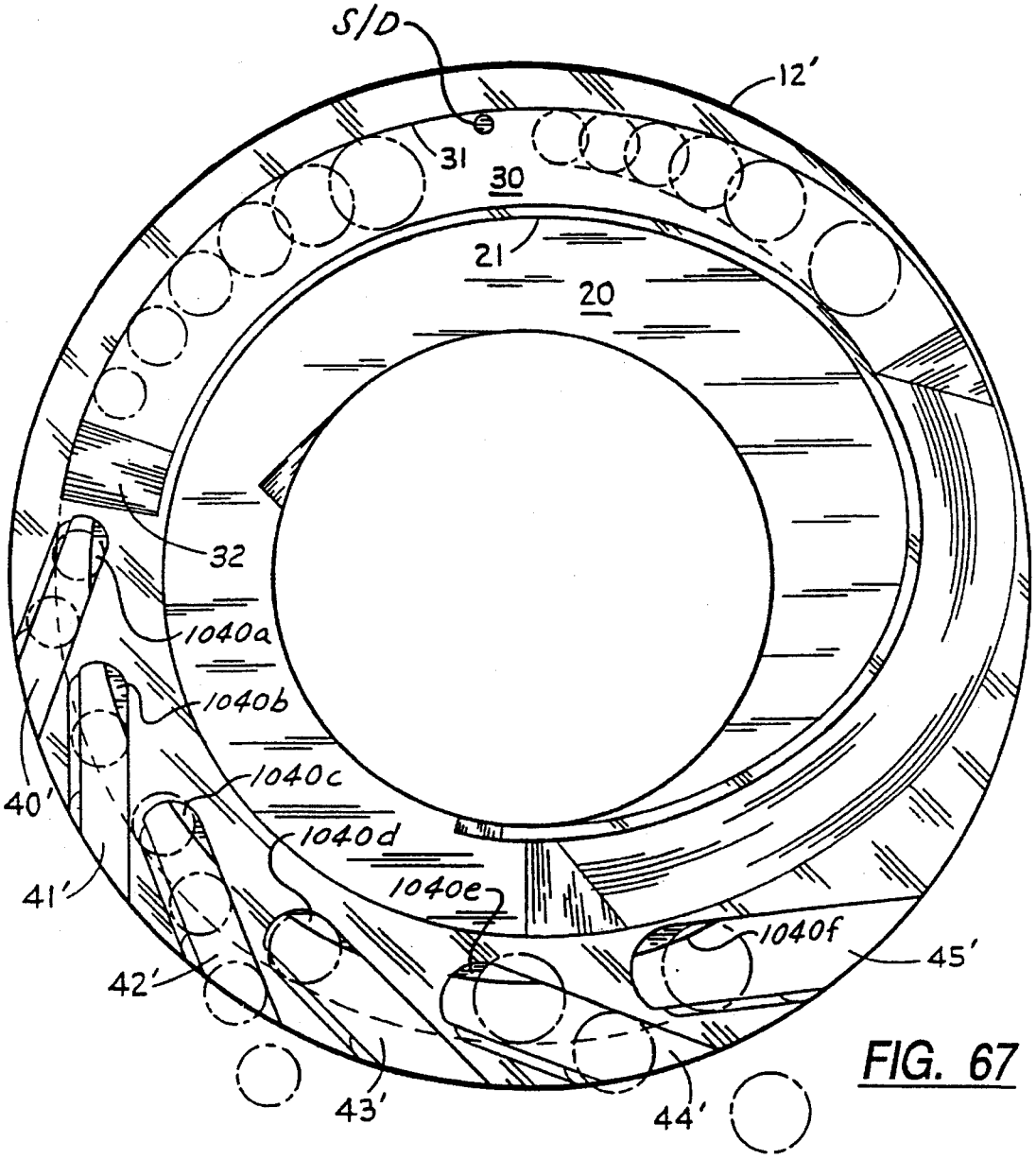
FIG. 67 is a bottom view of a stationary guide plate, according to the present invention, shown in the arrangement of FIG. 66.

A sorting arrangement for the first and second categories, continual recycling and inboard delflection, is illustrated in FIGS. 66 and 67. FIGS. 66 and 67 show the plan view for the guide plate 12' (with the resilient disc 16) and the bottom view for the guide plate 12', respectively, for this sorting arrangement. Except for certain changes to be discussed below, FIGS. 66 and 67 represent the same sorting arrangement as that shown in FIGS. 17.

In FIGS. 66 and 67, a sensor/discriminator is located in an area on the guide plate 12' after the coins are aligned and placed in single file but before they reach the exit paths 40' through 45'. The guide plate 12' includes a diverter 1040 in each coin exit path 40' through 45'. These diverters are used to prevent a coin (valid or invalid) from entering the associated coin exit path. Using a solenoid, the diverter is forced down from within the guide plate 12' and into line with the inside wall recess of the exit path, so as to prevent the inner edge of the coin from catching the inside wall recess as the coin rotates along the exit paths. By locating the sensor/discriminator ("S/D" or inductor 1006 of FIG. 65) upstream of the coin exit paths and selectively engaging each of the diverters (1040*a*, 1040*b*, etc.) in response to detecting an invalid coin, the controller (FIG. 56 or FIG. 62) prevents the discharge of an invalid coin into one of the coin exit paths for a valid coin.

An implementation of the continual recycling technique is accomplished by sequentially engaging each of the diverters (1040*a*, 1040*b*, etc.) in response to detecting an invalid coin using the controller. This forces any invalid coin to recycle back to the center of the rotating disc 16. Based on the speed of the machine and/or rotation tracking using the encoder, the controller sequentially disengages each of the diverters (1040*a*, 1040*b*, etc.) as soon as the invalid coin passes by the associated coin exit path. In this way, invalid coins are continually recycled with the valid coins being sorted and properly discharged as long as the diverters are not engaged. Once the sorter has discharged all (or a significant quantity) of the valid coins, the invalid coins are manually removed and discarded, or automatically discarded using one of the invalid-coin discharge techniques discussed below.

In certain higher-speed implementations, the time required to engage a diverter after sensing the presence of an invalid coin may require slowing down the speed at which the disc is rotating. Speed reduction for this purpose is preferably accomplished using one of the previously discussed brake and/or clutch implementations, as described for example in connection with FIGS. 56 and 62. This also applies for any of the implementations that are described below.

An implementation of the inboard deflection technique is accomplished by using one of the coin exit paths (for example, coin exit path 45') to discard invalid coins. This to in exit path can either be dedicated solely for discharging invalid coins or can be used selectively for discharging coins of the largest coin denomination and invalid coins.

Assuming that the coin exit path 45' is dedicated solely for discharging invalid coins, the implementation is as follows. In response to the S/D indicating the presence of an invalid coin, the controller sequentially engages each of the diverters 1040*a* through 1040*e;* that is, all of the diverters except the last one which is associated with coin exit path 45'. This forces the detected invalid coin to rotate past each of the coin exit paths 40' through 44'. Assuming that the width of the coin exit path 45' is sufficiently large to accommodate the detected invalid coin, it will be discarded via this coin exit path 45'. Based on the speed of the machine and/or tracking using l:he encoder, the controller sequentially disengages each of the diverters (1040*a*, 1040*b*, etc.) as soon as the invalid coin passes by the associated coin exit path. In this way, invalid coins are discarded as they are sensed with most, if not all, valid coins being sorted and properly discharged as long as their diverters are not engaged. Once the sorter has discharged all (or a significant quantity) of the valid coins, any valid coins that may be inadvertently discarded are manually retrieved and inserting back into the system.

Assuming that the coin exit path 45' is used selectively for discharging coins of the largest coin denomination and invalid coins, the above-described implementation is modified slightly. After forcing the detected invalid coins into the coin exit path 45' along with sorted coins of the largest denomination, the bag into which these valid and invalid coins were discharged are returned into the system for operation and sorted using the continually recycling technique, as described above, to separate the valid coins from the invalid coins. Thereafter, the bag of the sorted coins of the largest denomination is removed. The invalid coins remaining in the system are then removed manually or the above-described inboard deflection technique is used with the coin exit path 45' for discharging the invalid coins.

The sensors S1–S6 are not necessary, but may be optionally used to verify, or in place of, the coin-denomination counting function performed in connection with the S/D. By using the sensors S1–S6 in place of the coin-denomination counting function performed in connection with the S/D, the processing time required for the circuit of FIGS. 65*a*, 65*b-a* and 65*b-b* is significantly reduced.

Figure 68:
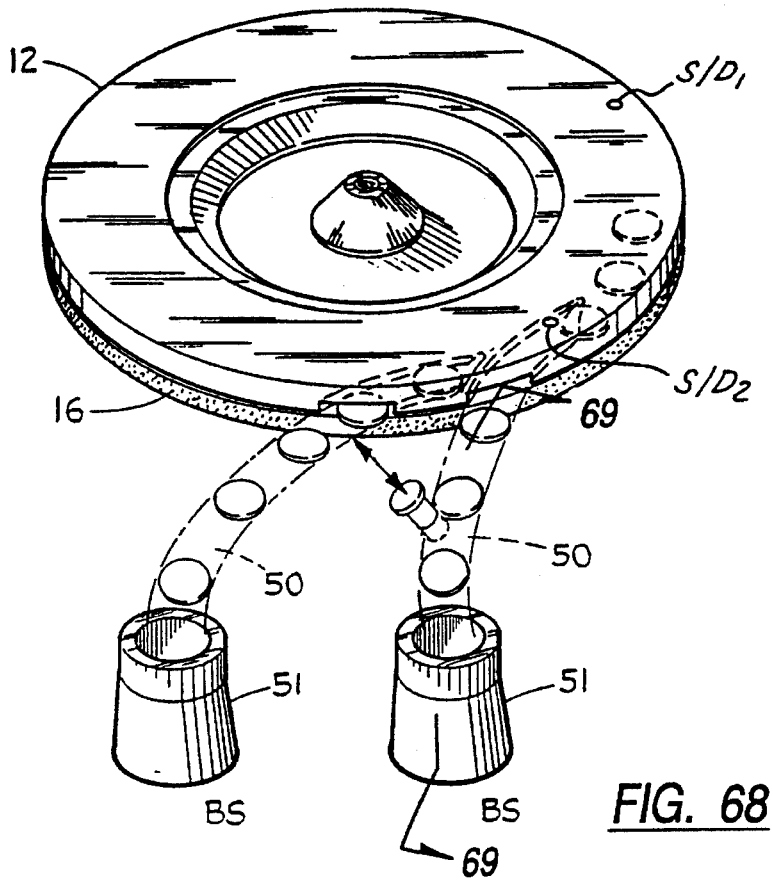
FIG. 68 is a perspective view of another coin sorting arrangement, also in accordance with the present invention.
Figure 69:
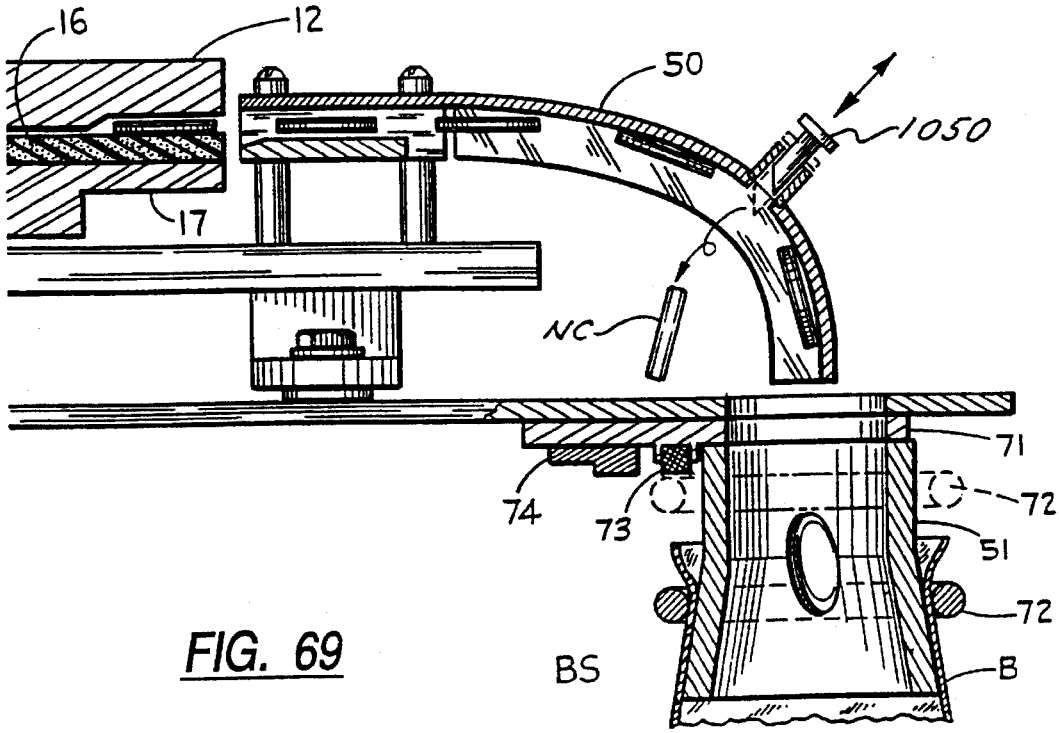
FIG. 69 is a cut-away view of the system shown in FIG. 68, showing an invalid coin being deflected from a coin exit chute.

An implementation of the outboard deflection technique is illustrated in FIGS. 68 and 69. FIG. 68 is similar to FIG. 66, except that the guide plate of FIG. 68 includes a sensor/discriminator ($S/D_2$) in the coin exit path and a coin deflector 1050 outboard of the periphery of the disc 16. The use of $S/D_1$ prior to the exit path and $S/D_2$ in the exit path provides for a dual check on coin validity. The coin deflector 1050 just outside the disc is engaged by the controller in response to the sensor discriminator ($S/D_2$) detecting an invalid coin exiting the coin exit path. FIG. 69 shows the coin deflector 1050 from a side perspective deflecting an invalid coin, depicted by the notation NC.

The sensor/discriminator ($S/D_1$) is not a necessary element, but may be used to reduce the sorting speed (via the jogging mode discussed supra) when an invalid coin passes under the sensor/discriminator ($S/D_1$). By reducing the sorting speed in this manner, the controller has more time to engage the deflector 1050 to its fullest coin-deflecting position. Preferably, the sorting system includes a coin sensor/discriminator in each coin exit path with an associated deflector located outboard for deflecting invalid coins which enter the coin exit path. Positioning a coin sensor/discriminator in each coin exit channel permits the controller to directly count coin denominations as they pass through their respective exit channels.

Figure 71:
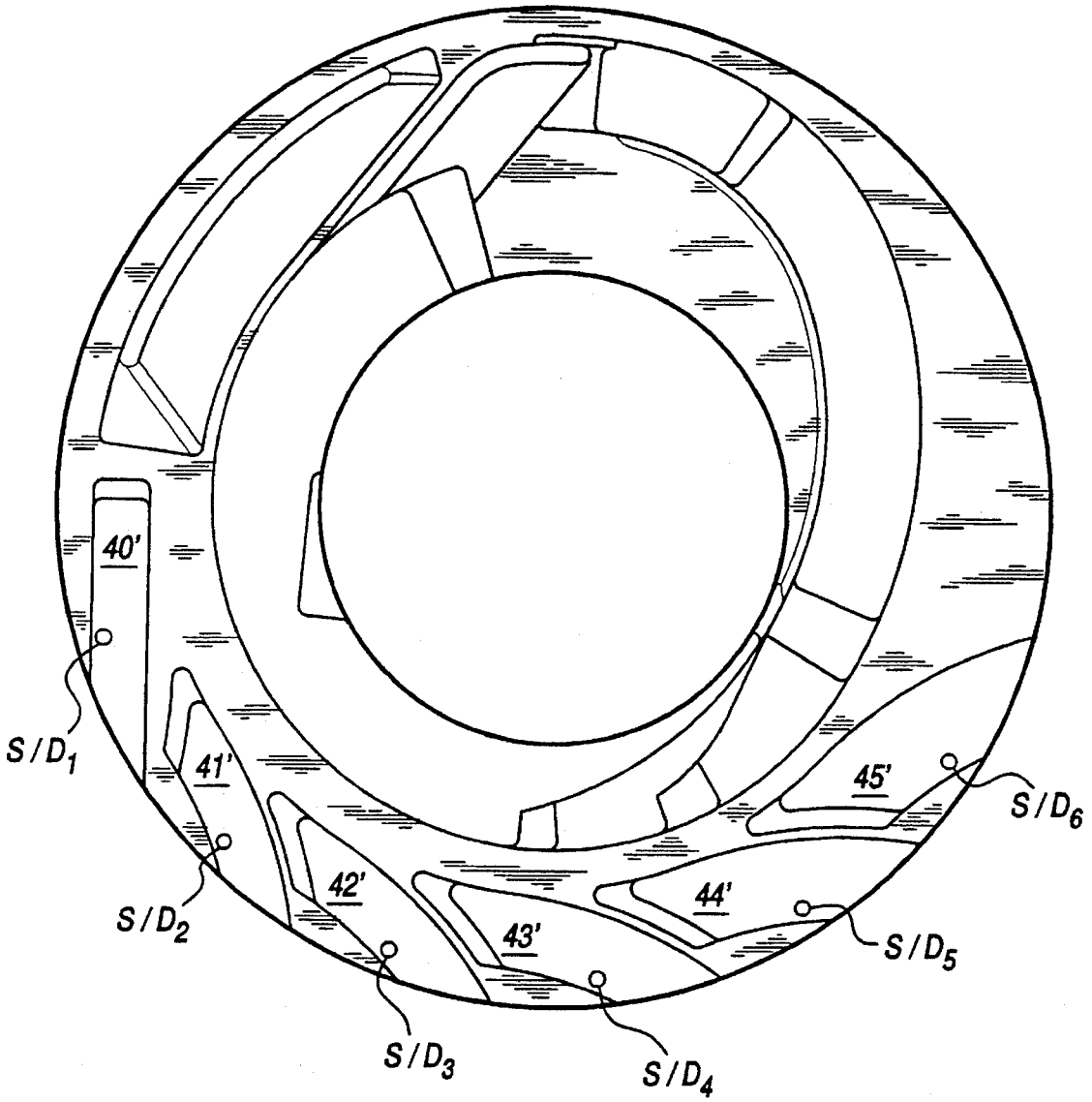
FIG. 71 is a bottom plan view of a sorting head including coin sensor/discriminators for use in the coin sorting system of FIG. 1, and embodying the present invention.
Figure 72:
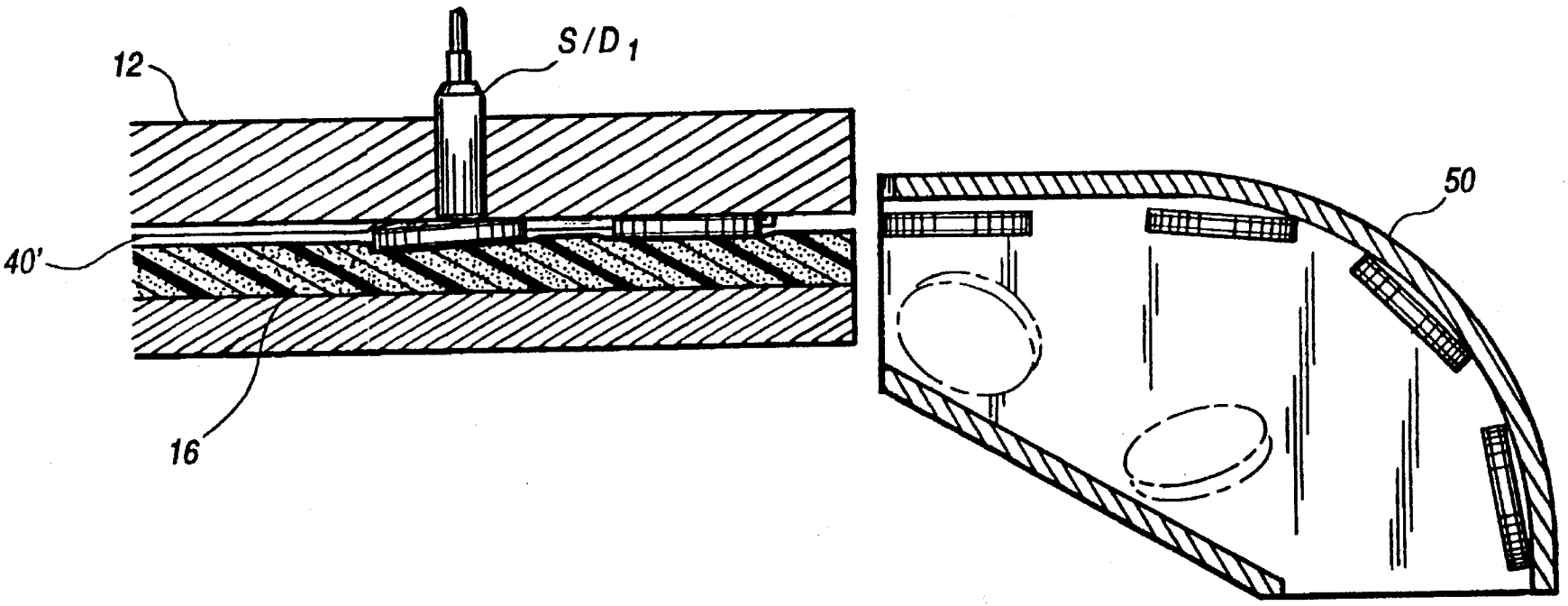
FIG. 72 is an enlarged section taken generally along line 72—72 in FIG. 71.

FIG. 71 depicts a sorting head in which each of the exit channels 40' through 45' is provided with its own coin sensor/discriminator. These coin sensor/discriminators are designated as $S/D_1$ through $S/D_6$. With this arrangement of coin sensor/discriminators, each exit channel is monitored by its respective coin sensor/discriminator for invalid coins. FIG. 72 is a side view showing the coin sensor/discriminator $S/D_1$ mounted in the guide plate 12 above the exit channel 40'. The other coin sensor/discriminators are mounted in similar fashion in the guide plate 12 above their respective exit channels. If the guide channel 50 associated with each exit channel is also provided with its own coin deflector (see FIG. 69), then the coin deflector of a particular guide channel is engaged by the controller in response to the sensor discriminator detecting an invalid coin exiting the exit channel associated with that guide channel. If desired, the controller can also maintain separate counts of the invalid coins sensed by each sensor/discriminator as previously described.

For each of the various arrangements of coin sensor/discriminators described above, the jogging mode may be used in combination with the encoder to track an invalid coin once it has been sensed. For example, in the arrangement of FIG. 71 where a sensor/discriminator is located in each of the exit channels 40' through 45', the disc is stopped by de-energizing or disengaging the drive motor and energizing the brake. The disc is initially stopped as soon as the trailing edge of an invalid coin in an exit channel clears the sensor/discriminator located in that exit channel, so that the invalid coin is well within the exit channel when the disc comes to a rest. The invalid coin is then discharged by jogging the drive motor with one or more electrical pulses until the trailing edge of the invalid coin clears the exit edge of its exit channel.

Figures 70A, 70B:
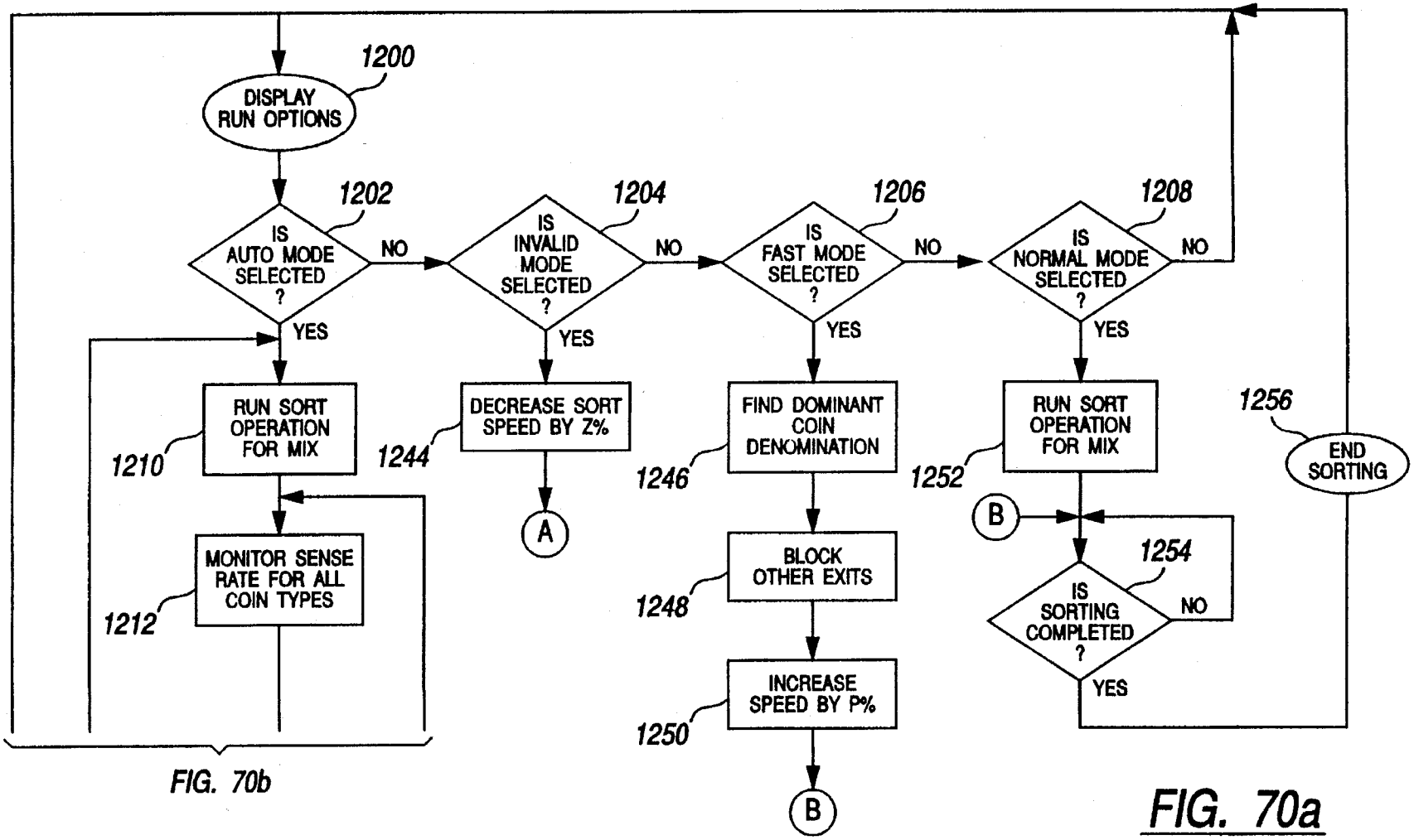
FIGS. 70*a* and 70*b* are a flow chart, according to the present invention, showing a way to program a controller for sorting and counting coins of multiple denominations in a coin sorting system, such as the one shown in FIG. 62 and FIG. 67.
Figures 70A, 70B:
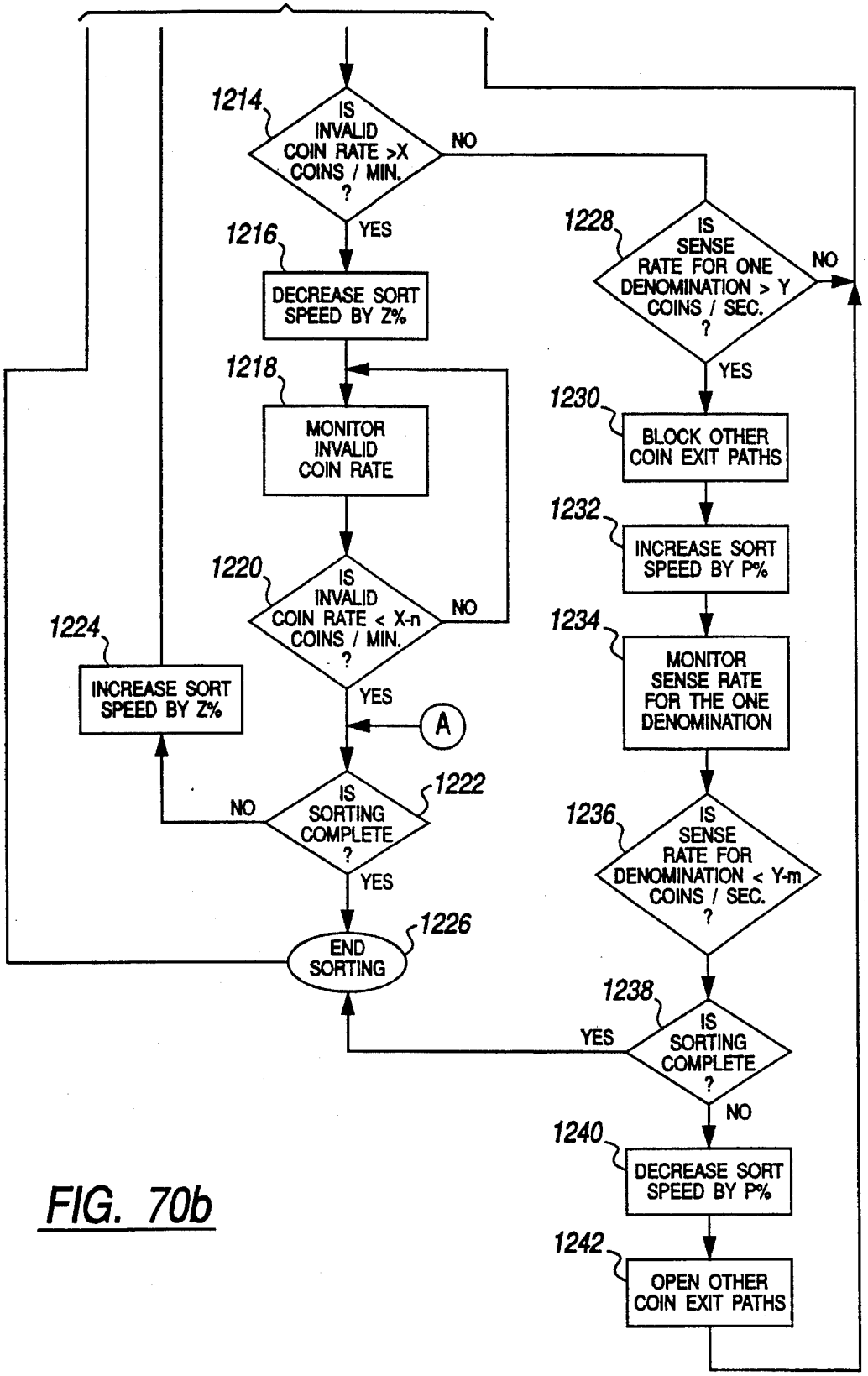

Another important aspect of the present invention concerns the capability of the system of FIG. 67 (or one of the other systems illustrated in the drawings) operating in a selected one of four different modes. These modes include an automatic mode, an invalid mode, a fast mode and a normal mode. The automatic mode involves initially running the sorting system for a normal mix of coin denominations and changing the sorting speed if the rate of invalid coins being detected is excessive or the rate of coins of a single coin denomination is excessive. By using the sensor/discriminator to educate the controller as to the type of coin mix, the controller can control the speed of the sorting system to optimize the sorting speed and accuracy. The invalid mode is manually selected by the user of the sorting system to run the sorting system at a slower speed. This mode insures that no invalid coin will be counted and sorted as one of the valid coin denominations. The fast mode is manually selected, and it involves the sorting system determining which of the coin denominations is dominant and sorting for that coin denomination at a higher sorting speed. The normal mode is also manually selected to run the sorting system without taking any special action for an excessive rate of invalid coins or coins of a particular denomination which dominate the mix of coins. FIGS. 70*a* and 70*b* illustrate process for programming the controller to accommodate these four sorting modes.

The flow chart begins at block 1200 where the sorting system displays each of the four sorting run options. From block 1200, flow proceeds to block 1202 where the controller begins waiting for the user to select one of the four modes. At block 1202, the controller determines if the automatic (auto) mode has been selected. If not, flow proceeds to block 1204 where the controller determines if the invalid mode has been selected. If neither the auto mode nor the invalid mode has been selected, flow proceeds to block 1206 where the controller determines if the fast mode has been selected. Finally, flow proceeds to block 1208 to determine if the normal mode has been selected. If none of the modes have been selected, flow returns from block 1208 to block 1200 where the controller continues to display the run option.

From block 1202, flow proceeds to block 1210 in response to the controller determining that the user has selected the auto mode. At block 1210, the controller runs the sorting system for a typical mix of coin denominations. From block 1210, flow proceeds to block 1212 where the controller begins tracking the rate of coins being sensed per minute, for each coin denomination. This can be done using one of the circuit arrangements shown in FIGS. 65*a*, 65*b-a* and 65*b-b*. From block 1214, flow proceeds to block 1216 in response to the controller determining that the rate of invalid coins being sensed is greater than a predetermined threshold (X coins/minute), e.g., X=5. This threshold can be selected for the particular application at hand.

At block 1216, the controller decreases the sorting speed by a certain amount (z %), for example, 10%. This is done to increase the accuracy of the sorting for invalid coins.

From block 1216 flow proceeds to block 1218 where the controller monitors the invalid coin rate to determine if the invalid coin rate has decreased significantly. At block 1220, the controller compares the invalid coin rate to a threshold somewhat less than the predetermined threshold (x) described in connection with block 1214. For example, if the predetermined threshold is five coins per minute, then the threshold used in connection with block 1220 (x–n) can be set at two coins per minute (x–n=2). This provides a level of hysteresis so that the controller does not change the sorting speed excessively. From block 1220, flow proceeds to block 1222 to determine if the sorting system has completely sorted out coins. A sensor/discriminator determines that sorting is complete when the sensor/discriminator fails to sense any coins (valid or invalid) for more than a predetermined time period. If sorting is not complete, flow proceeds from block 1222 to block 1224 where the where the controller increases the sorting speed by the same factor (z) as was used to reduce the sorting speed. From block 1224, flow returns to block 1210 where the controller continues to run the sorting operation for a normal mix of coin denominations and repeats this same process. From block 1222, flow proceeds to block 1226 in response to the controller determining that sorting of all coins has been completed. At block 1226, the controller shuts down the machine to end the sorting process, and returns to block 1200 to provide the user with a full display and the ability to select one of the four run options again.

If the auto mode is not selected (block 1202) and the invalid mode is selected, flow proceeds from block 1204 to block 1244 where the controller decreases the sorting speed by a predetermined factor (Z %). From block 1244, flow proceeds to block 1254, where the sorting system continues to sort until the sorting is complete. This mode can be selected by the user when the user is concerned that there may be an excessive number of invalid coins and wants to decrease the possibility of missorting. Thus, the sorting system sorts at a slower sorting rate from the very beginning of the sorting process.

If the user selects the fast mode, flow proceeds from block 1206 to block 1246 where the controller begins counting and comparing each of the coin denominations to determine which of the coin denominations is dominant. For example, if after thirty seconds of sorting, the controller determines that most of the coins in the system are dimes, the controller designates the dime denomination as the dominant one. From block 1246, flow proceeds to block 1248 where the controller uses the diverters (FIG. 67) to block all coin exit paths other than the exit path for dimes. From block 1248, flow proceeds to block 1250 where the controller increases the sorting speed by a predetermined factor (P %), for example, 10%. In this manner, the controller learns which of the coin denominations is the dominant one and sorts only for that denomination at a higher speed. The exit paths for the other coin denominations are blocked to minimize a coin being missorted.

If the user selects the normal mode, flow proceeds from block 1208 to block 1252 where the controller runs the sorting system for a normal mix of coin denominations. Because the controller is taking no special action for an excessive number of invalid coins or a dominant coin denomination, the controller runs the sorting system as previously described (e.g., any of the systems described in connection with FIGS. 56–64*b*) until the sorting of all coins has been completed, as depicted at block 1254. From block 1254, flow proceeds to block 1256 where the controller terminates the sorting process and then proceeds to block 1200 to permit the user to select another run option.

Accordingly, while the present invention has been described with reference to multiple embodiments using one or more types of coin-sensing, coin-counting and coin-discriminating techniques, those skilled in the art will recognize that many changes may be made thereto without departing from the spirit and scope of the present invention. For example, the previously described coin sensor/discriminators may be used in sorting heads designed to discharge various numbers of denominations, including sorting heads designed to discharge three denominations (FIG. 2) and sorting heads designed to discharge six denominations (FIG. 22). Each of these embodiments and obvious variations thereof is contemplated as falling within the spirit and scope of the claimed invention, which is set forth in the following claims.

What is claimed is:

1. A coin sorter, comprising:

a rotatable disc;

a drive motor for rotating said disc;

a stationary sorting head having a lower surface generally parallel to an upper surface of said rotatable disc and spaced slightly therefrom, said lower surface of said sorting head forming a plurality of exit channels for guiding coins of different denominations to different discharge stations around the periphery of said disc; and a coin sensor/discriminator mounted in said stationary sorting head over said rotatable disc for discriminating between valid and invalid coins guided by said stationary sorting head.

2. The coin sorter of claim 1, further including a controller, coupled to said coin sensor/discriminator, for counting valid coins sensed by said coin sensor/discriminator.

3. The coin sorter of claim 1, further including a controller, coupled to said coin sensor/discriminator, for counting invalid coins sensed by said coin sensor/discriminator.

4. The coin sorter of claim 1, wherein said coin sensor/discriminator is mounted in said stationary head upstream of said plurality of coin exit channels.

5. The coin sorter of claim 4, further including a diverter located in a coin route between said coin sensor/discriminator and said discharge stations, and further including a control circuit, responsive to said coin sensor/discriminator sensing an invalid coin in said coin route, engaging said diverter to prevent said invalid coin from being discharged into its respective discharge station.

6. The coin sorter of claim 1, wherein said coin sensor/discriminator is mounted in said stationary head over one of said plurality of coin exit channels.

7. The coin sorter of claim 6, further including a controller, coupled to said coin sensor/discriminator, for counting valid coins passing through said one of said plurality of coin exit channels.

8. The coin sorter of claim 6, further including a controller, coupled to said coin sensor/discriminator, for counting invalid coins passing through said one of said plurality of coin exit channels.

9. The coin sorter of claim 1, wherein said coin sensor/discriminator includes a circuit having a signal-carrying inductor and an oscillator circuit providing an output signal.

10. The coin sorter of claim 9, wherein said coin sensor/discriminator includes a digital signal processing circuit analyzing said output signal of said oscillator circuit.

11. The coin sorter of claim 10, wherein said digital signal processing circuit provides a signal representing characteristics that are unique to an invalid coin.

12. The coin sorter of claim 5, wherein said control circuit is coupled to said rotatable disc and controls the speed of said rotatable disc.

13. The coin sorter of claim 12, wherein said control circuit responds to said coin sensor/discriminator by reducing the speed of said rotatable disc.

14. The coin sorter of claim 1, wherein said coin sensor/discriminator discriminates between invalid and valid coins based on at least one coin characteristic selected from the group consisting of: thickness, diameter, imprinted configuration on coin face, smooth or milled peripheral edge, weight, mass, metallic content, conductivity, impedance, ferromagnetic properties, imperfections such as holes, and optical reflection properties.

15. A coin sorter, comprising:

a rotatable disc;

a drive motor for rotating said disc;

a stationary sorting head having a lower surface generally parallel to the upper surface of said rotatable disc and spaced slightly therefrom, said lower surface of said sorting head forming a plurality of exit channels for guiding coins of different denominations to different discharge stations around the periphery of said disc; and a plurality of coin sensor/discriminators mounted in said stationary sorting head over said rotatable disc for discriminating between valid and invalid coins guided by said stationary sorting head, at least one coin sensor/discriminator being mounted in each of said plurality of exit channels.

16. The coin sorter of claim 15, further including a controller, coupled to each of said coin sensor/discriminators, for counting valid coins sensed by said coin sensor/discriminators.

17. The coin sorter of claim 15, further including a controller, coupled to each of said coin sensor/discriminators, for counting invalid coins sensed by said coin sensor/discriminators.

18. The coin sorter of claim 15, further including a plurality of diverters located downstream from said exit channels and upstream from said discharge stations, and further including a control circuit, responsive to one of said plurality of coin sensor/discriminators sensing an invalid coin in said coin route, engaging said diverter to prevent said invalid coin from being discharged into its respective discharge station.

19. The coin sorter of claim 15, wherein said coin sensor/discriminators each include a circuit having a signal-carrying inductor and an oscillator circuit providing an output signal.

20. The coin sorter of claim 19, wherein said coin sensor/discriminators each include a digital signal processing circuit analyzing said output signal of said oscillator circuit.

21. The coin sorter of claim 20, wherein said digital signal processing circuit provides a signal representing characteristics that are unique to an invalid coin.

22. The coin sorter of claim 18, wherein said control circuit is coupled to said rotatable disc and controls the speed of said rotatable disc.

23. The coin sorter of claim 22, wherein said control circuit responds to said one of said plurality of coin sensor/discriminators by reducing the speed of said rotatable disc.

24. The coin sorter of claim 15, wherein said coin sensor/discriminators discriminate between invalid and valid coins based on at least one coin characteristic selected from the group consisting of: thickness, diameter, imprinted configuration on coin face, smooth or milled peripheral edge, weight, mass, metallic content, conductivity, impedance, ferromagnetic properties, imperfections such as holes, and optical reflection properties.

25. A coin sorter for sorting coins of at least one coin denomination from an invalid item not of said at least one coin denomination, the coin sorter comprising:

a motor having a motor output shaft rotatable at a first speed;

a rotatable disc, coupled to the motor output shaft, having a resilient surface for receiving said coins and, via the motor output shaft of the motor, imparting rotational movement to said coins;

a stationary sorting head having a contoured surface spaced slightly away from and generally parallel to said resilient surface of said rotatable disc, said stationary sorting head configured and arranged for sorting and discharging said coins of said at least one coin denomination through respective coin denomination exit paths around the periphery of said stationary sorting head and into associated stationary coin-collecting containers;

an electrical sensor, located at a fixed sensing station over the rotatable disc, sensing an invalid item while the invalid item is rotating on the rotatable disc;

a diverter, located in a coin route between the electrical sensor and the stationary coin-collecting containers; and a control circuit, responsive to the electrical sensor sensing an invalid item in the coin route, engaging the diverter to prevent the invalid item from being discharged into the associated stationary coin-collecting container;

further including an encoder for tracking the position of the invalid item in response to the electrical sensor while the invalid item traverses said coin route between the electrical sensor and the associated stationary coin-collecting container.

26. A coin sorter for sorting coins of at least one coin denomination from an invalid item not of said at least one coin denomination, the coin sorter comprising:

a motor having a motor output shaft rotatable at a first speed;

a rotatable disc, coupled to the motor output shaft, having a resilient surface for receiving said coins and, via the motor output shaft of the motor, imparting rotational movement to said coins;

a stationary sorting head having a contoured surface spaced slightly away from and generally parallel to said resilient surface of said rotatable disc, said stationary sorting head configured and arranged for sorting and discharging said coins of said at least one coin denomination through respective coin denomination exit paths around the periphery of said stationary sorting head and into associated stationary coin-collecting containers:

an electrical sensor, located at a fixed sensing station over the rotatable disc, sensing an invalid item while the invalid item is rotating on the rotatable disc;

a diverter, located in a coin route between the electrical sensor and the stationary coin-collecting containers; and a control circuit, responsive to the electrical sensor sensing an invalid item in the coin route, engaging the diverter to prevent the invalid item from being discharged into the associated stationary coin-collecting containers;

wherein the control circuit is coupled to the rotatable disc and controls the speed of the rotatable disc.

27. A coin sorter, according to claim 26, wherein the control circuit responds to the electrical sensor by reducing the speed of the rotatable disc.

28. A coin sorter for sorting coins of at least one coin denomination from an invalid item not of said at least one coin denomination, the coin sorter comprising:

a motor having a motor output shaft rotatable at a first speed;

a rotatable disc, coupled to the motor output shaft, having a resilient surface for receiving said coins and, via the motor output shaft of the motor, imparting rotational movement to said coins;

a stationary sorting head having a contoured surface spaced slightly away from and generally parallel to said resilient surface of said rotatable disc, said stationary sorting head configured and arranged for sorting and discharging said coins of said at least one coin denomination through respective coin denomination exit paths around the periphery of said stationary sorting head and into associated stationary coin-collecting containers;

an electrical sensor, located at a fixed sensing station over the rotatable disc, sensing an invalid item while the invalid item is rotating on the rotatable disc;

a diverter, located in a coin route between the electrical sensor and the stationary coin-collecting containers; and a control circuit, responsive to the electrical sensor sensing an invalid item in the coin route, engaging the diverter to prevent the invalid item from being discharged into the associated stationary coin-collecting containers;

wherein the diverter is constructed and arranged to divert coins of said at least one denomination while they are on the rotatable disc.

29. A coin sorter for sorting coins of at least one coin denomination from an invalid item not of said at least one coin denomination, the coin sorter comprising:

a motor having a motor output shaft rotatable at a first speed;

a rotatable disc, coupled to the motor output shaft, having a resilient surface for receiving said coins and, via the motor output shaft of the motor, imparting rotational movement to said coins;

a stationary sorting head having a contoured surface spaced slightly away from and generally parallel to said resilient surface of said rotatable disc, said stationary sorting head configured and arranged for sorting and discharging said coins of said at least one coin denomination through respective coin denomination exit paths around the periphery of said stationary sorting head and into associated stationary coin-collecting containers;

an electrical sensor, located at a fixed sensing station over the rotatable disc, sensing an invalid item while the invalid item is rotating on the rotatable disc;

a diverter, located in a coin route between the electrical sensor and the stationary coin-collecting containers:

a control circuit, responsive to the electrical sensor sensing an invalid item in the coin route, engaging the diverter to prevent the invalid item from being discharged into the associated stationary coin-collecting containers;

wherein the diverter is constructed and arranged to divert invalid item, and wherein the diverter diverts invalid items while they are on the rotatable disc.

30. A coin sorter, according to claim 29, wherein the diverter forces the invalid items to be recycled.

31. A coin sorter for sorting coins of at least one coin denomination an invalid item not of said at least one coin denomination, the coin sorter comprising:

a motor having a motor output shaft rotatable at a first speed;

a rotatable disc, coupled to the motor output shaft, having a resilient surface for receiving said coins and, via the motor output shaft of the motor, imparting rotational movement to said coins;

a stationary sorting head having a contoured surface spaced slightly away from and generally parallel to said resilient surface of said rotatable disc, said stationary sorting head configured and arranged for sorting and discharging said coins of said at least one coin denomination through respective coin denomination exit paths around the periphery of said stationary sorting head and into associated stationary coin-collecting containers;

an electrical sensor, located at a fixed sensing station over the rotatable disc, sensing an invalid item while the invalid item is rotating on the rotatable disc;

a diverter, located in a coin route between the electrical sensor and the stationary coin-collecting containers; and a control circuit, responsive to the electrical sensor sensing an invalid item in the coin route, engaging the diverter to prevent the invalid item from being discharged into the associated stationary coin-collecting containers;

wherein the electrical sensor is constructed and arranged for sensing invalid items within one of the coin denomination exit paths.

32. A coin sorter for sorting coins of at least one coin denomination from an invalid item not of said at least one coin denomination, the coin sorter comprising:

a motor having a motor output shaft rotatable at a first speed;

a rotatable disc, coupled to the motor output shaft, having a resilient surface for receiving said coins and, via the motor output shaft of the motor, imparting rotational movement to said coins;

a stationary sorting head having a contoured surface spaced slightly away from and generally parallel to said resilient surface of said rotatable disc, said stationary sorting head configured and arranged for sorting and discharging said coins of said at least one coin denomination through respective coin denomination exit paths around the periphery of said stationary sorting head and into associated stationary coin-collecting containers;

an electrical sensor, located at a fixed sensing station over the rotatable disc, sensing an invalid item while the invalid item is rotating on the rotatable disc;

a diverter, located in a coin route between the electrical sensor and the stationary coin-collecting containers; and a control circuit, responsive to the electrical sensor sensing an invalid item in the coin route, engaging the diverter to prevent the invalid item from being discharged into the associated stationary coin-collecting containers;

wherein the electrical sensor is constructed and arranged for sensing invalid items upstream of the coin denomination exit paths and wherein the diverter diverts invalid items after they leave the periphery of the rotatable disc, and in response to sensing invalid items upstream of the coin denomination exit paths the control circuit reduces the speed of the rotatable disc.

33. A coin sorter for sorting coins of at least one coin denomination from an invalid item not of said at least one coin denomination, the coin sorter comprising:

a motor having a motor output shaft rotatable at a first speed;

a rotatable disc, coupled to the motor output shaft, having a resilient surface for receiving said coins and, via the motor output shaft of the motor, imparting rotational, movement to said coins;

a stationary sorting head having a contoured surface spaced slightly away from and generally parallel to said resilient surface of said rotatable disc, said stationary, sorting head configured and arranged for sorting and discharging said coins of said at least one coin denomination through respective coin denomination exit paths around the periphery of said stationary sorting head and into associated stationary coin-collecting containers;

an electrical sensor, located at a fixed sensing station over the rotatable disc, sensing an invalid item while the invalid item is rotating on the rotatable disc;

a diverter, in a coin route between the electrical sensor and the stationary coin-collecting containers; and a control circuit, responsive to the electrical sensor sensing an invalid item in the coin route, engaging the diverter to prevent the invalid item from being discharged into the associated stationary coin-collecting containers;

wherein the electrical sensor is constructed and arranged for sensing invalid items within one of the coin denomination exit paths and, in response thereto, the diverter diverts the sensed invalid items after they leave the periphery of the rotatable disc.

34. A coin sorter, comprising:

a rotatable disc;

a drive motor for rotating said disc;

a stationary sorting head having a lower surface generally parallel to the upper surface of said rotatable disc and spaced slightly therefrom, said lower surface of said sorting head forming a plurality of exit channels for guiding coins of different denominations to different discharge stations around the periphery of said disc;

a coin sensor/discriminator mounted in said stationary sorting head over said rotatable disc for discriminating between valid and invalid coins guided by said stationary sorting head; and a control unit, responsive to detection of an invalid coin by said coin sensor/discriminator, for stopping rotation of said disc and then controllably discharging said invalid coin from one of said plurality of exit channels.

35. A coin sorter for sorting coins of at least one coin denomination from an invalid item not of said at least one coin denomination, the coin sorter comprising:

a motor having a motor output shaft rotatable at a first speed;

a rotatable disc, coupled to the motor output shaft, having a resilient upper surface for receiving said coins thereon and, via the motor output shaft of the motor, imparting rotational movement to said coins;

a stationary sorting head having a lower contoured surface spaced slightly above and generally parallel to said resilient upper surface of said rotatable disc, said stationary sorting head configured and arranged for sorting and discharging said coins of said at least one coin denomination through respective coin denomination exit paths around the periphery of said stationary sorting head and into associated stationary coin-collecting containers;

an electrical sensor, located at a fixed sensing station over the rotatable disc, sensing an invalid item while the invalid item is rotating on the rotatable disc;

a diverter, located in a coin route between the electrical sensor and the stationary coin-collecting containers; and a control circuit, responsive to the electrical sensor sensing an invalid item in the coin route, engaging the diverter to prevent the invalid item from being discharged into the associated stationary coin-collecting containers.

36. A coin sorting device for sorting coins of at least one coin denomination from an invalid item not of said at least one coin denomination, comprising:

a coin-driving member having a resilient surface;

a stationary coin-guiding member having a coin-guiding surface opposing the resilient surface of the coin-driving member, the coin-guiding surface being positioned generally parallel to the resilient surface and spaced slightly therefrom, the resilient surface of the coin-driving member constructed and arranged to move coins along the coin-guiding surface of the coin-guiding member, the coin-guiding surface configured and arranged for sorting and discharging the coins of said at least one denomination through respective coin denomination exit stations formed by the coin-guiding surface; and a coin sensor/discriminator, located at a fixed sensing station adjacent the coin-driving member, for sensing invalid items after the invalid items enter one of the coin denomination exit paths.

37. A coin sorter, comprising:

a rotatable disc;

a drive motor for rotating said disc;

a stationary sorting head mounted over said rotatable disc, said sorting head having a lower surface generally parallel to an upper surface of said rotatable disc and spaced slightly therefrom, said lower surface of said sorting head forming a plurality of exit channels for guiding coins of different denominations to different discharge stations around the periphery of said disc; and a coin sensor/discriminator, located at a fixed sensing station over said rotatable disc, for discriminating between valid and invalid coins guided by said stationary sorting head.

* * * * *